United States Patent [19]

Yoseloff

[11] 4,008,893

[45] Feb. 22, 1977

[54] SIMULATED BOWLING GAME

[76] Inventor: Mark Yoseloff, 8 Candle Lane, East Brunswick, N.J. 08816

[22] Filed: Feb. 26, 1975

[21] Appl. No.: 553,361

[52] U.S. Cl. ..... 273/85 R; 273/37; 273/138 A

[51] Int. Cl.[2] ..... A63F 7/06

[58] Field of Search ..... 35/25; 235/1 C, 92 GA, 235/184; 273/1 E, 37–39, 41, 85 R, 86 R, 93 R, 154 C, 101.1 R, 101.2 R, 101.2 B, 138 A, DIG. 28, 118 A, 119 A, 120 A, 121 A; 340/323, 384 R, 384 E

[56] References Cited

UNITED STATES PATENTS

| | | | |
|---|---|---|---|
| 2,643,884 | 6/1953 | Koci | 273/41 |
| 2,652,252 | 9/1953 | Alexander | 273/38 |
| 3,269,731 | 8/1966 | Koci et al. | 273/85 R |
| 3,703,288 | 11/1972 | Vogel et al. | 273/41 |
| 3,778,058 | 12/1973 | Rausch | 273/85 R |
| 3,831,172 | 8/1974 | Gluges et al. | 273/1 E X |
| 3,874,669 | 4/1975 | Ariano et al. | 273/85 R |

*Primary Examiner*—Richard C. Pinkham
*Assistant Examiner*—Vance Y. Hum
*Attorney, Agent, or Firm*—Lawrence I. Field

[57] ABSTRACT

A simulated bowling game includes solid state logic circuitry for simulating the position of a bowling ball as it is rolled down the alley, for determining the simulated disposition of the pins upon impact by the ball, and for computing the score of each player after each simulated roll of the ball. In order to imitate the roll of a ball, a player selects an initial ball position and an initial ball direction. Encoders provide signals which correspond to the selected initial ball position and direction, and a random number generator provides a spin factor signal. A horizontal displacement signal is computed from the ball direction signal and the spin factor signal and is added to the ball position signal to establish the horizontal ball position at successive vertical positions along the alley. Pin disposition logic determines which pins will fall upon impact by the ball and is responsive to the horizontal position of the ball as it enters the pin target area, the ball direction signal, the previous status of the pins, and a random signal from the random number generator. A pair of pin status registers are provided for storing the current status of the pins and registering changes as pins are indicated as fallen by the pin disposition logic. A scoring pulse train generator is responsive to one of the pin status registers for providing a single pulse chain, a double pulse train, and a triple pulse train, which include, respectively, one, two, and three pulses for each fallen pin; the pulse trains are employed in the scoring logic. A pin display includes lamps which indicate which of the pins is standing; these lamps are controlled by signals from the other status register to indicate the current pin status. After a ball reaches the pin target area, a ball return sequence is established showing the ball returning down the alley back to the starting line.

24 Claims, 30 Drawing Figures

FROM FIG. 4C
BOWLING PIN-FALL LOGIC
160
TO FIG. 4E
589
590
591
593
594
595
597
598
599
601
602
603
604
605
606
607
608
609
611
612
613
614
615
616
617
620
624
625
626
627
628
629
630
631
632
633
634
639
640
644
565
567
568
569
570
571
572

TO FIG. 4F
FROM FIG. 4D
BOWLING PIN
STATUS REGISTERS
650 (170 AND 171)
592
596
600
610
618
619
621
623
622
635
636
637
638
641
642
643
645
646
AA
S
V
PIN 1
PIN 2
PIN 3
PIN 4
PIN 5
PIN 6
PIN 7
PIN 8
PIN 9
651
652
653
654
655
656
657
658
659

FROM FIG. 4E
TO FIG. 4G

PIN 1
PIN 2
PIN 3
PIN 4
PIN 5
PIN 6
PIN 7
PIN 8
PIN 9
PIN 10
J3-14
J3-11
J3-12
J3-9
J3-10
J3-7
J3-8
J3-5
J3-6
J3-3
BOWLING PIN DRIVERS
175
672-1
672-2
672-3
672-4
672-5
672-6
672-7
672-8
672-9
672-10

FROM FIG. 4F
STRIKE OR SPARE TEST
200
STRIKE
LL
692
693
694
695
ALL PINS DOWN
685
687
689
690
691
688
FF
x
n
JJ
SPARE
KK
HH
700
MM
696
697
701
698
699
NN
680
681
682
683
684
S
R
Q
q
p
CC
197
PIN STATUS STORE
702
703
704
PP
TO FIG. 4H

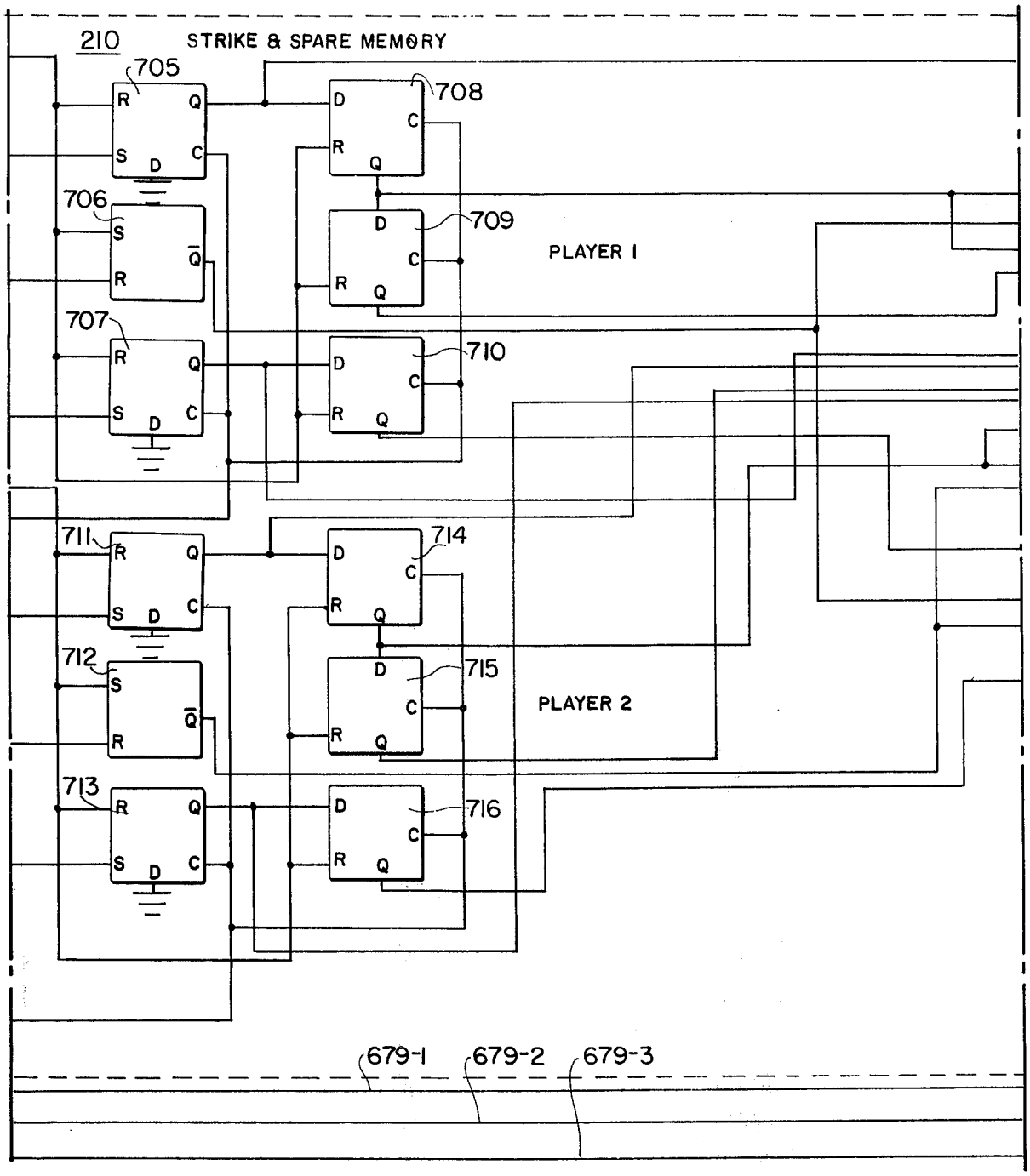
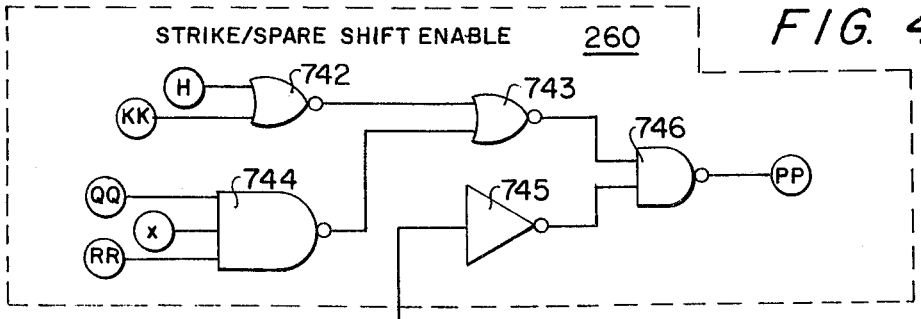
FIG. 4H
FROM FIG. 4G
TO FIG. 4I

J7-H
STRIKE 2-PLAYER I
TO LAMP DRIVERS
717
J7-J
STRIKE I-PLAYERI
J7-L
SPARE PLAYER I
J7-N
STRIKE 2-PLAYER 2
719
J7-M
SPARE-PLAYER 2
718
J7-K
STRIKE I-PLAYER 2
JJ
720
726
n
STRIKE/SPARE
MEMORY
MULTIPLEXING
721
722
724
723
YY
X
679-1
679-2
679-3
FROM FIG. 4H
TO FIG. 4J

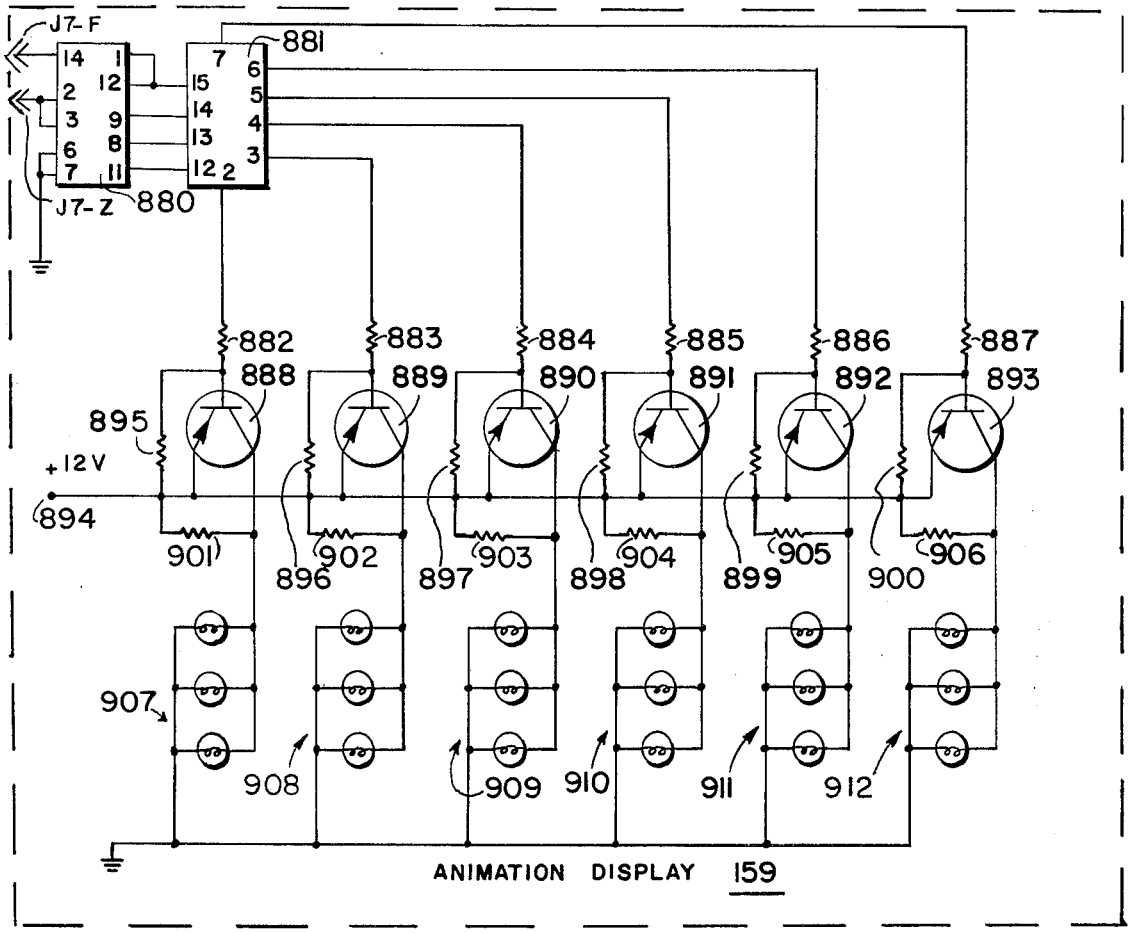
FIG. 6C
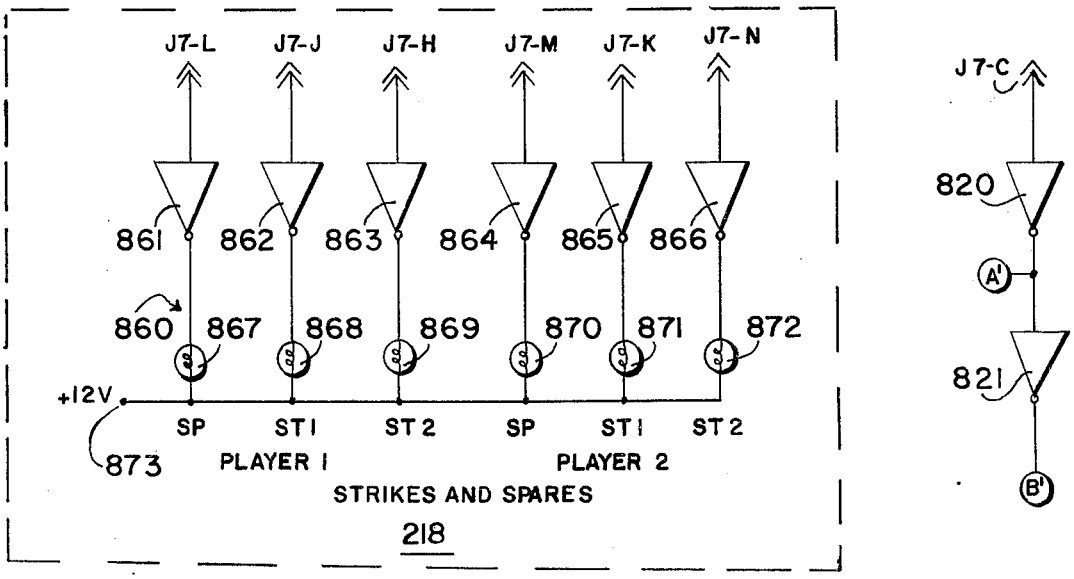

SIMULATED BOWLING GAME

BACKGROUND OF THE INVENTION

This invention relates to simulated games and, more particularly, to a simulated bowling game employing solid state logic.

There have been a number of proposals in the prior art for games which simulate the movement of an object to a target area. In the games, which are, for example, disclosed in Hurley U.S. Pat. Nos. 3,337,218; 3,604,707; and 3,637,202, the accuracy of a simulated horseshoe toss, dart toss, or bird shoot is determined by the player who presses a button two times in succession. If the time spacing between the actuations of the button are equal to some predetermined interval, the object is shown as travelling along an accurate path. If, however, the time between actuations of the button differs from the predetermined interval, an inaccurate movement of the object is determined and displayed. It has also been proposed to simulate a bowling game, and such a device is shown in Coci et al, U.S. Pat. No. 3,269,731. In the game shown in this patent, the path of the ball may be selected by pivoting a ball path selector bar to different path positions. A plurality of lamps are carried by the bar and display the movement of the ball down the alley to the pin area.

These prior art simulated games are limited in appeal, because they lack any element of chance and thus do not duplicate the excitement and unpredictability of real games. In a real bowling game, for example, there are always random factors affecting the accuracy of the ball roll and determining which pins will fall when a ball enters the pin target area.

SUMMARY OF THE INVENTION

It is, accordingly, the principal object of the present invention to provide an improved simulated game.

It is a further object of the invention to provide a simulated game in which the simulated path of a ball, or other projectile, is determined both by operator selected factors and by chance factors. More specifically, it is an object of the invention to provide a simulated bowling game of this character in which the determination of which pins fall is also controlled by operator selected factors and chance factors.

It is another object of the invention to provide a simulated bowling game employing solid state logic to determine the path of the ball, to determine which pins will fall, and to determine the score. It is also an object of the invention to provide a game of this character including display means showing the roll of the ball down the alley, displaying which pins are standing, displaying the score, and showing the return of the ball to the starting line.

To these ends, the present invention contemplates a simulated bowling game which broadly includes ball path selection means under the control of the operator, random signal means, and ball position means for simulating movement of the ball down a bowling alley in response to the ball path selection means and the random signal means. Display means displays the movement of the ball down the alley and includes a plurality of rows and columns of lamps and associated circuitry which respond to signals provided by the ball position means for showing the successive positions of the ball as it moves from a starting line to a pin target area of a simulated bowling alley. The ball path selection means includes a plurality of keys for selecting an initial ball position and a plurality of keys for selecting a ball direction. When one ball position and one ball direction are selected, a ball release logic circuit initiates a ball roll sequence. Encoder circuitry is provided for converting the selected initial position and ball direction to ball position and direction signals. A horizontal ball position displacement generator logic circuit generates a horizontal displacement signal for the ball as it progresses down the alley in response to a spin factor signal, which is derived from the random signal means, and the ball direction signal. This horizontal displacement signal is added to the initial ball position signal to establish the horizontal ball position at each step along the alley from the starting line to the pin target area.

A pin disposition logic circuit responds to the horizontal ball position of the ball as it enters the target area, the ball direction signal, a pin status signal (whether pins are standing or fallen) as provided by a pin status register, and a random signal provided by the random signal means. The output from the pin disposition logic circuit adjusts a pair of pin status registers. One of the pin status registers controls a scoring pulse generator which provides a single pulse train, a double pulse train, and a triple pulse train, which signify the number of fallen pins, twice the number of fallen pins, and three times the number of fallen pins, respectively. These pulse trains are coupled to a scoring logic section. This pin status register provides the pin status signal to the pin disposition logic circuit and controls a strike/spare test logic circuit. The other pin status register controls a bowling pin display circuit.

The scoring logic section includes current ball, player alternation and frame number logic circuits which keep track of the ball rolled, the players and the frames for each. When the tenth frame has been counted, an end of game logic circuit provides an END OF GAME signal to appropriate indicator lamps. If the tenth frame has not been counted, an $\overline{\text{END OF GAME}}$ signal is provided to enable the pin control logic. A strike/spare memory receives a signal signifying a strike or a spare, if one has been attained on the previous ball roll, from the strike/spare test logic circuit and, in turn, controls an extra ball test logic circuit which controls extra ball indicator lamps. The strike/spare register also provides signals to a scoring pulse processing logic circuit which receives the pulse trains generated by the scoring pulse generator and selects the pulse train to be counted in a score counter for each player. Each score counter drives a seven-segment LED display to indicate the score. A frame number register drives a seven-segment LED display to indicate the frame number. A ball return sequence logic circuit is enabled and controls lamps indicating the return of the ball to the starting line. A sound generating circuit is used to generate a sound when the ball rolls down the alley and another sound when the ball completes its roll.

These and other objects, features, and advantages of the invention will become more readily apparent from consideration of the following detailed description of a preferred embodiment of the invention along with the drawings.

BRIEF DESCRIPTION OF THE DRAWINGS

FIGS. 4A, 4B, 4C, 4D, 4E, 4F, 4G, 4H, 4I, 4J, 4K, 4L, 4M, 4N, 4O, 4P, and 4Q taken together constitute a schematic diagram of the main logic board of the game of FIG. 1;

FIG. 6C is a schematic circuit diagram of a part of the scoring logic panel of the game of FIG. 1;

DETAILED DESCRIPTION OF THE PREFERRED EMBODIMENT

Figure 1:
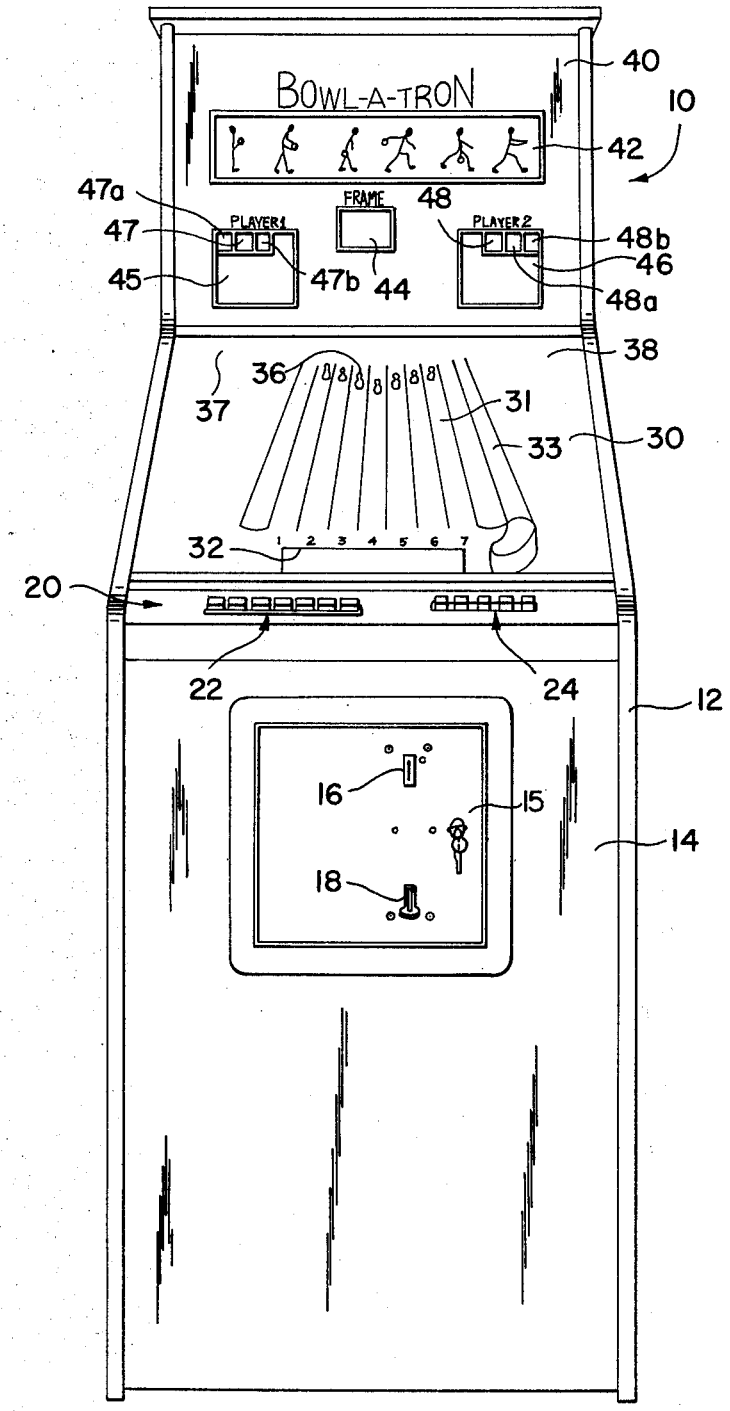
FIG. 1 is a perspective view of a preferred embodiment of a bowling game according to the invention.

A preferred embodiment of a bowling game, according to the present invention, is shown in FIG. 1. The game 10 is housed in a cabinet 12 which has a front panel 14. Mounted on the front panel is a coin receptacle 15 which includes a coin slot 16 and a coin return receptacle 18. The coin mechanism is similar to that employed in the prior art and will not be described in detail in the present application. It will be sufficient to note that the coin mechanism includes a normally closed and a normally open switch and that it can be used to initiate the game for one player or, if desired, for two players by inserting more than one coin. At the top front corner of front panel 14 is a control panel 20 upon which are located seven ball position keys 22 and five ball direction keys 24. These, as will be presently explained, will serve to initiate a simulated ball roll and, in addition, will, in part, determine which pins will fall when the simulated ball reaches a simulated pin target area.

The game 10 further includes an alley display panel 30 which extends rearwardly from control panel 20 in a plane which is inclined slightly upwardly from a horizontal plane. It will be noted from FIG. 1, and, also from FIG. 2 which shows the alley display panel in greater detail, that it includes a simulated bowling alley area 31 having a starting line 32. There is also provided a ball return gutter 33. At the upper end of alley 31, a pin target area 36 is located. As will be observed from FIGS. 1 and 2, a set of 10 bowling pins are displayed in pin target area 36 in the usual triangular array. A pair of auxiliary display areas 37 and 38 are provided in the upper corners of display panel 30. These may be used for displaying messages of importance in the game, such as that the game is over or that an extra ball is available.

Game 10 includes a scoring display panel 40. This panel extends vertically upwardly from the rear back corner of alley panel 30. An animation display panel 42 is provided showing a simulated bowler going through the motions of bowling a ball. This is accomplished by sequentially illuminating six figures as shown in panel 42. Scoring panel 40 also includes a frame number display panel 44 within which the number of the current frame will be displayed. In addition, a pair of scoring panels 45 and 46 are provided, the first for one player designated as "Player 1" and the second for a second player designated as "Player 2". Each of the player scoring panels 45 and 46 includes a large open area for displaying the score of the player in question as well as three small squares, 47, 47*a*, and 47*b* for scoring area 45 the squares 48, 48*a*, 48*b* for scoring area 46. These additional small squares serve as areas for indicating spares and strikes as is customary in the scoring of bowling.

Figure 2:
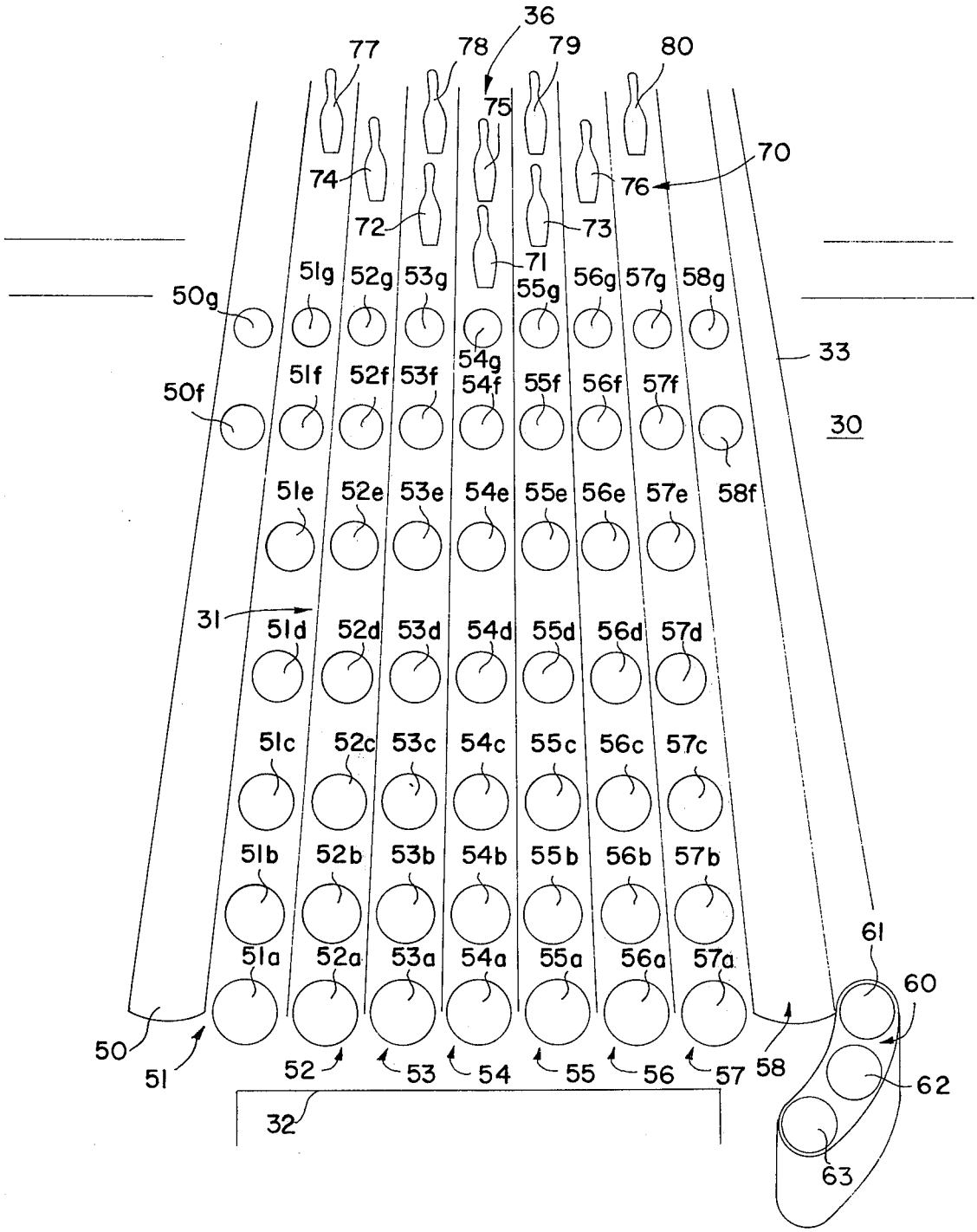
FIG. 2 is a schematic diagram of the alley panel of the game of FIG. 1.

Turning now more particularly to FIG. 2, it will be noted that alley display panel 30 includes a starting line 32 and seven rows and seven columns of bowling ball display lamps which will be selectively illuminated for displaying the simulated roll of a ball from starting line 32 to pin target area 36. It will be noted that at the lefthand side of the alley 31 a gutter 50 is provided. A pair of lamps 50*f* and 50*g* are positioned in gutter 50 in lateral alignment with the sixth and seventh rows from starting line 32. These lamps 50*f* and 50*g* will be illuminated when a simulated ball roll ends in gutter 50. In like manner, at the righthand side of alley 31 is a gutter 58. Again, a pair of lamps 58*f* and 58*g* are positioned in lateral alignment with the sixth and seventh rows from starting line 32. These lamps will also be illuminated if a simulated ball roll ends in gutter 58.

It will be observed, in particular, that row 51 of alley 31 includes seven lamps 51*a*, 51*b*, 51*c*, 51*d*, 51*e*, 51*f*, and 51*g* in each of the seven rows from starting line 32. Likewise, each of the other six columns 52, 53, 54, 55, 56, and 57 of the alley includes lamps in positions corresponding to the rows extending from starting line 32. In column 52, lamps 52*a*, 52*b*, 52*c*, 52*d*, 52*e*, 52*f*, and 52*g* are provided. In column 53, lamps 53*a*, 53*b*, 53*c*, 53*d*, 53*e*, 53*f*, and 53*g* are provided. Likewise, in column 54, there are positioned lamps 54*a*, 54*b*, 54*c*, 54*d*, 54*e*, 54*f*, and 54*g*. Column 55 includes lamps 55*a*, 55*b*, 55*c*, 55*d*, 55*e*, 55*f*, and 55*g*. Lamps 56*a*, 56*b*, 56*c*, 56*d*, 56*e*, 56*f*, and 56*g* constitute column 56. Finally, column 57 includes lamps 57*a*, 57*b*, 57*c*, 57*d*, 57*e*, 57*f*, and 57*g*.

When, in a manner to be presently described, a simulated ball roll is initiated, one lamp in each row in succession from starting line 32 will be illuminated to display the simulated roll of the ball. After a lamp in the seventh row from starting line 32 is illuminated, the simulated ball roll will enter pin target area 36. It will be noted that pin target area 37 includes ten lamps 71, 72, 73, 74, 75, 76, 77, 78, 79, and 80 constituting a set of ten pins 70. These pins are arranged in the typical triangular array which is common in bowling. After a ball roll is completed, a ball return sequence is initiated, in a manner to be described more fully hereinafter; and a set of ball return lamps 60 are energized when the ball return sequence is initiated, as will be explained in more detail hereinafter. It is to be noted that the set of ball return lamps 60 includes lamps 61, 62, and 63 which will be energized in sequence.

Within cabinet 12 of the game 10 as shown in FIG. 1, a number of circuit boards are mounted. These circuit boards form thee logic circuitry and display lamp drivers of the game.

Figure 3:
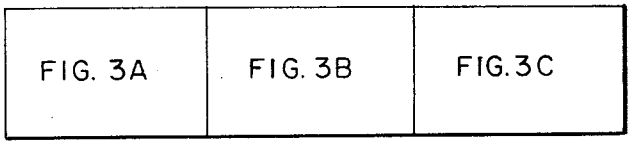
FIG. 3 is a schematic diagram showing the relationship among FIGS. 3A, 3B, and 3C.
Figure 3A:
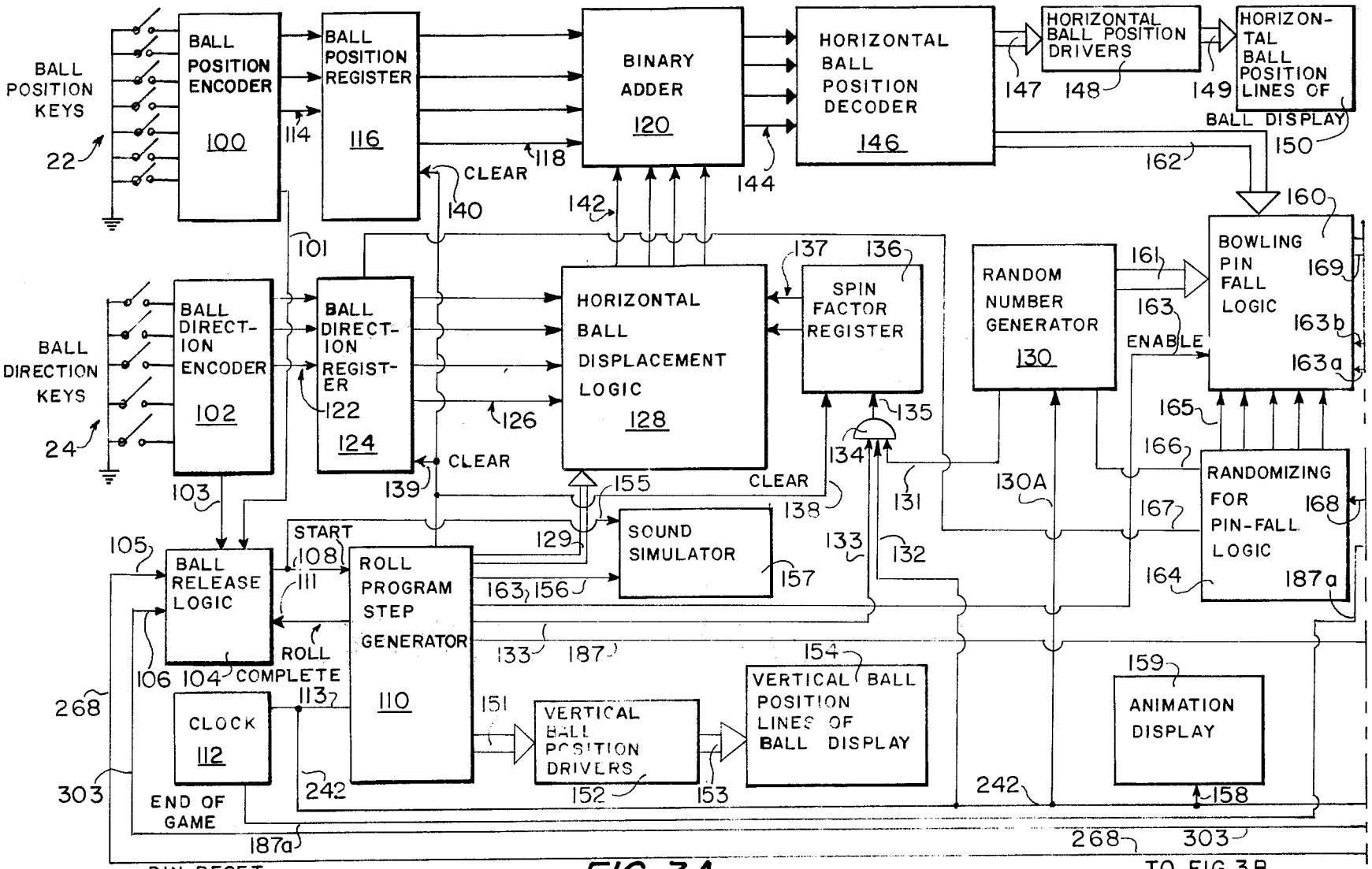
FIGS. 3A, 3B, and 3C taken together form a schematic block diagram of the game of FIG. 1.
Figure 3B:
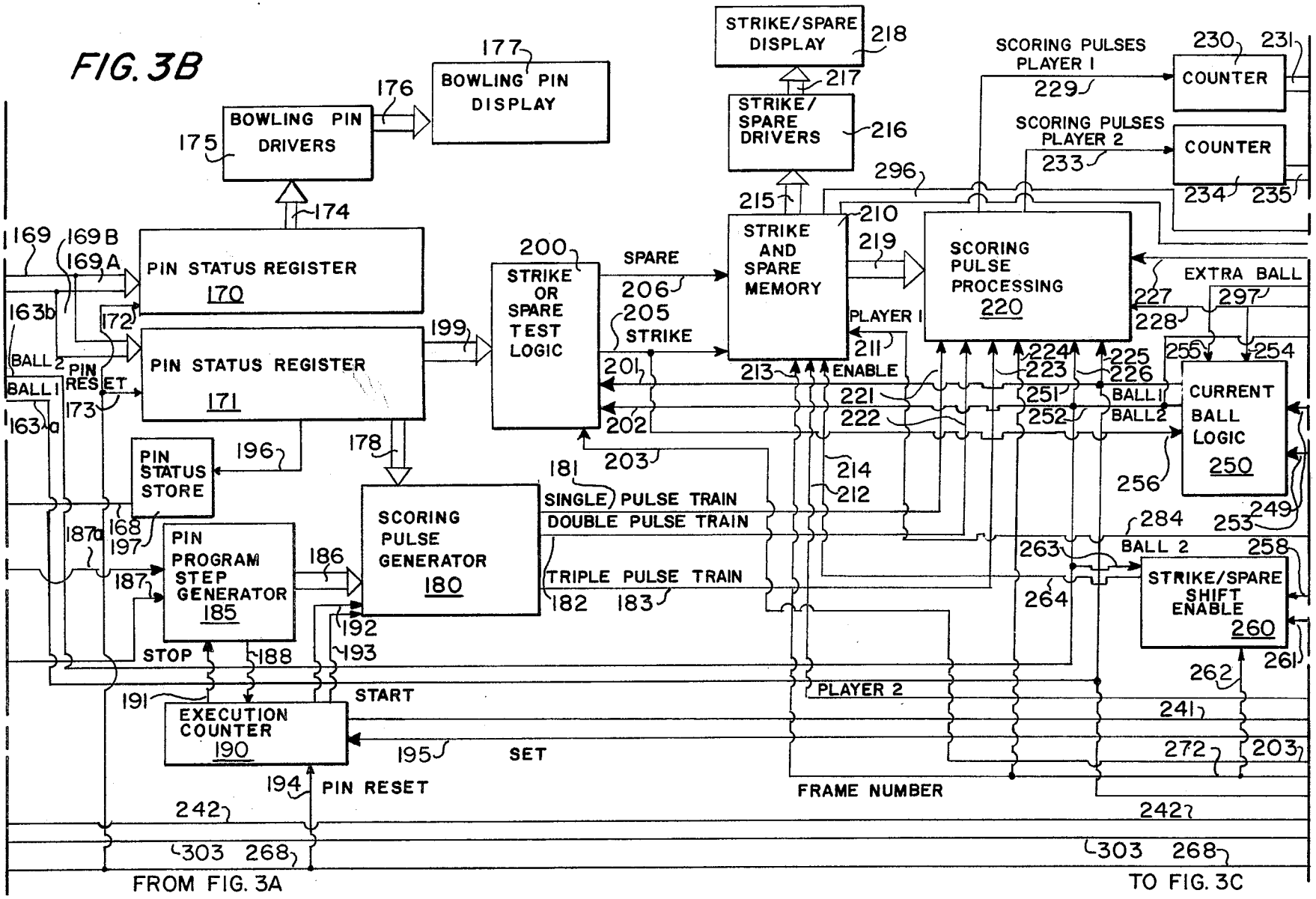
Figure 3C:
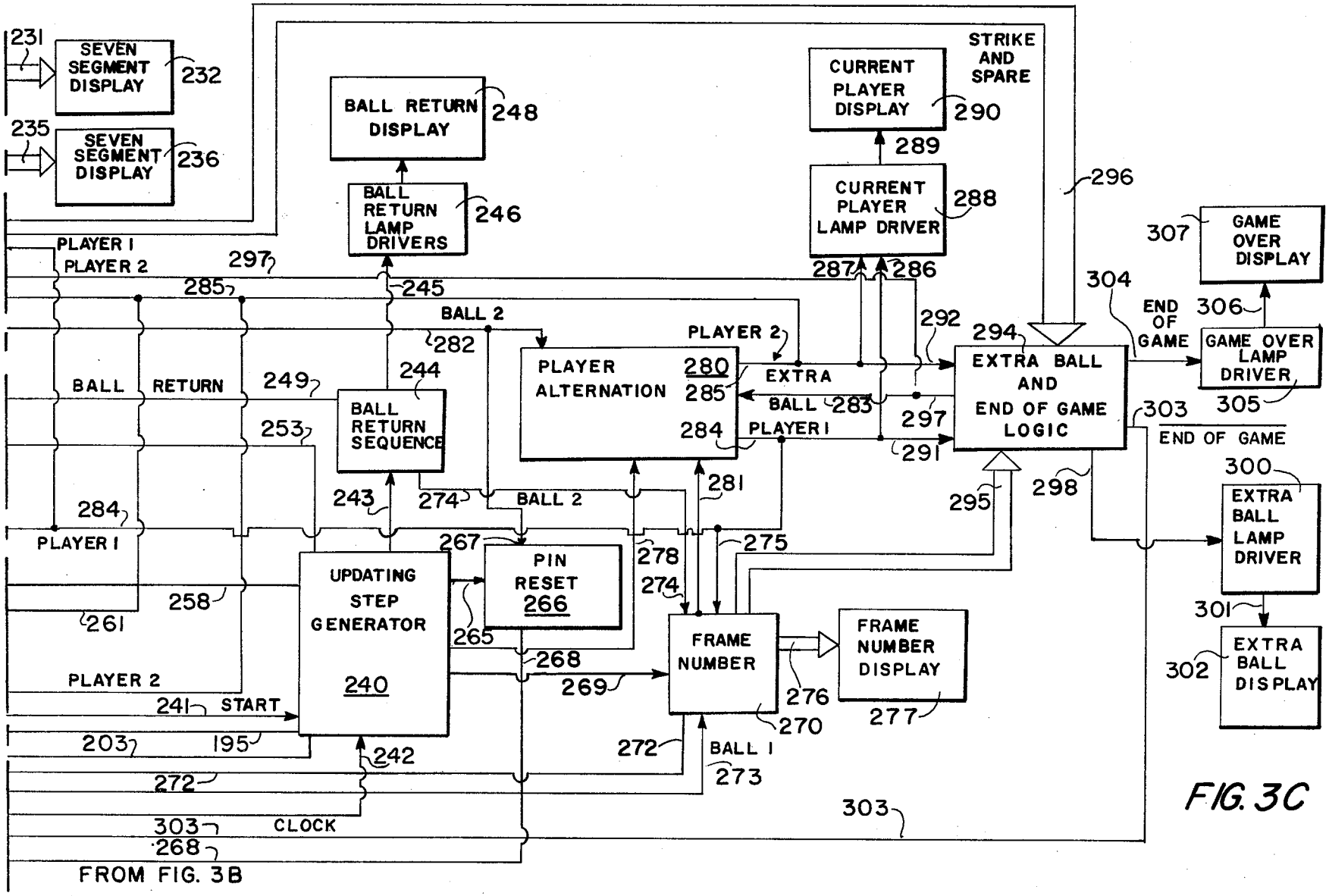

A block diagram of the logic circuitry is found in FIGS. 3A, 3B, and 3C. The relationship between these figures is illustrated in FIG. 3.

Considering this block diagram, it will be noted that ball position keys 22 comprise seven key-driven switches which selectively connect seven input terminals of a ball position encoder 100 to a point of ground reference potential. Ball direction keys 24 consist of five key-operated switches which selectively connect one of five input terminals to a ball direction encoder 102 to a point of ground reference potential. It will be understood that each of the seven ball position keys selects, as a starting position, one of the seven columns of the simulated alley 31. Each of the ball direction keys selects a unique direction, as follows: far left, slightly left, straight ahead, slightly right, and far right. Several leads 101 from ball position encoder 100 and several leads 103 from ball direction encoder 102 couple information as to which of the ball position keys and which of the ball direction keys have been actuated to a ball release logic circuit 104. One part of this circuit is enabled by a pin reset signal on an input lead 105; this part controls the final ball return lamp 62. An END OF GAME signal on an input lead 106 enables ball release logic circuit 104 when the game has not ended. A second part of circuit 104 will provide a BALL RELEASE, or START, signal on lead 108 when, and only when, one ball position key has been actuated and one ball direction key has been actuated. The BALL RELEASE signal on lead 108 acts as a START signal for a roll program step generator 110, initiating the ball roll sequence. Nine step output leads are provided by roll program step generator 110, providing nine output signals in sequence. On the ninth step, a ROLL COMPLETE, or CLEAR, signal is provided on lead 111 to ball release logic circuit 104, enabling the ball release logic circuit for a new roll.

It will be noted that a clock circuit 112 provides clock or timing signals on an input lead 113 of roll program step generator 110 to provide the timing for the step generator. As will become readily apparent, roll program step generator will provide signals controlling the timing of events in the ball roll sequence.

Returning to ball position encoder 100, it is to be noted that this circuit provides on three parallel output leads 114 a binary signal signifying which of the ball position keys has been actuated. This binary signal is stored in ball position register 116. A set of four parallel outputs leads 118 provides a binary coded signal representing the ball position to a binary adder 120.

Ball direction encoder 102 provides a binary coded signal on three parallel output leads 122 representing the selected one of the five ball direction keys to a ball direction register 124. Four parallel output leads 126 from ball direction register 124 provide a binary coded signal representing a stored ball direction signal from register 124 to a horizontal ball displacement logic circuit 128. Roll program step generator 110 provides four signals derived from steps 6, 7 and 8 on a group of leads 129 to horizontal ball displacement logic circuit 128. Thus, horizontal ball displacement logic circuit 128 has received on input leads 126 a signal representing an operator selected ball direction, and on input leads 129, time-related step signals from roll program step generator 110.

In addition to these inputs to horizontal ball displacement logic circuit 128, it is desired to provide a chance, or random, signal to affect horizontal ball displacement. This is accomplished by employing a random numer generator 130 which receives a clock signal on an input lead **130*a* from clock lead 242 leading from clock circuit 112. It is to be understood that in the embodiment disclosed herein, random number generator 130 provides a sequence of numbers in a time-related sequence, the sequence being related in time to the timing signals provided by the clock circuit 112. Since the time that a BALL RELEASE signal is provided by ball release logic circuit 104 is wholly under the control of the operator, there will be only a chance relationship between the BALL RELEASE signal and the random number present on an output lead 131 from random number generator 130. The same clock signal is provided on a lead 132 from clock 112, and roll program step generator provides a signal on an input lead 133, this signal, for example, representing the sixth step of the roll program corresponding to energization of the sixth row of alley board lamps as will be presently described. The inputs 131, 132, and 133 are provided as three inputs to an AND circuit 134 providing an output signal on an input lead 135 of a spin factor register 136. Spin factor register 136 provides a spin factor signal on a pair of output leads 137 to horizontal ball displacement logic circuit 128, thus introducing a chance element in this logic circuit. At the end of the roll program, roll program step generator 110 provides a CLEAR signal input 138 of spin factor register 136, on input 139 of ball direction register 124, and on input 140 of ball position register 116, resetting these registers. It will be noted that the CLEAR signal corresponds with the ninth step of the roll program and with the ROLL COMPLETE signal provided on input 111 to ball release logic 104. Horizontal ball displacement logic circuit 128 has four parallel output leads 142 which provide a binary output signal to binary adder 120. Thee binary horizontal ball displacement signal from horizontal ball displacement logic circuit 128 and the binary ball position signal from ball position register 116 are added in binary adder 120 and provide a horizontal ball position signal on four parallel output leads 144 to a horizontal ball decoder 146, which converts the binary input signal to a signal on one of nine output leads 147. Each of these leads corresponds to one of the columns 50, 51, 52, 53, 54, 55, 56, 57, and 58 of the alley display and are connected, respectively, to horizontal ball position drivers 148 connected by a plurality of leads 149 to corresponding horizontal ball position lines 150 of the ball display. Roll program step generator 110 also provides a set of seven output leads 151 providing, in succession, the first seven step signals of the roll program to a set of vertical ball position drivers 152; each of these drivers is coupled by a line 153 to a corresponding one of the vertical ball position lines 154** of the ball display. Thus, each of the rows of the ball display is energized in succession.

Figure 5:
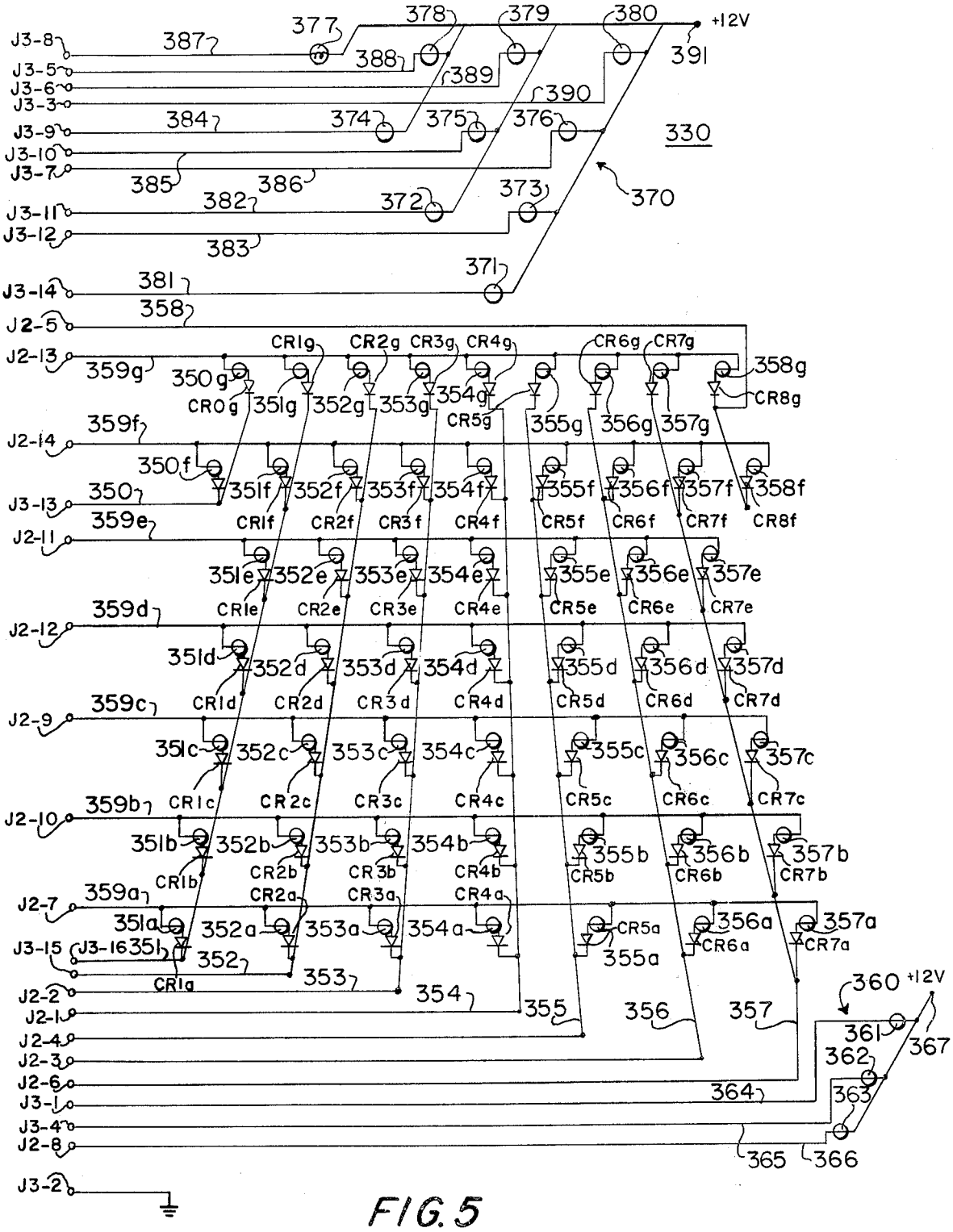
FIG. 5 is a schematic circuit diagram of a display panel of the preferred embodiment.

At this juncture, it is appropriate to consider the ball display portion 331 of the alley display board circuitry 330, shown in detail in FIG. 5. The alley display board includes a plurality of connector terminals which are shown, in FIG. 5, along the lefthand side thereof and which are numbered with reference numbers corresponding to the reference numbers of connector terminals on the main logic board, to be described hereinafter. From FIG. 5 it is seen that the alley board includes horizontal, or column, lines 351, 352, 353, 354, 355, 356, and 357 which correspond to columns 51, 52, 53,

54, 55, 56, and 57 of the alley display of FIG. 2. In addition, there are horizontal, or column, lines 350 and 358, corresponding to the gutters 50 and 58 of the alley board display of FIG. 2. Cooperating with these lines are a number of vertical, or row, lines 359*a*, 359*b*, 359*c*, 359*d*, 359*e*, 359*f*, and 359*g*, each corresponding to the row designated by the same letter of the alley display board of FIG. 2. These horizontal, or column, lines form a matrix with these vertical, or row, lines. Thus, a series circuit consisting of a lamp and a rectifier is connected between one of the horizontal, or column, lines and one of the vertical, or row, lines. More specifically, a lamp 351*a* and a semiconductor rectifier CR1*a* are connected in series between column line 351 and row line 359*a*. Thus, when column line 351 is energized and row line 359*a* is energized, current will flow through lamp 351*a* and rectifier CR1*a* illuminating lamp 351*a*. Much the same arrangement is obtained with respect to each of the other lamps of the alley board. It is to be noted that each of the lamps is designated by a reference number which shares, in its numeral portion, the number of the column line to which it is connected and, in connection with its terminal letter, shares the terminal letter of the row line with which it is connected. By this means, one lamp is energized uniquely when the column line and the row line between which it is connected are both energized. Since, as has been already described, a particular horizontal, or column, line is energized in response to the output from the horizontal ball position decoder 146 and since each of the row lines is energized in succession in response to the steps of the roll program step generator, it will be readily apparent that upon the generation of a ball release logic signal by ball release logic circuit 104, first a lamp connected to row line 359*a* is energized; the selected lamp is selected by the energization of one of the horizontal or column, lines. In like manner, a lamp associated with row lines 359*b*, 359*c*, 359*d*, 359*e*, 359*f*, and 359*g* are selected by a horizontal, or column, line, and energized in succession. The remainder of the alley display board of FIG. 5 will be described when it becomes appropriate to discuss the ball return lamps 360 and the pin display lamps 370.

Returning to the system block diagram of FIGS. 3A, 3B, and 3C, it will be noted that ball release logic circuit 104 provides the BALL RELEASE, or START signal to an input terminal 155 of a soumd simulator circuit 157. When a BALL RELEASE signal is received on input terminal 155 of sound simulator 157 it will generate a sound through a loudspeaker at a time corresponding to the roll of the ball down the alley. Sound simulator circuit 157 also receives a signal on an input lead 156 from roll program step generator 110. This signal will correspond in time with the entry of a ball into the pin target area, which will be the eighth step generated by the roll program step generator. When this signal, which signifies that a ball has entered the pin target area, is received by sound simulator circuit 157, it will generate a sound corresponding to the impact of a ball with pins in the pin target area. The details of the sound simulator circuit 157 will be described in greater detail hereinafter with reference to FIG. 7.

An animation display driving circuit 159, which corresponds to the animation portion 42 of the back panel 40, as shown in FIG. 1, is continuously driven by clock signals received on lead 158 from clock lead 242, which, as has already been explained, is connected to the output terminal of clock circuit 112. It is, thus, readily apparent that the animation display is continuously operating. It is also possible to enable animation display circuit 159 with the BALL RELEASE signal provided on lead 108 from ball release logic circuit 104. In that event, the animation display will be shown only at a time corresponding to the roll of a ball. While this may seem to be an advantage, it is to be remembered that random number generator 130 is also driven continuously by clock 112. Thus, an experienced player might observe the correlation between the animation display and the accuracy of his roll and thus time actuation of a ball position key 22 and a ball direction key 24 in response to a clue given by the animation display. This is avoided in the preferred arrangement which drives the animation display continuously.

The manner in which a ball reaches the pin target area has already been described. A bowling pin fall logic circuit 160 determines which of the pins will fall in response to the roll of the ball. Random number generator 130 provides a set of random number bits on leads 161 to bowling pin fall logic circuit 160, which also receives a horizontal ball position signal on a plurality of leads 162 from horizontal ball position decoder 146. These leads correspond to the leads for columns 51, 52, 53, 54, 55, 56 and 57 of the alley display board. Since a ball in the right or left gutter will have no effect on the fall of the bowling pins, signals corresponding to the lines for columns 50 and 58 are not included in the input to bowling pin fall logic circuit 160. The fall of bowling pins is also affected by a randomizing for pin fall logic circuit 164 which provides signals on five parallel input leads 165 to bowling pin fall logic circuit 160. It is to be observed that the randomizing for pin fall logic circuit 164 receives input signals on lead 166 from the random number generator 130 and, also, input signals on lead 167 from ball direction register 124 and on lead 168 from a pin status store to be described hereinafter. Thus, the signal provided on leads 165 from randomizing for pin fall logic circuit 164 will be a signal which is a function of random numbers generated in random number generator 130, the selected ball direction as stored in ball direction register 124, and a signal on input lead 168 which is related to those pins which are standing before the ball reaches the pin target area. Bowling pin fall logic circuit 160 also receives a BALL 1 signal on input lead 163*a* and a BALL 2 signal on input lead 163*b*, permitting it to be affected by information as to whether the current ball is the first or the second ball to be rolled in a frame. An ENABLE signal is introduced on input lead 163 to bowling pin fall logic circuit 160 to enable logic circuit 160 in response to a step signal from roll program step generator 110 which corresponds in time with the arrival of a ball in the pin target area. As was explained previously, this will correspond with the eighth step of the roll program generated by program step generator 110 and, thus, the signal on lead 169 will be at substantially the same time as the signal on lead 156.

The output from bowling pin fall logic circuit 160 comprises a set of ten output leads 169, one for each of the ten pins. The signals will signify by their value whether a given pin has fallen. This output is applied in parallel to a set of input terminals 169*a* for a first pin status register 170 and a set of input terminals 169*b* of a second pin status register 171. As will be explained more fully hereinafter in connection with the detail description of the main logic board, pin status registers 170 and 171 are formed of a set of ten dual flip-flops. A set of ten parallel output leads 174 from pin status register 170 are connected to a corresponding set of bowling pin drivers 175 which drive the bowling pin display 177 through ten output leads 176. Turning, again, to FIG. 5, it will be noted that bowling pin display 177 is provided by section 370 of alley board 330. A set of lamps 371, 372, 373, 374, 375, 376, 377, 378, 379, and 380 correspond, respectively, with bowling pins 71, 72, 73, 74, 75, 76, 77, 78, 79, and 80 of alley display panel 30 as shown in FIG. 2. The signals from the drivers 175 are received on respective leads 381, 382, 383, 384, 385, 386, 387, 388, 389, and 390 which complete the circuit of the corresponding pin lamps from a source of +12 volts 391. It is to be understood that the circuit is completed only when a pin is standing so that a pin lamp is energized to signify a standing pin. When a pin lamp is not energized, it signifies that the corresponding pin has fallen. Returning to FIGS. 3A, 3B, and 3C, it will be noted that pin status register 170 and pin status register 171 receive on input leads 172 and 173, respectively, a PIN RESET signal from a pin reset bus 268, which resets the registers for a new frame or for a second player in the same frame.

Pin status register 171 provides a set of ten output leads, one for each pin, to a scoring pulse generator 180 which provides on a first output lead 181 a single pulse train, the number of pulses in which corresponds to the number of fallen pins; on a second output lead 182 a double pulse train, the number of pulses in which corresponds to twice the number of fallen pins; and on a third output lead 183 a triple pulse train, the number of pulses in which corresponds to three times the number of fallen pins. A pin program step generator 185 provides ten step signals on ten parallel output leads 186 which are coupled to scoring pulse generator 180. It is to be noted that pin program step generator is started in response to a signal on lead 187 from roll program step generator 110. This signal corresponds with the ninth step of the roll program. A clock signal is provided from clock circuit 112 on input lead 187*a* to pin program step generator 185.

As mentioned above, scoring pulse generator 180 provides a single pulse train on output lead 181, a double pulse train on output lead 182, and a triple pulse train on output lead 183. In order to generate these pulse trains, scoring pulse generator 180 scans the status of the pins in pin status register 171 three times in sequence. In the first scan, a pulse train is generated with as many pulses as the number of pins which have fallen on each of the lines 181, 182, and 183. On the second scan, only the double and triple output lines 182 and 183 are active; and on these lines pulses are generated to correspond with the number of pins which have fallen. On the third scan, only the triple pulse train line 183 is active; and pulses are generated corresponding to the number of pins which have fallen. In this way, the single pulse line 181 will have one pulse for each fallen pin, the double pulse line 182 will have two pulses for each fallen pin, and the triple pulse line 183 will have three pulses for each fallen pin. Since the signals provided by pin program step generator 185 on its ten parallel output leads 186 are employed for generating the pulse trains, it is thus necessary to cycle pin program step generator three times, once for each scan of pin status register 171. This is accomplished by an execution counter 190. A START signal is derived from pin program step generator output lead 188, signifying the first scan and initiating counting by execution counter 190. When execution counter 190 has counted three executions of pin program step generator 185, a signal on output lead 191 to pin program step generator 185 terminates the cycling of pin program step generator 185. For the second and third scans, execution counter 190 provides enabling signals on leads 192 and 193 which permit pulses to be generated on leads 182 and 183 in the second scan and in lead 183 in the third scan. At the completion of the three scans, execution counter 190 will provide a START signal on lead 241 to an updating step generator 240. Updating step generator 240 will, in turn, provide a SET signal signifying that the update sequence has been completed. This will set a flip-flop associated with a counter in execution counter 190 to be set for the next execution count.

Pin status register 171 also provides an output signal at 196 to a pin status store 197. The signal developed in pin status store 197 will be related to the influence a standing pin will have on the pin fall of other pins. As previously mentioned, the output from pin status store 197 is provided on input lead 168 to the randomizing for pin fall logic circuit 164.

Pin status register 171 also provides a plurality of outputs on ten parallel output leads 199 to a strike or spare test logic circuit 200. This circuit will determine whether the roll of the ball results in a strike or a spare. A BALL 1 signal is received on input lead 201 to strike or spare test logic circuit 200, and a BALL 2 signal is provided on input lead 202 to logic circuit 200. This circuit is also under the control of the updating step generator and receives an input signal on lead 203 therefrom. If logic circuit 200 determines that a strike has been attained, a STRIKE signal will be provided on input lead 205 to strike and spare memory circuit 210. If, however, logic circuit 200 determines that a spare has been attained, a SPARE signal will be provided on input lead 206 to strike and spare memory circuit 210. This memory will store strike and spare information as to each player for as many frames as is required. To this end, it receives a PLAYER 1 signal on an input lead 211, a PLAYER 2 signal on input lead 212, and frame number signals on input leads 213. The circuit is enabled by a signal on input lead 214. One set of output leads from strike and spare memory circuit 210 is provided at 215 to strike/spare drivers 216, which, in turn, control through lines 217 the lamps of a strike/spare display 218. Strike and spare memory circuit 210 also provides a plurality of signals on parallel leads 219 to a scoring pulse processing logic circuit 220. This circuit controls the scoring for each player. It thus receives on input leads 221, 222, and 223 the single pulse train, double pulse train, and triple pulse train which were provided, respectively, on output leads 181, 182, and 183 from scoring pulse generator 180. It also keeps track of the frame number by frame number signals on input leads 224. It keeps track of which ball was just rolled by a BALL 1 signal on input lead 225 and a BALL 2 signal on lead 226. It keeps track of which player is to be scored by a PLAYER 1 signal on input lead 227 and a PLAYER 2 signal on input lead 228.

A first output from scoring pulse processing logic circuit 220 is provided on output lead 229 which couples scoring pulses for Player 1 to a counter 230. Counter 230, in turn, provides over a set of parallel output leads 231 signals to a seven-segment numeric display 232 for displaying the score for Player 1. It will be observed, that counter 230 will maintain a cumulative count of the score for Player 1 throughout the game. It will be reset by a RESET signal derived from the coin mechanism (not shown in this block diagram) initiating a new game. In like manner, scoring pulses for Player 2 are provided on output line 233 to a counter 234 which, in turn, provides a plurality of signals on parallel leads 235 to a seven-segment display 236 showing the cumulative score for Player 2. Counter 234 will also be reset at the initiation of a new game.

One of the functions of scoring pulse processing logic circuit 220 is the selection of the single pulse train, double pulse train, or triple pulse train. This selection is made on the basis of whether the score from a ball roll is to be applied only to the present frame or, as in the case of a strike or a spare, to the present frame and a preceding frame, or as in the case of some strikes, in the present frame, a preceding frame, and the next preceding frame.

Updating step generator 240, which controls a number of updating functions as will be presently described, starts a cycle in response to a START signal on an input lead 241 from execution counter 190. Thus, the updating step program is enabled at the completion of the execution count by execution counter 190. Timing for updating step generator 240 is received on an input lead 242 from clock circuit 112. A timing signal on a lead 243 from updating step generator 240 initiates a ball return sequence in ball return sequence logic circuit 244. Signals on output leads 245 from ball return sequence 244 control ball return lamp drivers 246, which, in turn, drive through output leads 247 a ball return display 248. It will be understood that ball return display 248 corresponds with the ball return section 60 of alley display board 30 including display lamp positions 61 and 62, as is shown in FIG. 2. Ball return sequence logic circuit 244 also provides a BALL RETURN signal on a lead 249 to a current ball logic circuit 250. This enables current ball logic circuit 250 to count the ball roll just completed and provide an output signal corresponding to the next ball to be rolled. A BALL 1 signal is provided on output lead 251, signifying that the first ball of a frame for a player is being rolled. A BALL 2 signal is provided on output lead 252 and signifies that a second ball of a frame for a player is the ball being rolled. A timing signal is received on a lead 253 from updating step generator 240 by current ball logic circuit 250 to govern the proper time for a change in the output signals. Current ball logic circuit 250 also receives a PLAYER 2 signal on input lead 254, an EXTRA BALL signal on input lead 255, permitting it to continue the BALL 2 signal after a second ball has been rolled, and a STRIKE signal on input lead 256 from strike or spare test logic circuit 200 to avoid generating the BALL 2 signal after a strike.

Updating step generator 240 also provides a timing signal on a lead 258 to a strike/spare shift enable logic circuit 260. This circuit also receives a PLAYER 2 signal on a lead 261, and a frame number signal on input lead 262 to account for the situation which develops in the tenth frame. A BALL 2 signal is received on lead 263 from current ball logic circuit 250. An ENABLE signal is provided on output lead 264 from strike/spare shift enable logic circuit 260 and is used as an input on input lead 214 of strike and spare memory circuit 210, enabling this circuit to receive strike and spare data from the strike or spare test logic circuit 200.

Updating step generator 240 also provides a timing signal on lead 265 to a pin reset logic circuit 266, enabling pin reset logic circuit 266 to provide a pin RESET signal on an output lead 268. It is to be noted that pin reset logic circuit 266 also receives the BALL 2 signal on an input lead 267. The circuit thus determines when a frame has been completed after the second ball roll at which time it is appropriate to reset the pins.

Updating step generator 240 also provides a timing signal on lead 269 to a frame number logic circuit 270, enabling frame number logic circuit 270 to count the frame just executed. Other inputs to frame number logic circuit 270 include the BALL 1 signal on an input lead 273, a ball return sequence enabling signal on input lead 274, and a PLAYER 1 signal on input lead 275. Outputs on leads 272 provide information as to whether the current frame is the eleventh or twelfth frame or not the eleventh or twelfth frame to the strike and spare memory circuit 210, information as to whether the current frame is not the tenth frame to strike/spare enable circuit 260, and information as to whether the current frame is the eleventh or twelfth frame to the scoring pulse processing circuit 220. Frame number logic 270 provides a plurality of output signals on parallel output leads 276 to a frame number display 277. This will take the form of a seven-segment numeric display and will be found within frame number display area 44 of back panel 40 of the game, as is shown in FIG. 1.

The PLAYER 1 and PLAYER 2 signals are provided by player alternation logic circuit 280 on output leads 284 and 285, respectively. Updating step generator 240 provides a timing signal on an input lead 278 to player alternation logic circuit 280, and frame number signals are provided on input leads 281 from frame number logic 270. These frame number signals will provide data to player alternation logic circuit 280 as to the existence of the tenth frame. The BALL 2 signal from current ball logic 250 is received on an input terminal 282 to player alternation logic circuit 280, and an EXTRA BALL signal is received on input lead 283. The PLAYER 1 signal and PLAYER 2 signal are provided on leads 286 and 287, respectively, to current player lamp drivers 288; these drivers drive through lines 289 the current player display 290, which corresponds to the display provided just above boxes 45 and 46 of back panel 40 of the game, as is shown in FIG. 1. The PLAYER 1 and PLAYER 2 signals are also provided on input leads 291 and 292, respectively, to an extra ball and end of game logic circuit 294. This circuit also includes a plurality of input signal leads 295 receiving frame number data from frame number counter 270 and strike or spare data on a plurality of leads 296 from strike and spare memory 210. An EXTRA BALL output signal is provided on output terminal 297 from extra ball and end of game logic circuit 294, and this signal is provided to other parts of the system as has already been described. An EXTRA BALL signal is also provided on an output lead 298 to extra ball lamp drivers 300 which through leads 301 drive an extra ball display 302. This display may be found in display areas 37 or 38 of alley display board 30 of FIG. 1. Extra ball and end of game logic circuit 294 also provides an $\overline{\text{END OF GAME}}$ output signal on an output lead 303 serving as a bus to the input terminal 106 of ball release logic circuit 104. An END OF GAME signal is provided on output lead 304 to a "game over" lamp driver 305. This lamp driver through lead 306 drives the game over display 307. This display will be located at the other of the display areas 37 and 38 of the alley display board 30 of FIG. 1.

Figure 4:
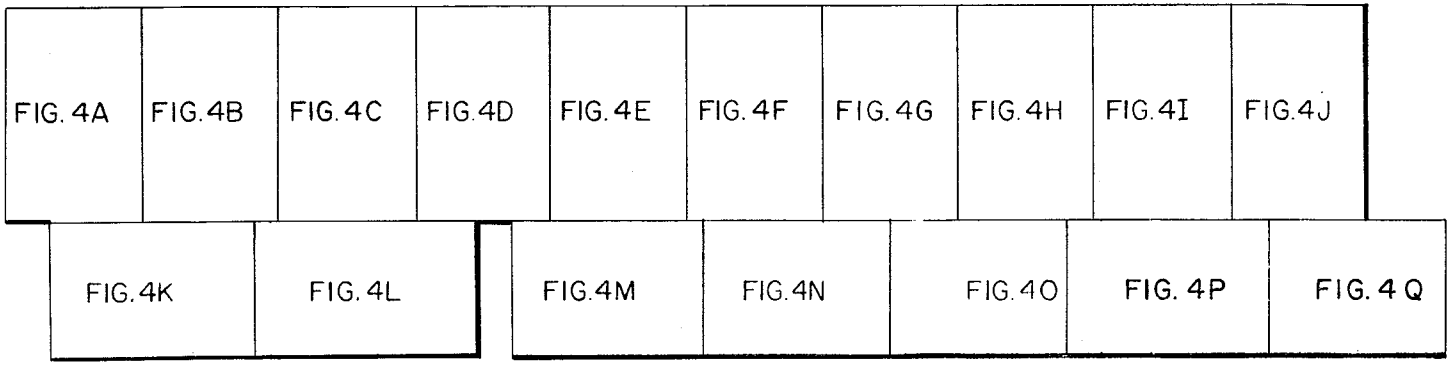
FIG. 4 is a schematic diagram showing the relationship among FIGS. 4A, 4B, 4C, 4D, 4E, 4F, 4G, 4H, 4I, 4J, 4K, 4L, 4M, 4N, 4O, 4P, and 4Q.

The circuitry constituting the solid state logic of game 10 is provided on a number of circuit boards contained within cabinet 12. The most important of these circuit boards is the main circuit board, the schematic diagram of which is found in FIGS. 4A, 4B, 4C, 4D, 4E, 4F, 4G, 4H, 4I, 4J, 4K, 4L, 4M, 4N, 4O, 4P, and 4Q. When these figures are positioned as shown in the diagram of FIG. 4, they constitute a schematic circuit diagram of the main circuit board with, however, some peripheral apparatus and circuits shown schematically. Due to the complexity of the schematic diagram, a signal point identifying convention has been adopted. This consists of the use inside circles of letters designating a unique signal connection point. All signal connection points identified by the same letter or letters may be considered as connected together; the sources for each point are identified in Table II. It is also to be noted that the board terminals are identified and will correspond to terminals similarly identified on connecting circuit boards, as will become readily apparent hereinafter. Unless otherwise stated, the solid state logic circuits used are provided by the circuit types as identified in the following table:

Table I

| Logic Circuit | Type | Description |
|---|---|---|
| 2-input AND | 7408 | Quadruple 2-input positive AND gate |
| 2-input NAND | 7400 | Quadruple 2-input positive NAND gate |
| 3-input NAND | 7410 | Triple 3-input positive NAND gate |
| 4-input NAND | 7420 | Dual 4-input positive NAND gate |
| 8-input NAND | 7430 | 8-input positive NAND gate |
| NOR | 7402 | Quadruple 2-input positive NOR gate |
| OR | 7432 | Quadruple 2-input OR gate |
| Exclusive OR | 7486 | Quadruple 2-input Exclusive OR gate |
| Inverter | 7404 | Hex Inverter |
| Inverter Buffer | 7406 | Hex Inverter Buffer/Driver with open collector high voltage output |
| Buffer | 7407 | Hex Buffer/Driver with open collector high voltage output |
| Flip-Flop Master-Slave | 7474 | Dual D-type Edge-Triggered Flip-Flops |
| Flip-Flop | 7473 | Dual J-K Master-Slave Flip-Flops |
| Decoder | 7442 | BCD-To-Decimal Decoder |
| Latch | 7475 | Quadruple Bistable Latch |
| Adder | 7483 | 4-bit Binary Full Adder (look ahead carry) |
| Decade Counter | 7490 | Decade Counter |
| Decade Counter | 74176 | Presettable Decade Counter |
| Binary Counter | 7493 | 4-bit Binary Counter |
| Decoder-Demultiplexer | 74154 | 4-line to 16-line Decoder/Demultiplexer |
| Clock | 555 | Clock |
| Decoder/Driver | 7447 | BCD-To-Seven Segment Decoder/Driver with 15-volt output |
| Decoder/Driver | 7445 | BCD-To-Decimal Decoder/Driver with 30-volt output |
| Selector/Multiplexer | 74157 | Quadruple 2-input Data Selector/Miltiplexer |

All resistors used are rated at 0.25 watt.

Figure 4A:
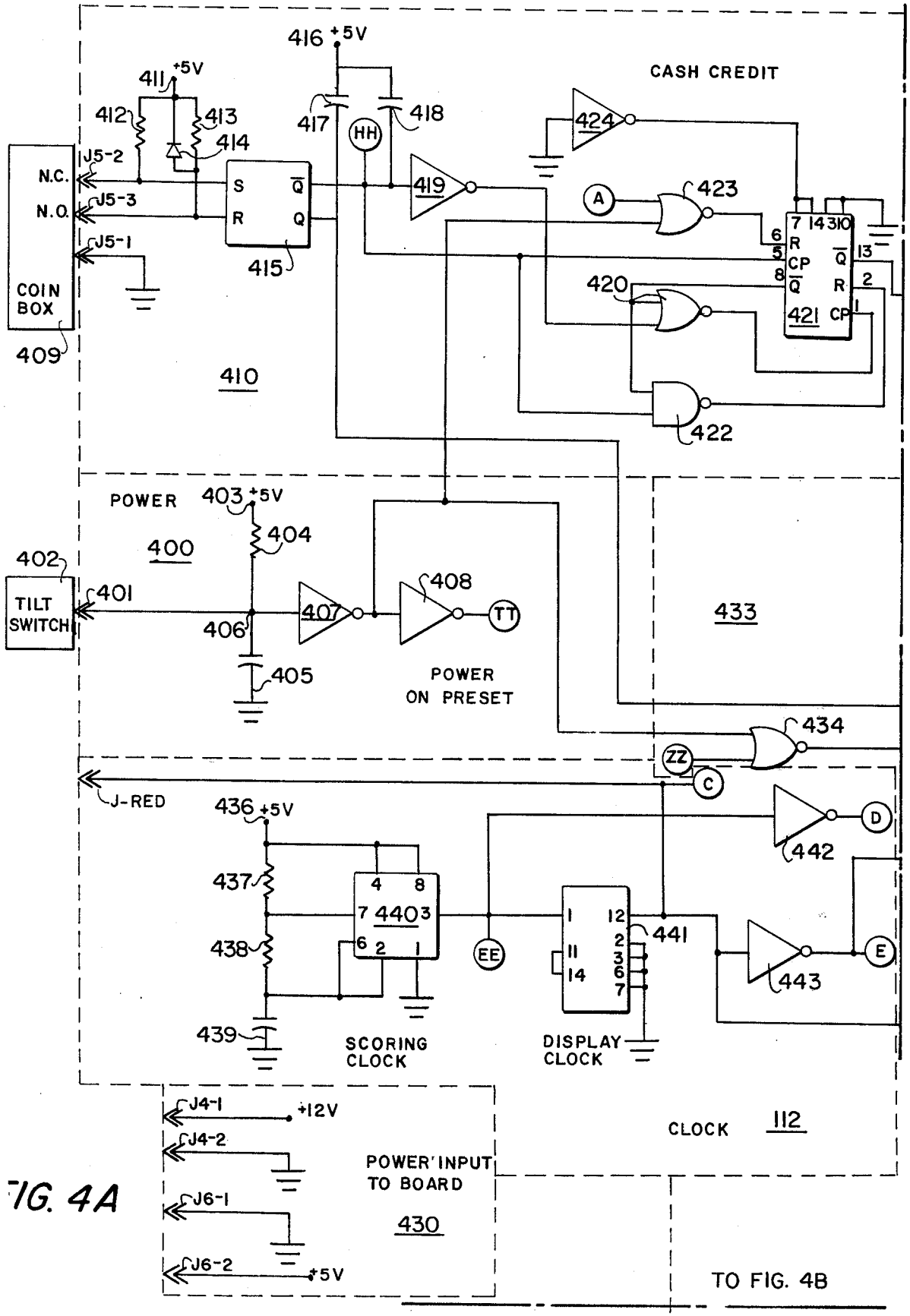
Figure 4B:
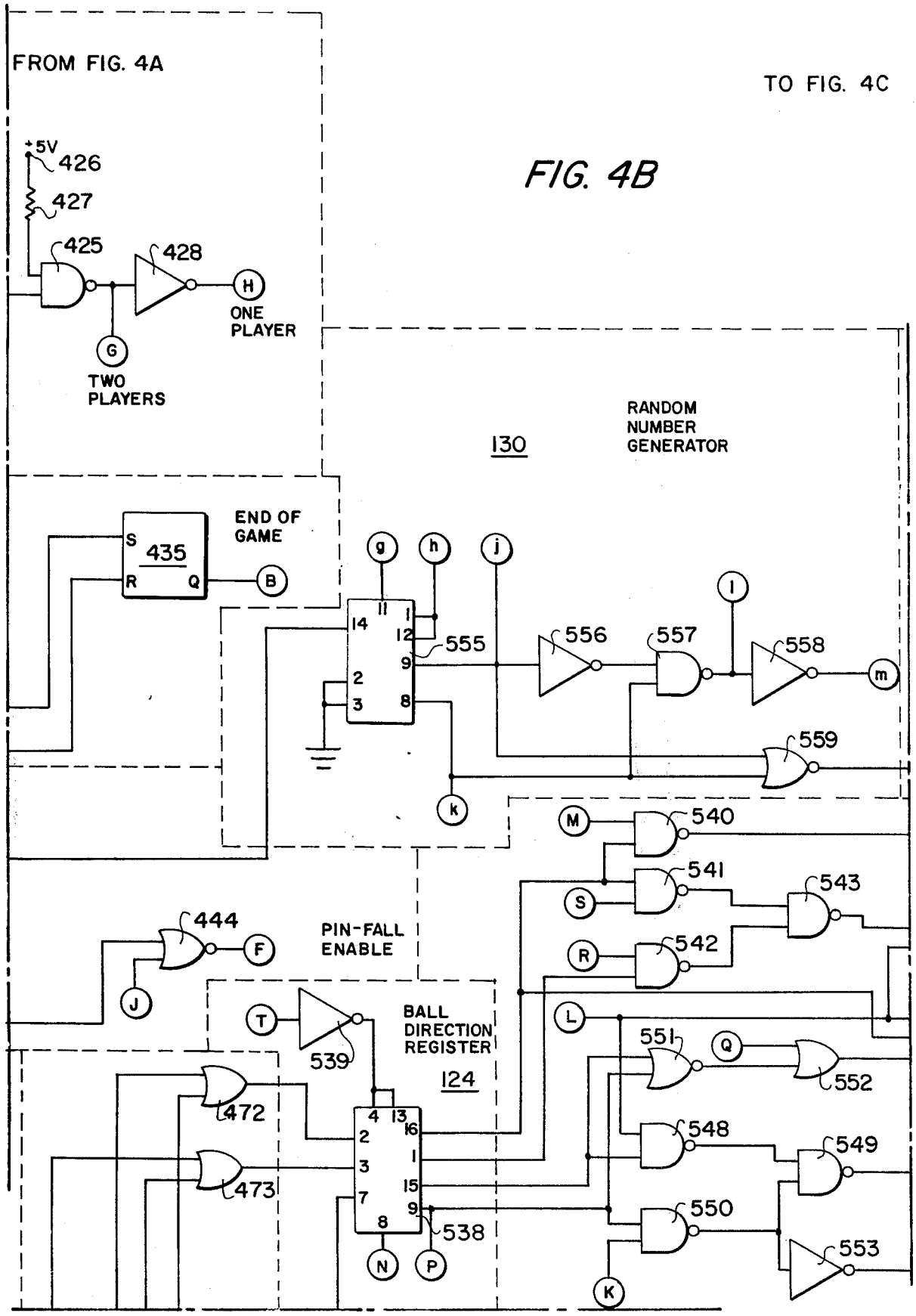

Turning, then, initially to FIG. 4A, a power section 400 includes a board terminal 401 connected to a tilt switch 402, which is located on cabinet 12 of the game at some convenient location thereon. When it is desired to turn the power on, tilt switch 402 is actuated; this actuation, in effect, connects terminal 401 to ground. Power circuit 400 includes a terminal 403 connected to a +5 volt source. A resistor 404, which has a value of 39,000 ohms, is connected between terminal 403 and a junction point 406. A capacitor 405, which may have a value of 10 microfarads and a 16-volt rating, is connected between junction point 406 and ground. Alternatively, a one microfarad capacitor may be substituted with a 22,000 ohm resistor in parallel. Junction point 406 is connected to an inverter 407 which, in turn, is connected to an inverter 408. A POWER ON preset signal TT is provided on the output side of inverter 408.

A cash credit circuit 410 is connected through board terminal connections J5-2, J5-3, and J5-1 to a coin box 409. Terminal J5-2 is connected to a normally closed coin switch, while terminal J5-3 is connected to a normally open coin switch. A bias supply terminal 411 is connected to a +5 volt source, and resistors 412 and 413 are connected to terminal 411, each being a 1,000 ohm resistor. A semiconductor diode 414 (Type 1N4001) is connected in parallel with resistor 413. The lower end of resistor 412 is connected to board terminal J5-2 and to a S input to a flip-flop circuit 415, while the lower end of resistor 413 is connected to board terminal J5-3 and the R input terminal of flip-flop 415. A bias terminal 416 is connected to the +5 volt supply and to a pair of 0.1 microfarad capacitors 417 and 418, the other ends of which are respectively connected to the Q and Q outputs of flip-flop 414. An HH signal is derived from output terminal Q of flip-flop 415, which is also connected to an inverter 419. The output from inverter 419 is connected to an input of a NOR gate 420, the output of which is connected to a CP input terminal of a master-slave flip-flop 421. A Q output from flip-flop 421 is connected to the other input of NOR gate 420 and to an input to a NAND gate 422, the other input of which is connected to the Q output terminal of flip-flop 415. The output from NAND gate 422 is connected to an R input of master-slave flip-flop 421. A second R input of master-slave flip-flop 421 is connected to the output from a NOR gate 423, one input of which is connected from inverter 407 of power section 400, and the other output of which is connected to signal point A from the ball release logic 104. A pair of terminals of master-slave flip-flop 421 are connected to the output of an inverter 424, the input of which is grounded. The other Q output from master-slave flip-flop 421 is connected to an input of a NAND gate 425, the other input of which is connected to a +5 volt bias terminal 426 through a 3,900 ohm resistor 427. The output of NAND gate 425 provides the 2 PLAYERS signal at signal point G and is connected to the input of an inverter 428, the output from which provides the 1 PLAYER signal to signal point H.

Power inputs to the main circuit board are provided at section 430. Board terminal J4-1 provides the +12 voltage source, and board terminal J6-2 provides the +5 voltage source. Board terminals J4-2 and J-1 provide the grounded side of the respective bias sources.

An end of game section 433 includes a NOR gate 434, receiving on one input terminal a signal from inverter 407 of the power section, and a signal from signal connection point ZZ on its other input terminal. As will be apparent hereinafter, an END OF GAME signal is provided at signal connection point ZZ from the extra ball and end of game logic circuit 294. The output from NOR gate 434 is connected to the R input of flip-flop 435. The S input of this flip-flop receives a signal from the Q output of flip-flop 415 of cash credit circuit 410. The Q output from flip-flop 435 provides an END OF GAME signal to connection point B.

The clock circuit 112 includes a +5 volt bias terminal 436 connected to ground through an 11,000 ohm resistor 437, a 11,000 ohm resistor 438, and a one microfarad capacitor 439 (16-volt rating). These are connected, as shown, to terminals of a clock circuit 440 which will serve as the scoring clock of the system. A SCORING CLOCK output signal is provided to signal connection point EE and to an input terminal of a decade counter 441 (Type 7490), serving as the display clock of the system. Thus, the clock signals appearing at the output terminal from display clock 441 will have a frequency which is 1/10 the frequency of clock signals from scoring clock 440. It will be understood that display clock 441 is used to time animation and ball motion display of the game, and the frequency is selected so that these displays will operate at a speed which seems natural to the player. On the other hand, scoring functions should be executed rapidly; and for this reason the greater frequency is preferred from the scoring clock. It will be noted that the output from scoring clock 440 is also connected through an inverter 442 to signal connection point D providing a $\overline{\text{SCORING CLOCK}}$ signal. The output from the display clock 441 is connected to signal connection point C and through inverter 443 to signal connection point E. Signal connection point C is connected to the J-red board terminal, which will serve as a clock input to the sound board to be described hereinafter.

A pin fall enable signal is provided by a NOR gate 444, one input of which receives the DISPLAY CLOCK signal from display clock 441, and the other input to which is connected to the J signal connection point provided from roll program step generator 110 as will be presently described.

A key input section 450 (see FIG. 4K) includes board terminals J1-11, J1-12, J1-9, J1-10 and J1-7, respectively connected to ball direction keys 445, 446, 447, 448, and 449 forming the set 24 of direction keys. Each of these keys carries indicia indicating ball direction, as shown. In like manner, board terminals J1-8, J1-5, J1-6, J1-3, J1-4, J1-1, and J1-2 are connected respectively to ball position keys 451, 452, 453, 454, 455, 456, and 457 forming the set 22 of position keys. Each of these keys carries indicia identifying the horizontal, or lateral, ball position selected. It will be understood that each of the ball direction keys and ball position keys, when actuated, serve to connect the board terminal to which it is connected to ground. Bias for the ball direction input leads is provided from a +5 volt bias terminal 451' through 1,000 ohm resistors 452', 453', 454', 455', and 456' as shown. Likewise, bias for the leads from the position keys is provided from a +5 volt bias terminal 460 through 1,000 ohm resistors 461, 462, 463, 464, 465, 466, and 467 as shown. Board terminal J1-13 is grounded.

Ball direction encoder 102 (FIGS. 4B and 4K) includes inverters 468, 469, 470, 471, and 472 connected, respectively, to the leads from direction keys 445, 446, 447, 448, and 449. The outputs from these inverters are connected to NOR gates 472, 473, and 474 as shown.

Ball position encoder 100 (FIG. 4K) includes inverters 475, 476, 477, 478, 479, 480, and 481 connected, respectively, to the leads from position keys 451, 452, 453, 454, 455, 456, and 457. The outputs from these inverters are connected to an inverter 482 and NOR gates 483, 484, 485, and 486 as shown, the outputs from which are connected to the inputs of NAND gates 487, 488, and 489 as shown.

Ball release logic circuit 104 (FIG. 4K) includes Exclusive OR gates 490 and 491 receiving inputs from inverters 468, 469, 470, 471, and 472 of ball direction encoder 102 as shown. The outputs from Exclusive OR gates 490 and 491 are connected to an Exclusive OR gate 492, the output from which is connected to an input of an Exclusive OR gate 493, the other input of which is connected to the output from inverter 472. Exclusive OR gates 494, 495, and 496 receive input signals from ball position encoder 100 as shown and are connected to inputs of Exclusive OR gates 497 and 498 as shown. The outputs from Exclusive OR gates 497 and 498 are connected to respective inputs of Exclusive OR gate 499, the output from which provides one input to an AND gate 500, the other input to which receives the output from exclusive OR gate 493. The output from AND gate 500 provides a BALL RELEASE signal at signal connection point A. It will be noted that by virtue of the aforementioned logic, a BALL RELEASE signal at signal point A will be provided when, and only when, a player actuates one direction key and one position key. If more than one direction key, more than one position key, or only a direction key or a position key is actuated, the BALL RELEASE signal at signal connection point A will not be generated. The output from AND gate 500 is also connected to an input to NAND gate 503. This input is connected through a 0.1 microfarad capacitor 502 to a +5 volt bias terminal 501. A second input to NAND gate 503 is connected to signal connection point B which, as has been described, provides the END OF GAME signal. The output from AND gate 500 is also connected to the S input of flip-flop 505, the Q output from which is connected to a third input terminal of NAND gate 503. The reset input R of flip-flop 505 is connected to signal connection point J, receiving a STEP 8 signal from roll program generator 110, as will be presently described. The output from NAND gate 503 is connected to the reset input R of flip-flop 504 and to the reset input R of flip-flop 506. The Q output from flip-flop 504 is connected to the fourth input terminal of NAND gate 503, while the $\overline{Q}$ output therefrom provides a signal to signal connection point *f.* The S input to flip-flop 506 is connected to signal connection point DD, which carries a roll program STEP 9 signal from roll program step generator 110, as will be described hereinafter. The $\overline{Q}$ output from flip-flop 506 provides a CLEAR signal to signal connection point T.

Ball position register 116 (FIG. 4L) receives the CLEAR signal from signal connection point T through an inverter 507, which applies the signal to a latch circuit 508, enabling latch circuit 508 to receive a binary input signal on parallel input leads from ball position encoder 100. Inverters 487, 488, and 489 of ball position encoder 100 will provide either a 0 or a 1 signal on its respective output lead; thus, the following seven binary signals are provided by the three leads, 000, 001, 010, 011, 101, 110, and 111. Since these seven signals are equal in number to the number of position keys 22, each of the aforementioned codes may represent one of the position keys. Since latch 508 will be inhibited, because of the lack of a signal at signal connection point T, if none or more than one position key is actuated, it is not necessary to provide a fourth lead to cover the case of no actuated keys. Latch circuit 508 has four output lines providing, respectively, signals to signal connection points U, V, W, and X in a binary code representing initial ball position. A 4-bit output code is employed, because it must serve as an input to a 4-bit adder in adder 120. The 4-bit code may signify ball position according to the following coding: position 1, code 1011; position 2, code 1010; position 3, code 1001; position 4, code 1000; position 5, code 0111; position 6, code 0110; position 7, code 0101.

A BALL RELEASE signal is also provided from output Q of flip-flop 506 of ball release logic circuit 104 to a buffer 509, serving as a buffer-driver for the ball roll sound activator on the sound board to which connection is made through board terminal 510.

Figure 4C:
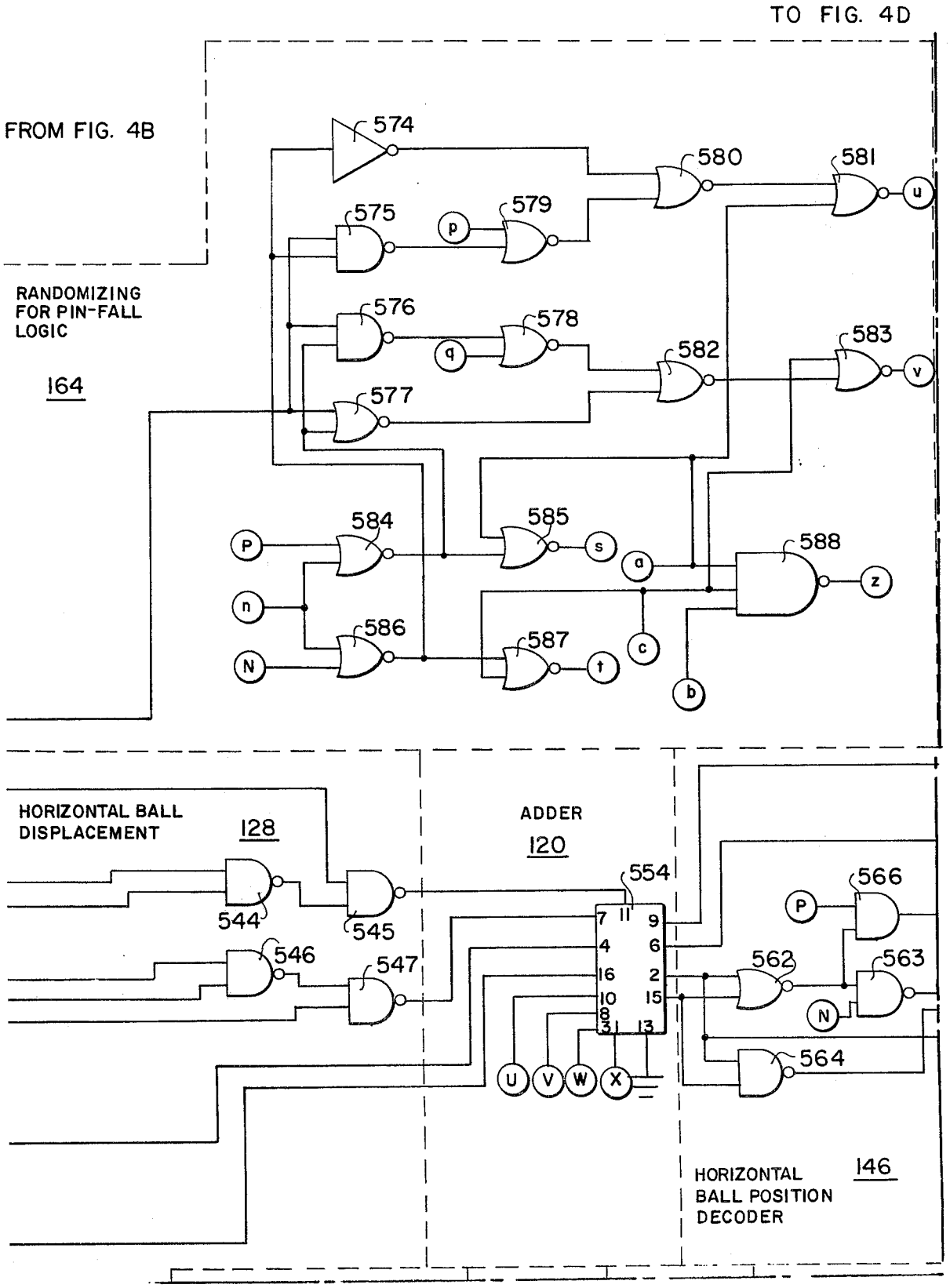
Figure 4D:
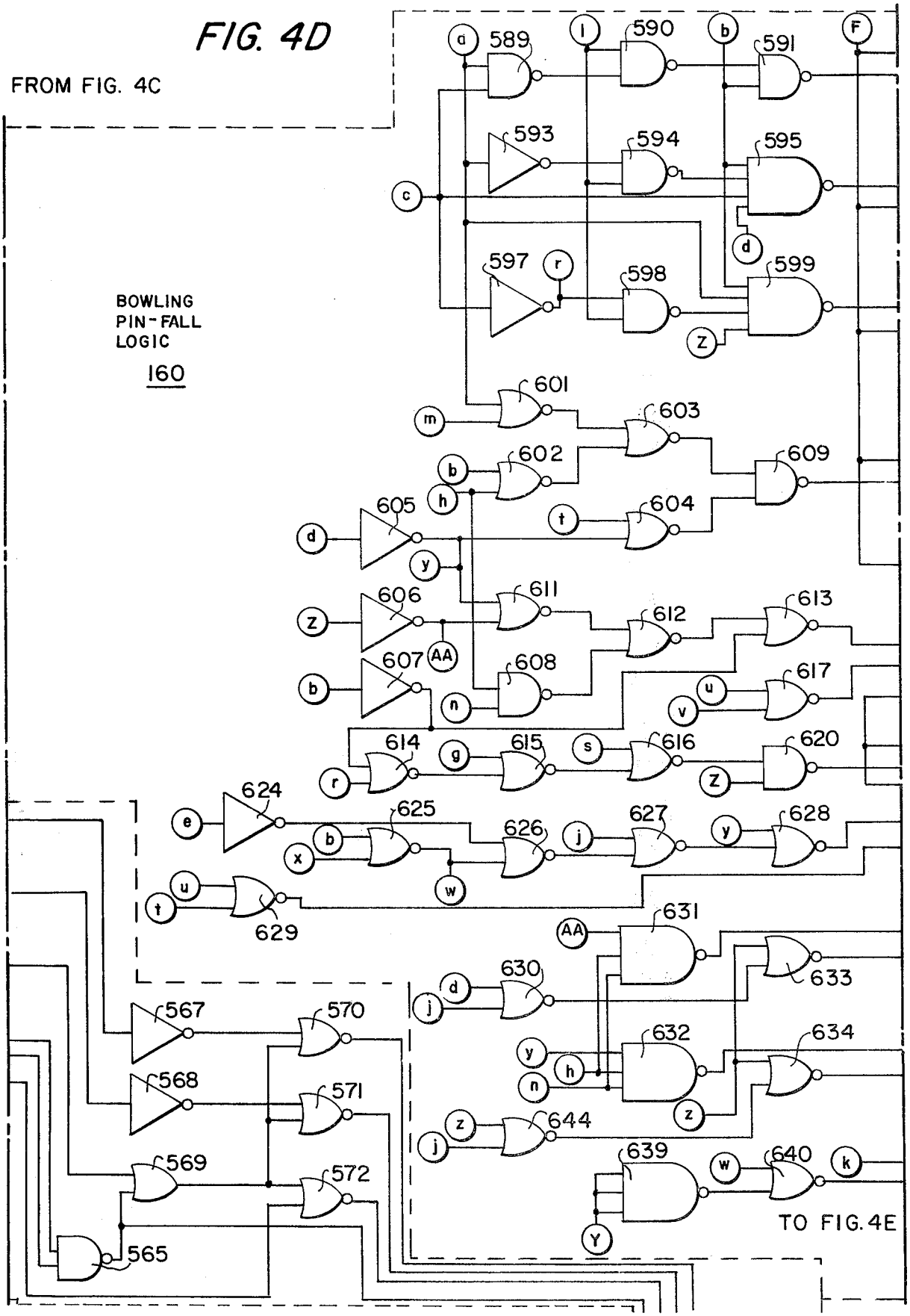
Figure 4E:
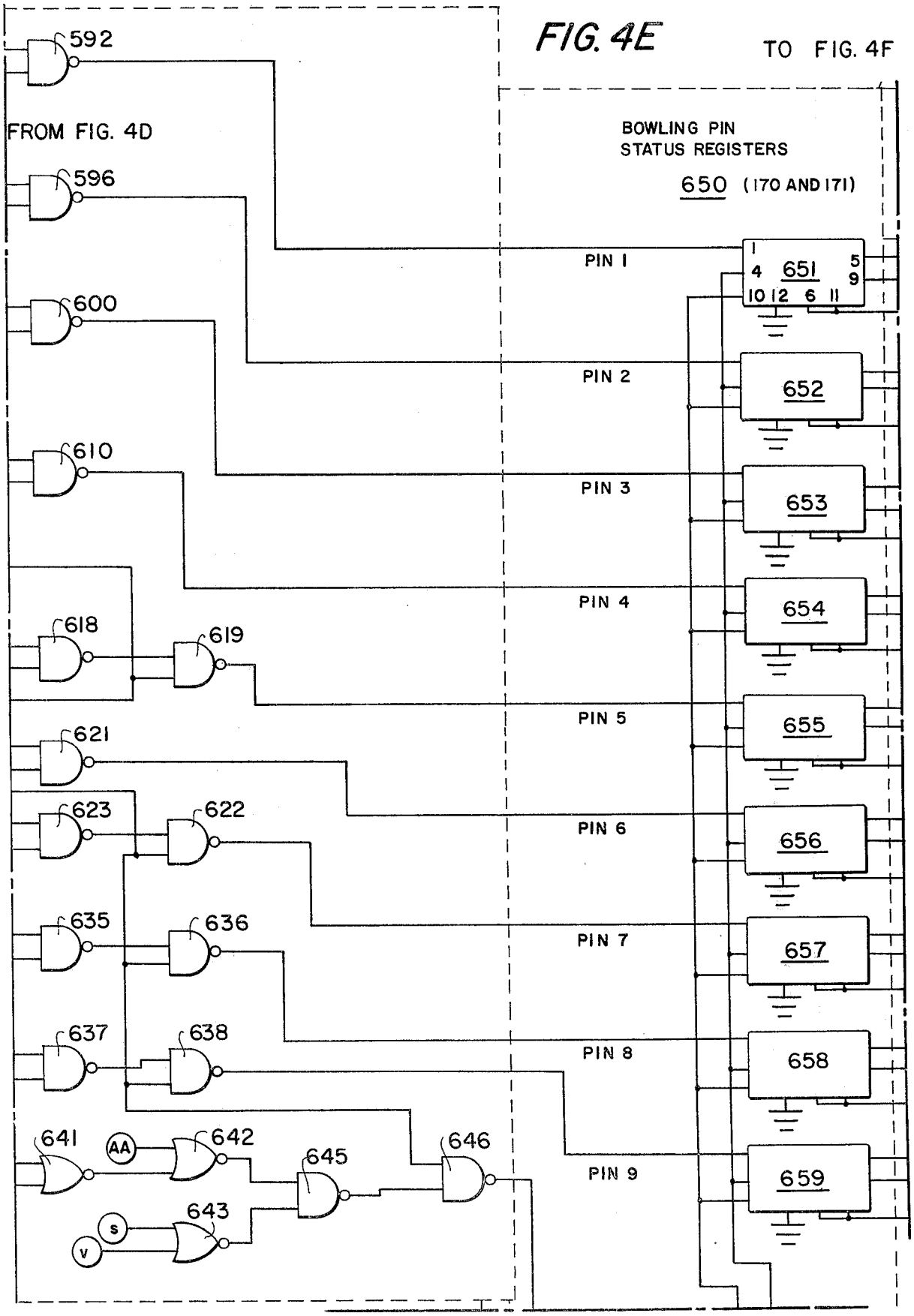
Figure 4F:
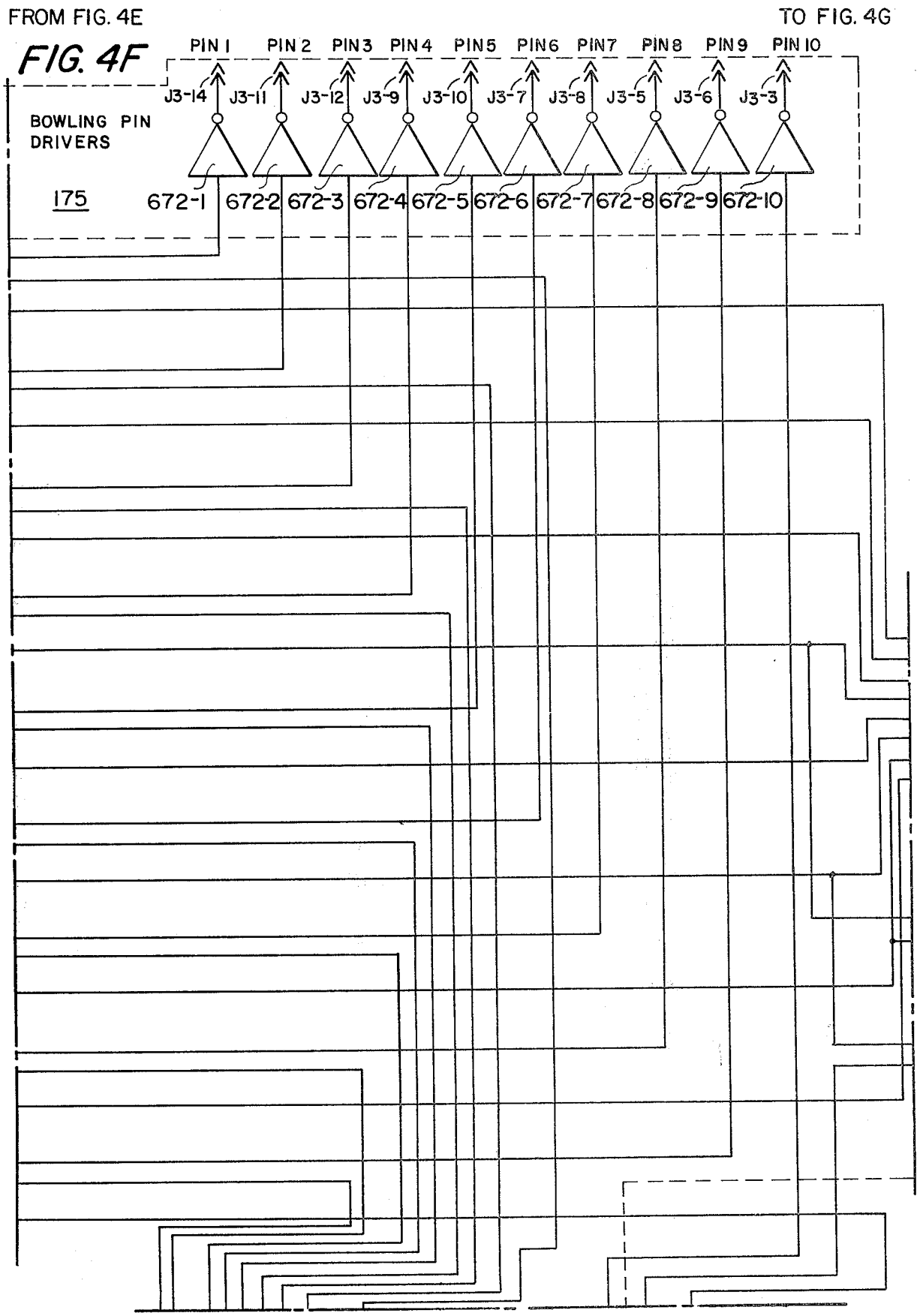
Figure 4G:
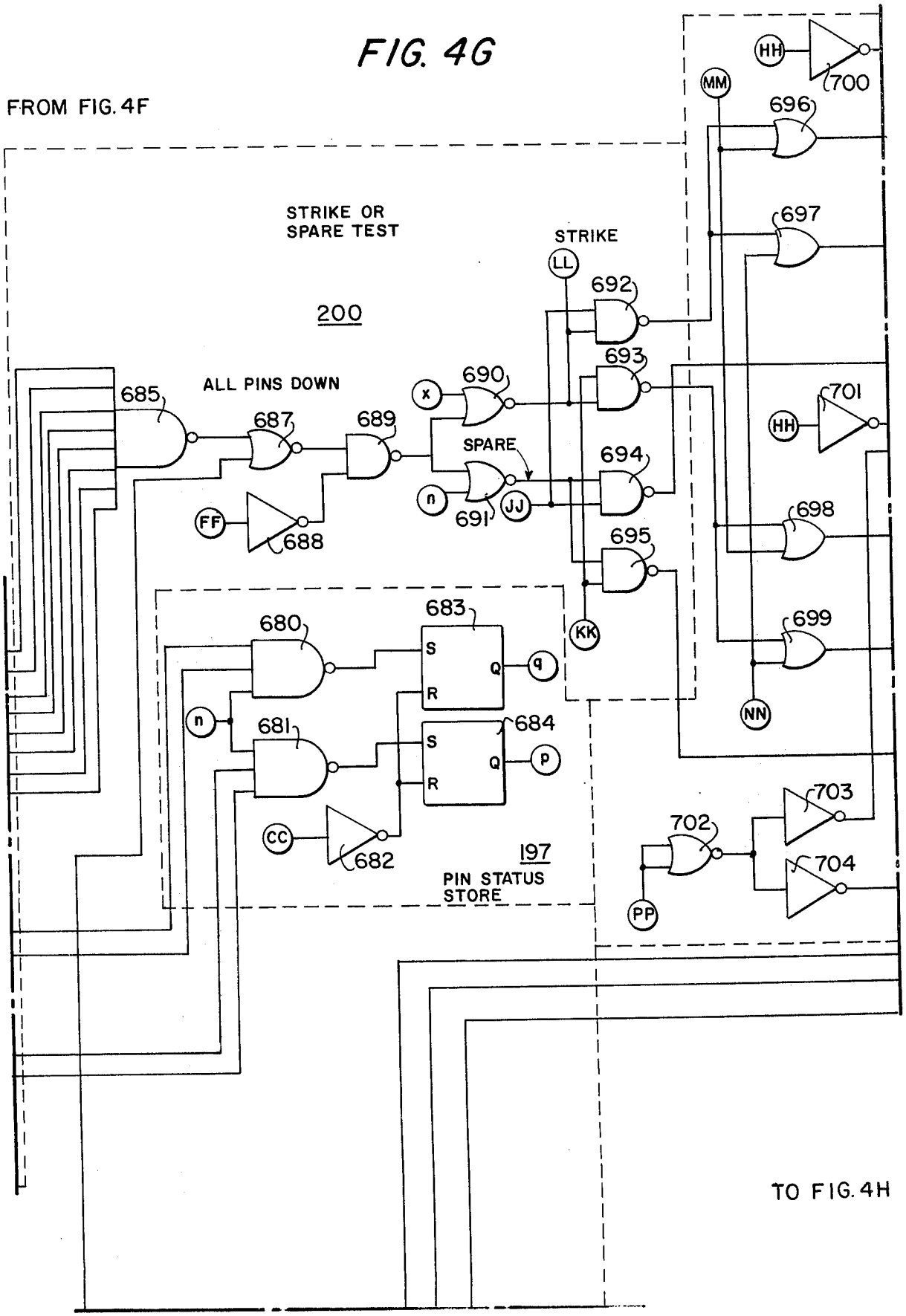
Figure 41:
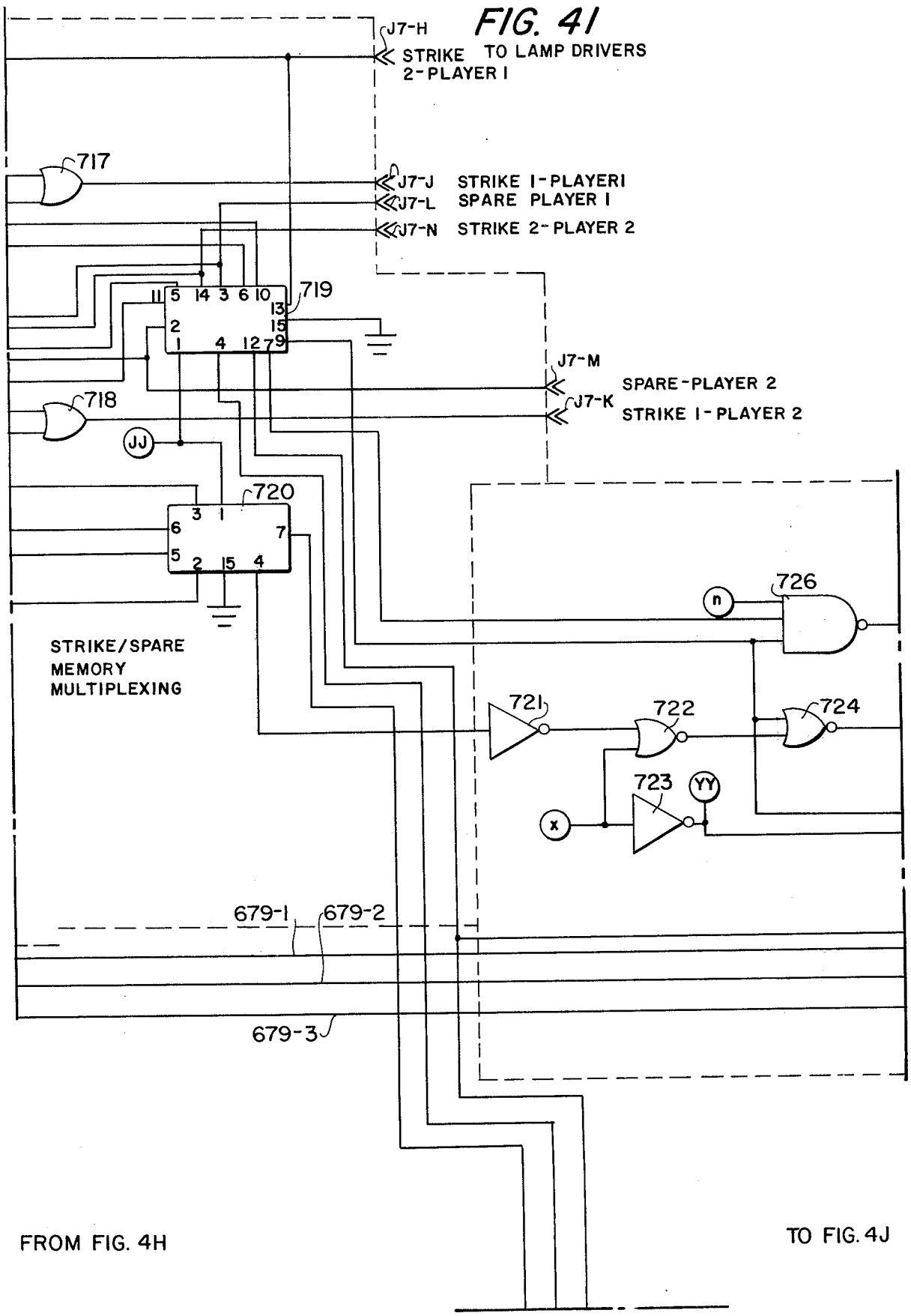
Figure 4J:
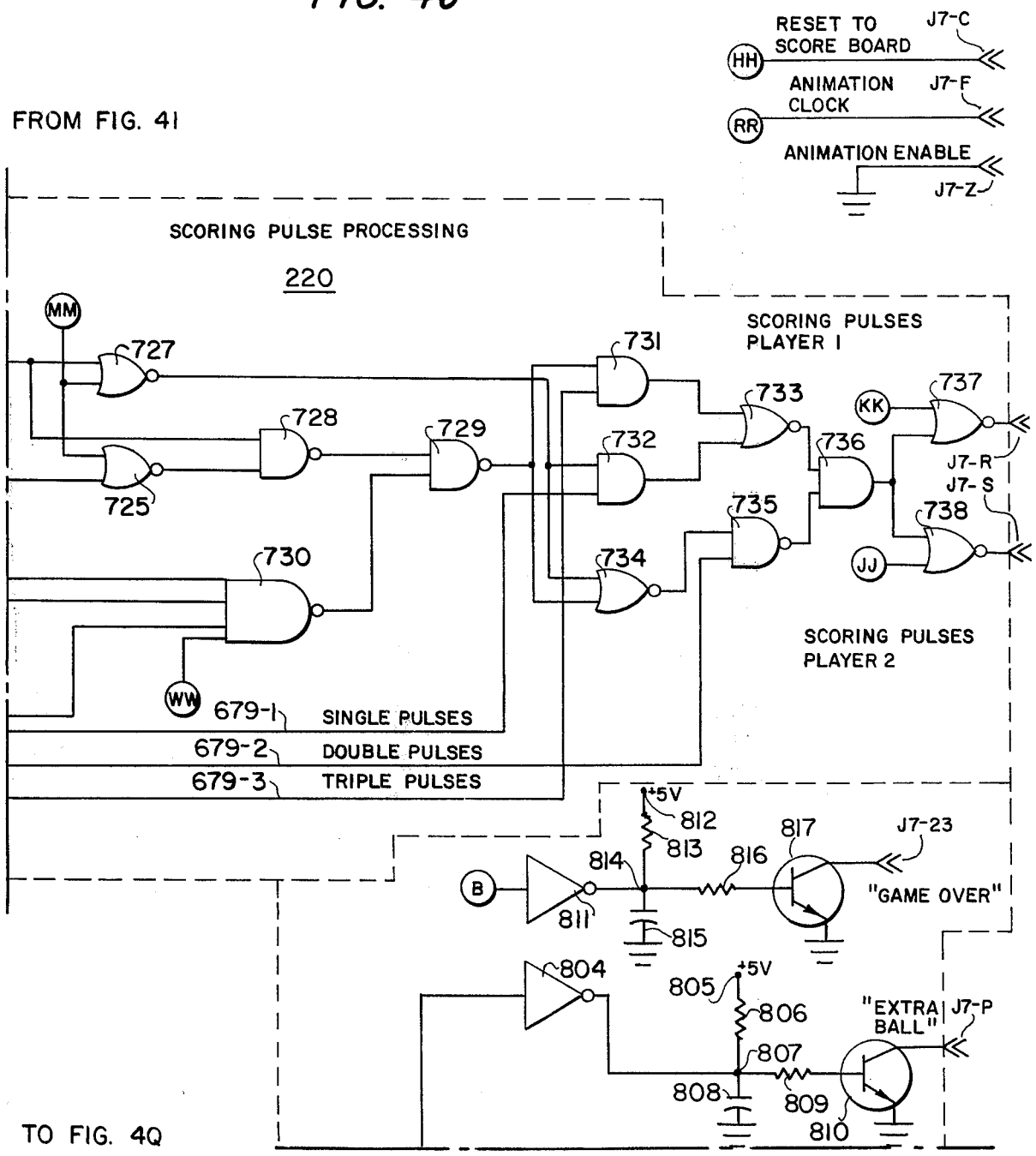
Figure 4K:
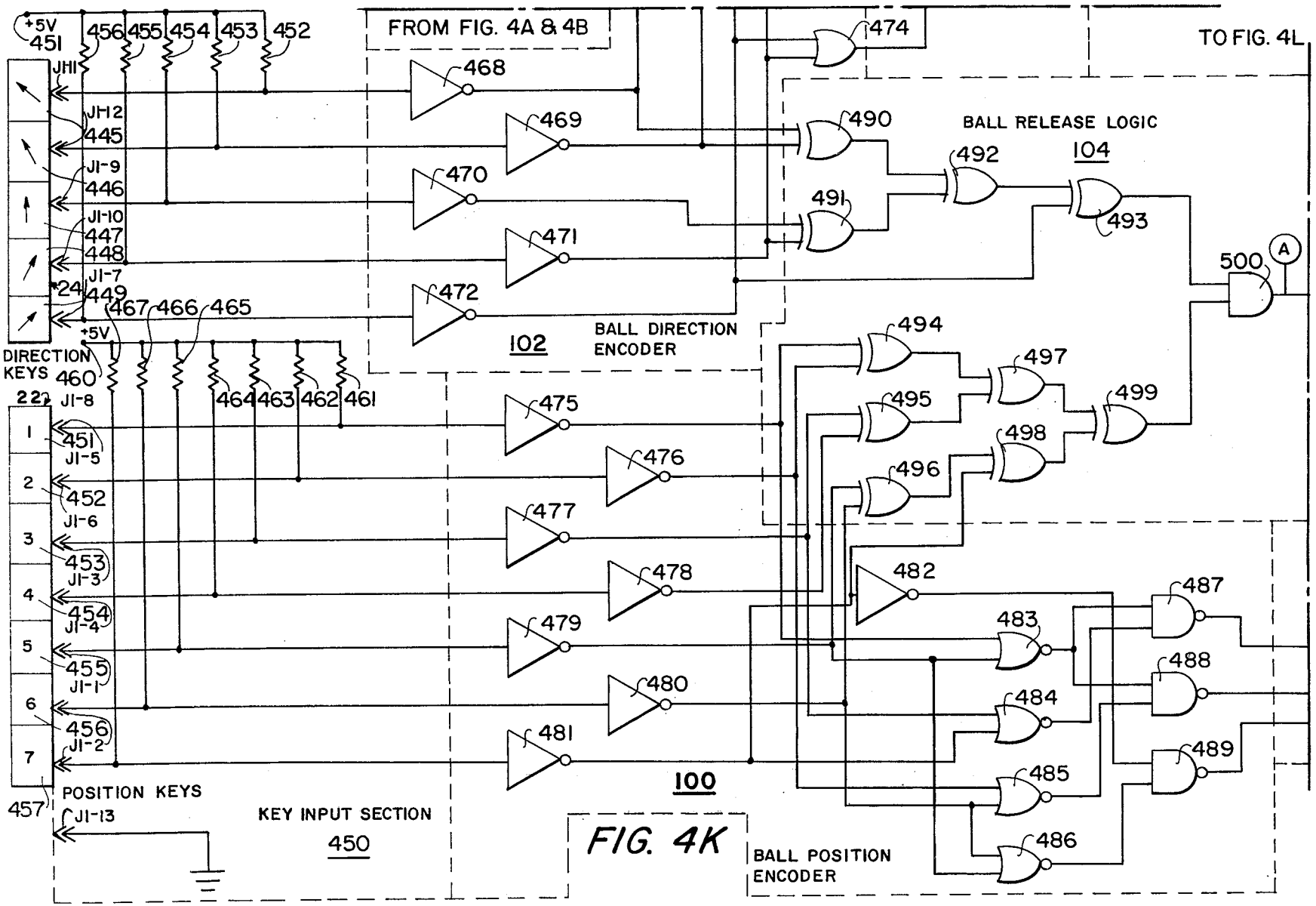
Figure 4L:
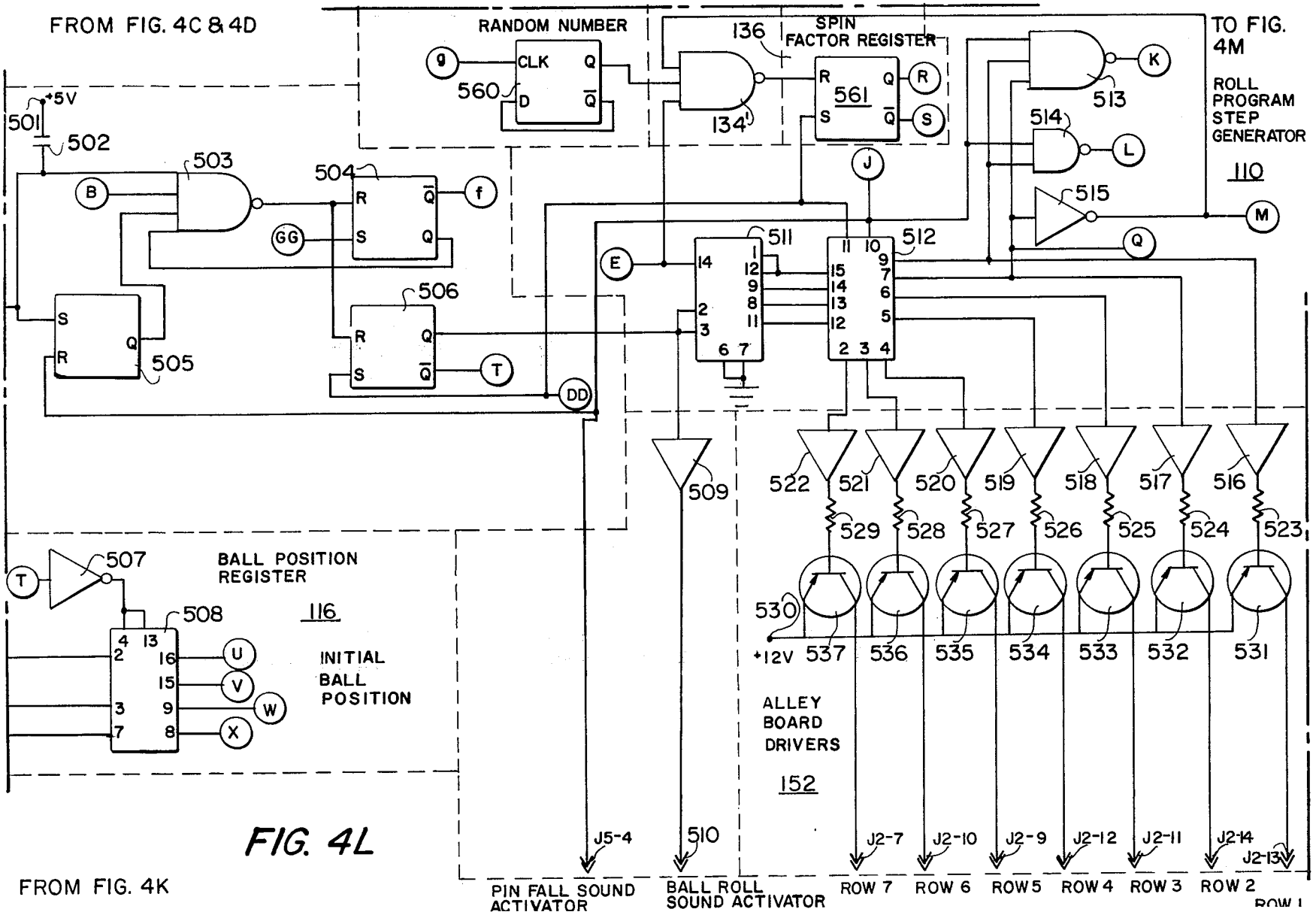

The BALL RELEASE signal from output Q of flip-flop 506 is also applied as a START signal of decade counter 511 (Type 7490) of roll program step generator 110 (FIG. 4L). Decade counter 511 counts to binary seven, providing a binary output signal on four parallel output leads which serve as an input to decoder circuit 512 which serves to convert the binary input signal to a decimal signal on seven output leads, connected, respectively, to buffers 516, 517, 518, 519, 520, 521, and 522 which correspond with row 1, row 2, row 3, row 4, row 5, row 6, and row 7 of the alley display board. Thus, referring to alley board row driver section 152, it will be noted that 1,000 ohm resistors 523, 524, 525, 526, 527, 528, and 529 couple the respective buffers to the base input leads of transistors 531, 532, 533, 534, 535, 536, and 537, each of which has its collector output lead connected to a respective one of the board terminals corresponding with row 1, row 2, row 3, row 4, row 5, row 6, and row 7, as follows: J2-13, J2-14, J2-11, J2-12, J2-10, and J2-7. A +12 volt bias terminal 530 is connected to the emitter electrodes of each of the transistors, which may be Type 2N5139 transistors. Referring to FIG. 5, it will be noted that the board terminals corresponding to row 1, row 2, row 3, row 4, row 5, row 6, and row 7 connect, respectively, to row leads 359*g*, 359*f*, 359*e*, 359*d*, 359*c*, 359*b*, and 359*a* of the alley display 331.

Returning to roll program step generator 110, it will be observed that pins 2, 3, 4, 5, 6, 7, and 9 of decoder 512 correspond to the first seven steps of the program; that is, output signals are provided in sequence on these leads. Thus, consecutive rows of the alley board will be energized in succession. Pin 10 of decoder 512 represents the eighth step of the roll program, and pin 11 represents the ninth step of the roll program. As previously mentioned, decoder 512 provides a signal corresponding to the eighth step of the roll program to signal connection point J, and pin 11, corresponding to the ninth step of the roll program, is connected to signal connection point DD. NAND gate 513 has three inputs connected, respectively, to pins 7, 9, and 10 of decoder 512, corresponding to steps six, seven, and eight of the roll program. The output from NAND gate 513 is connected to signal connection point K, representing step six, step seven, and step eight of the roll program. A NAND gate 514 is connected to pins 9 and 10 of decoder 512, corresponding to steps seven and eight of the roll program. The output from NAND gate 514 is connected to signal connection point L, providing a STEP SEVEN AND STEP EIGHT signal thereon, Pin 7 of decoder 512, corresponding to step six of the roll program is connected to signal connection point Q and through inverter 515 to signal connection point M.

Ball direction register 124 (FIG. 4B) includes a latch circuit 538 which is enabled by a signal from signal connection point T applied through an inverter 539, this signal being a CLEAR signal. Ball direction encoder 102 provides a binary direction signal on three parallel input leads to latch circuit 538, according to the following code: direction "Far Left", code 010; direction "Left", code 001; direction "Straight", code 000; direction "Right", code 101; direction "Far Right", code 110. Latch circuit 538 provides direction bit signals from pin 8 to signal connection point N, from pin 9 to signal connection point P, from pin 15 to an input of a NAND gate 548 and a NOR gate 551 of horizontal ball displacement logic circuit 128, from pin 1 to NAND gate 542 of horizontal ball displacement logic circuit 128, and from pin 16 to NAND gate 541 and NAND gate 546 of horizontal ball displacement logic circuit 128.

Horizontal ball displacement logic circuit 128 includes NAND gate 540, receiving an input from pin 16 of latch circuit 538 and from signal connection point M (step six of roll program). NAND gate 541 receives an input from pin 16 of latch circuit 538 and from signal connection point S from spin factor register 561. NAND gate 542 has one input connected to signal connection point R from spin factor register 561 and an input connected to pin 1 of latch circuit 538. The outputs from NAND gates 541 and 542 serve as inputs to NAND gate 543 which provides an input to NAND gate 544. The other input of NAND gate 544 is connected to signal connection point L (steps seven and eight of roll program). The outputs from NAND gate 540 and NAND gate 544 serves as inputs to NAND gate 545, the output from which provides one input to 4-bit binary adder 554 of adder 120. Signal connection point L is also connected as an input to NAND gate 548, the other input of which is connected to pin 15 of latch circuit 538. Pin 15 is also connected to an input of NOR gate 551, the other input of which is connected to pin 9 of latch circuit 538. The output from NOR gate 551 serves as an input to an OR gate 552, the other input of which is connected to signal connection point Q (step six of the roll program). The output from NAND gate 548 serves as an input to NAND gate 549, the other input of which is received from the output from NAND gate 550. NAND gate 550 receives an input from pin 9 of latch circuit 538 and from signal connection point K (roll program steps six, seven, and eight). The output from OR gate 552 serves as an input to NAND gate 547, the other input of which is received from NAND gate 546. The output from NAND gate 547 serves as a second input to 4-bit binary adder 554. The output from NAND gate 549 serves as a third input to 4-bit binary adder 554. The output from NAND gate 550 is applied through inverter 553 as the fourth input to binary adder 554. The other four inputs to binary adder 554 are connected to signal connection points U, V, W, and X, as previously explained.

Random number generator 130 plays a role in the production of the signals at signal connection points R and S from spin factor register 561; as was just explained, these signals play a role in the horizontal ball displacement. Random number generator 130 includes a binary counter 555 which is connected to receive $\overline{\text{DISPLAY CLOCK}}$ signals from signal connection point E of clock circuit 112. Binary output bits, representing a random number output, are provided on output leads to signal connection points, *g*, *h*, *j*, and *k*. The bit provided from signal connection point *j* is connected through inverter 556 to an input terminal of NAND gate 557, the other input terminal of which is connected to signal connection point *k*. The output from NAND gate 557 is connected to signal connection point *l* and through inverter 558 to signal connection point *m*. Signal connection point *j* is also connected to an input to NOR gate 559, the other input of which is connected to receive the signal on signal connection point *k*. As will be presently explained, the output from NOR gate 559 will serve as one of the inputs to the randomizing for pin fall logic circuit 164.

Another portion of random number generator 130 is provided by flip-flop 560 which receives the signal from signal connection point *g* on its CLK input terminal. The output from the Q terminal of flip-flop 560 is applied as an input terminal to NAND gate 134', which corresponds to AND gate 134 in FIG. 3A. The other inputs of NAND gate 134' are connected, respectively, to signal connection point E to receive the $\overline{\text{DISPLAY CLOCK}}$ signal and to signal connection point M to receive roll program $\overline{\text{STEP 6}}$ signal from roll program step generator 110. The output from NAND gate 134' is connected to the R input of flip-flop 561 forming spin factor register 136. The S input to spin factor register 136 is connected to pin 11 of decoder 512 of roll program step generator 110 to receive the ninth step of the roll program. The output terminal Q provides the signal to the R signal connection point, and the output from $\overline{Q}$ provides the signal to the S connection point.

Figure 4M:
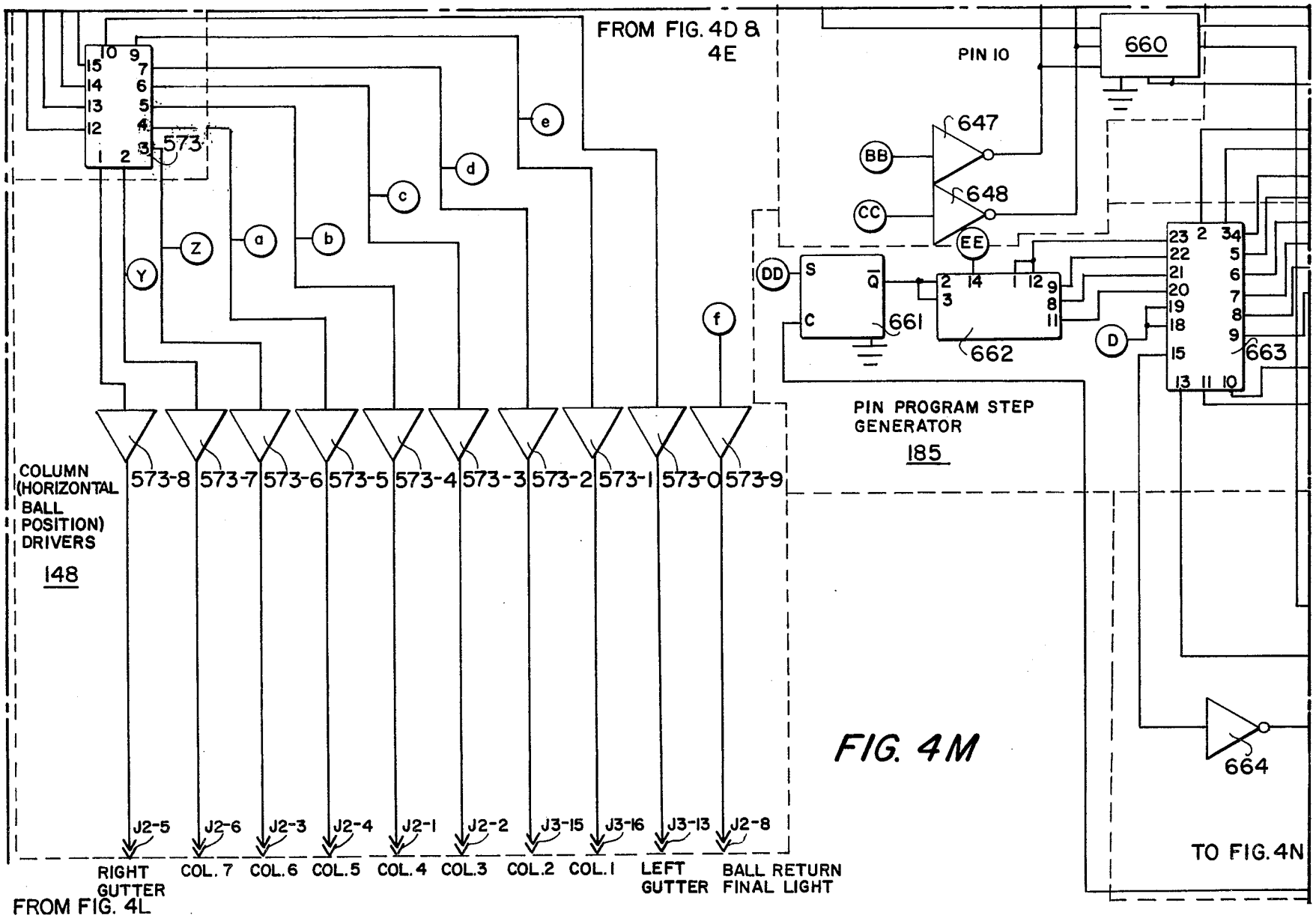
Figure 4N:
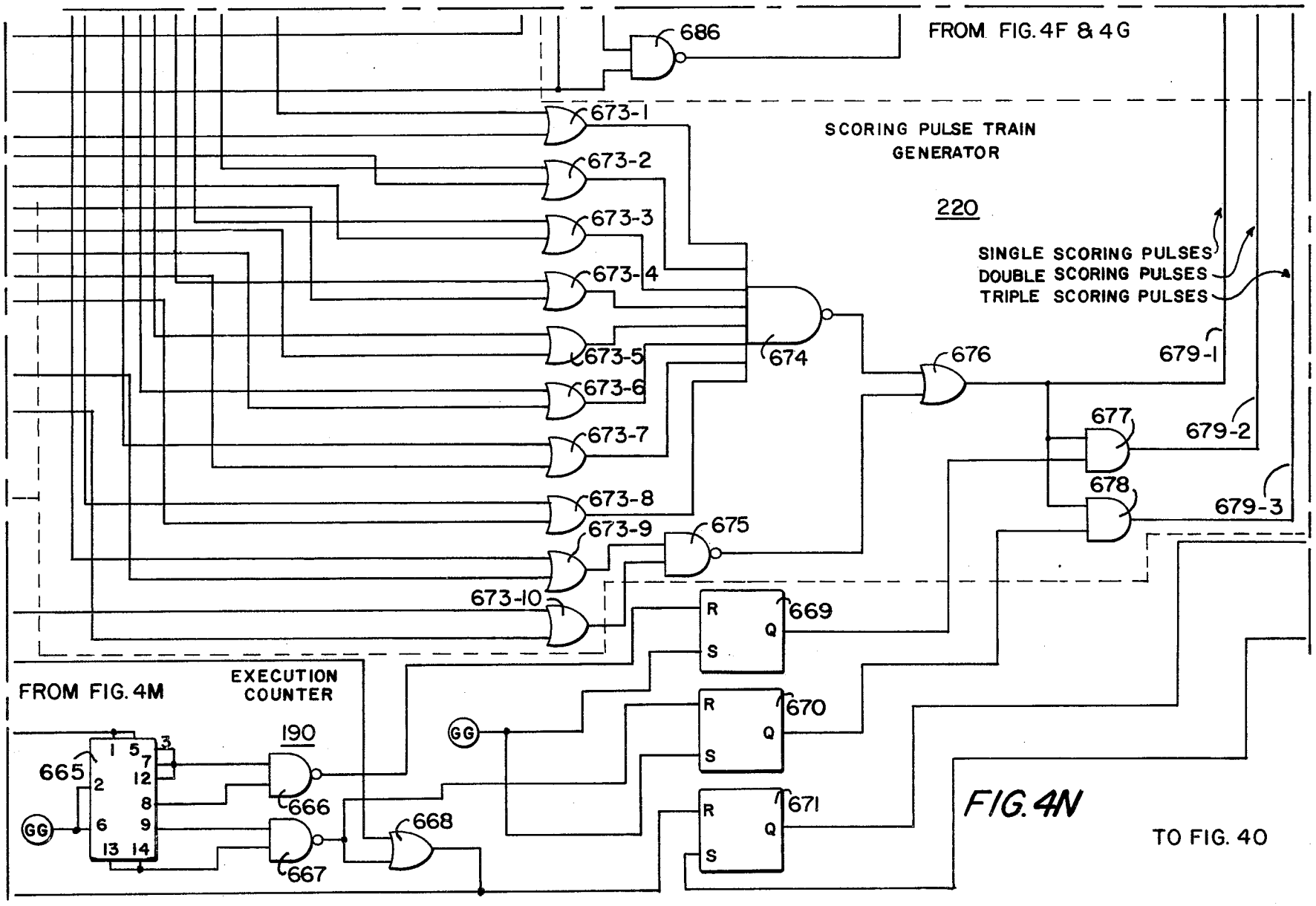

Returning to adder 120 and the output from binary adder 554, it will be noted that this output is provided to horizontal ball position decoder 146 (FIGS. 4C, 4D, and 4M). Pins 2 and 15 of adder 554 provide inputs to NOR gate 562 and to NAND gate 564. The output from NOR gate 562 provides an input to NAND gate 563, the other input of which is connected to signal connection point N (a ball direction bit). The output from NAND gate 563 is applied as an input to NAND gate 565, the other input of which receives the output from NAND gate 564. An AND gate 566 receives a signal from signal connection point P (a ball direction bit) and from the output from NOR gate 562. An inverter 567 receives the signal from pin 9 of adder 554; inverter 568 receives a signal from pin 6 of adder 554; and OR circuit 569 receives an input from AND gate 566 and from NAND gate 565. NOR circuit 570 receives inputs from inverter 567 and OR circuit 569. NOR circuit 571 receives inputs from inverter 568 and OR circuit 569. NOR circuit 572 receives inputs from OR circuit 569 and from pin 2 of adder 554. A decoder (Type 7442) 573 receives outputs from NOR gate 570, NOR gate 571, NOR gate 572, and NAND gate 565. The binary input signal received on these four parallel input leads of decoder 573, which are in a binary coded decimal code, are converted by decoder 573 to decimal signals on nine output leads connected, respectively, to pins 1, 2, 3, 4, 5, 6, 7, 9, and 10; these decimal signals correspond to the right gutter, column 7, column 6, column 5, column 4, column 3, column 2, columnn 1, and the left gutter of the alley display board. Referring to the column drivers 148 in FIG. 4M, it will be noted that buffer-driver 573-0 is connected between pin 10 of decoder 573 and board terminal J3-13 which, in turn, is connected to the left gutter line of the alley display board of FIG. 5. Buffer-driver 573-1 is connected between pin 9 of decoder 573 and board terminal J3-16 which is connected to the column 1 line of the alley display board. Buffer-driver 573-2 is connected between pin 7 and board terminal J3-15, corresponding to the column 2 line of the alley display board. Buffer-driver 573-3 is connected between pin 6 and board terminal J2-2, corresponding to the column 3 line of the alley display board. Buffer-driver 573-4 is connected between pin 5 and board terminal J2-1, corresponding to column 4 of the alley display board. Buffer-driver 573-5 is connected between pin 4 and board terminal J2-4, corresponding to column 5 of the alley display board. Buffer-driver 573-6 is connected between pin 3 and board terminal J2-3, corresponding to column 6 of the alley display board. Buffer-driver 573-7 is connected between pin 2 and board terminal J2-6, corresponding to column 7 of the alley display board. Buffer-driver 573-8 is connected between pin 1 and board terminal J2-5, corresponding to thr right gutter line of the alley display board. It will be noted, also, that signal connection ponts Y, Z, *a*, *b*, *c*, and *d* correspond, respectively, with the leads connected to columns 6, 5, 4, 3, 2 and 1 of the alley display board. Since decoder 573 provides a signal on only one of the leads 1, 2, 3, 4, 5, 6, 7, 9, and 10 at any one time, it uniquely energizes only one of the column lines 350, 351, 352, 353, 354, 355, 356, 357, and 358. Thus, only the ball lamp which corresponds to a uniquely energized column line and a uniquely energized row line will be activated on the alley display board of FIG. 5. A BALL RELEASE signal from signal connection point *f* is applied through buffer-driver 573-9 to board terminal J2-8 which connects to final lamp 363 of the ball return lamp set 360 of FIG. 5.

Randomizing for pin fall logic circuit 160 receives a bit related to two bits of a random number selected by random number generator 130 from NOR gate 559 of random number generator 130, this bit being applied to NAND gates 575 and 576 and a NOR gate 577. NOR gates 584 and 586 both receive the BALL 1 signal from signal connection point *n* and supplied by current ball logic circuit 250 The other input of NOR gate 584 is connected to signal connection point P to receive a ball direction bit from ball direction register 124, while the other input terminal of NOR gate 586 is connected to signal connection point N to receive another ball direction bit from ball direction register 124. The output from NOR gate 586 is applied as an input to inverter 574 and as the second input to NAND gate 575. The output from NAND gate 575 is connected to an input of NOR gate 579, the other input of which is connected to signal connection point *p* providing a pin status bit from pin status store 197. The output from NOR gate 579 is connected as one input of a NOR gate 580, the other input of which is connected to inverter 574. The output from NOR gate 580 is connected as an input to NOR gate 581, the other input of which is connected to signal connection point *a* to receive the COLUMN 5 signal from horizontal decoder 146. The output from NOR gate 581 provides a randomizing bit to signal connection point *u*. The ouput from NOR gate 584 is connected to inputs to NAND gate 576 and NOR gate 577. The output from NAND gate 576 provides one input to NOR gate 578, the other input of which is connected to signal connection point *q* providing a pin status bit from pin status store 197. A NOR gate 582 has inputs connected to NOR gate 578 and NOR gate 577 and is, in turn, connected as an input to NOR gate 583. The other input to NOR gate 583 is connected to signal connection point *c* to receive a COLUMN 3 signal therefrom. The output from NOR gate 583 provides a randomizing bit to signal connection point *v*. A NOR gate 585 receives an input from NOR gate 584 and from signal connection point a to receive the COLUMN 5 signal from horizontal decoder 146. The output from NOR gate 585 is connected to signal connection point *s* to provide a further randomizing bit. A NOR gate 587 receives an input from NOR gate 586 and from signal connection point c which provides a COLUMN 3 signal from horizontal decoder 146. The output of NOR gate 587 is connected to signal connection point 5 providing a further randomizing bit. A NAND gate 588 has three input leads connected, respectively, to signal connection point a (COLUMN 5), to signal connection point *c* (COLUMN 3), and to signal connection point *b* (COLUMN 4). The output from NAND gate 588 is connected to signal connection point *z* to provide a fifth randomizing bit. The five bits provided by randomizing for pin fall logic 164 are, therefore, functions of a random number bit provided from NOR gate 559, ball direction bits provided from signal connection points N and P, pin status bits provided from signal connection points *p* and *q*, and horizontal ball position bits provided from signal connection points *a*, *b* and *c*.

Bowling pin fall logic circuit 160 includes a NAND gate 589 having one input connected to signal connection point a and the other input connected to signal connection point *c*. The output from NAND gate 589 provides one input to NAND gate 590, the other input of which is connected to signal connection point *l*, receiving a random number bit from random number generator 130. The output from NAND gate 590 is connected as an input to NAND gate 591, to other input of which is connected to signal connection point *b*. The output from NAND gate 591 is connected as an input to NAND gate 592, the other input of which is connected to signal connection point F from which the PIN FALL ENABLE signal is derived. The output from NAND gate 592 will determine whether Pin 1 of the bowling pins will fall.

An inverter 593 receives the signal from signal connection point a and provides an input to NAND gate 594, the other input of which is connected to signal connecion point l. The output from NAND gate 594 provides one input to NAND gate 595. A second input to NAND gate 595 is received from signal connection point *b*, while a third input to NAND gate 595 is connected to signal connection point *c*. A fourth input to NAND gate 595 is derived from signal connection point *d* providing the COLUMN 2 signal. The output from NAND gate 595 provides one input to NAND gate 596, the other input to which receives the PIN FALL ENABLE signal from signal connection point F. The output of NAND gate 596 will determine whether Pin 2 will fall.

The logic determining whether Pin 3 will fall includes an inverter 597 connected to signal connection point *c*. The output from inverter 597 is connected to signal connection point r providing thereat a $\overline{\text{COLUMN 3}}$ signal. The output from inverter 597 also provides one input to NAND gate 598, the other input to which is taken from signal connection point *l*. The output from NAND gate 598 provides one input to NAND gate 599. A second input to NAND gate 599 is connected to signal connection point *a*, a third input to signal connection point *b*, and a fourth input to signal connection point Z, which provides a COLUMN 6 signal from horizontal decoder 146. The output from NAND gate 599 provides one input to NAND gate 600, the other input to which receives the PIN FALL ENABLE signal from signal connection point F. The output from NAND gate 600 determines whether Pin 3 will fall.

A NOR gate 601 receives an input from signal connection point a and from signal connection point *m*, which provides a random number bit from random number generator 130. A NOR gate 602 receives an input from signal connection point *b* and from signal connection point *h*, which provides a random number bit from random number generator 130. The outputs from NOR gates 601 and 602 provide inputs to a NOR gate 603, the output from which is connected as an input to NAND gate 609. A NOR gate 604 has one input connected to signal connection point t from which it receives a randomizing bit from randomizing for pin fall logic circuit 164. The other input to NOR gate 604 is connected to the output of inverter 605, the input of which is connected to signal connecion point *d* from which it receives a COLUMN 2 signal. Inverter 605 also is connected to signal connection point *y* to which it provides a $\overline{\text{COLUMN 2}}$ signal. The output from NOR gate 604 provides the second input to NAND gate 609, the output from which provides an input to NAND gate 610, the other input of which receives the PIN FALL ENABLE signal from signal connection point F. The output from NAND gate 610 determines whether Pin 4 will fall.

An inverter 606 receives a signal from signal connection point Z from which it receives a COLUMN 6 signal and has its output connected to signal connection point AA providing a $\overline{\text{COLUMN 6}}$ signal. The output from inverter 606 is also connected as an input to NOR gate 611, the other input to which receives the $\overline{\text{COLUMN 2}}$ signal from inverter 605. The output from NOR gate 611 provides one input to NOR gate 612. An inverter 607 is connected to signal connection point *b* and has its output connected to an input of NOR gate 613, the other input of which receives the output from NOR gate 612. NOR gate 613 provides an input to NAND gate 618, the output from which provides an input to NAND gate 619. The other input to NAND gate 618 is connected to the output from NOR gate 617, the two inputs to which are connected to signal connection points *u* and *v*, which receive randomizing bits from the randomizing for pin fall circuit 164. The other input to NOR gate 612 is received from NAND gate 608, which has a first input connected to signal connection point *h* from which it receives a random number bit and a second input connected to signal connecion point *n* from which it receives the BALL 1 signal. NAND gate 619, which receives an input from NAND gate 618 receives on its other input lead the PIN FALL ENABLE signal from signal connecion point F. The output from NAND gate 619 determines whether Pin 5 will fall.

A NOR gate 614 has one input connected to inverter 607 and another input connected to signal connection point *r* from which it receives the $\overline{\text{COLUMN 3}}$ signal. The output from NOR gate 614 provides one input to NOR gate 615, the other input to which is connected to signal connection point *g* from which it receives a random number bit from random number generator 130. The output from NOR gate 615 provides one input to NOR gate 616, the other input to which is connected to signal connection point *s* from which it receives a randomizing bit provided from the randomizing for pin fall logic circuit 164. The output from NOR gate 616 provides an input to NAND gate 620, the other input to which is connected to signal connecion point Z, providing a COLUMN 6 signal. The output from NAND gate 620 is connected as an input to NAND gate 621, the other input to which receives the PIN FALL ENABLE signal from signal conneciton point F. The output from NAND gate 621 determines whether Pin 6 will fall.

Inverter 624 receives an input from signal connection point e which provides the COLUMN 1 signal and provides an input to NOR gate 626. A NOR gate 625 has inputs connected to signal connection point *b* and to signal connection point *x*, from which it receives a BALL 2 signal. The output from NOR gate 625 is connected to signal connection point *w*. NOR gate 625 also provides one input to NOR gate 626, the output from which provides one input to NOR gate 627. The other input to NOR gate 627 is connected to signal connection point *j*, providing a random number bit from random number generator 130. The output from NOR gate 627 provides one input to NOR gate 628, the other input to which is connected to signal connection point *y*, from which it receives a $\overline{\text{COLUMN 2}}$ signal. The output from NOR gate 628 provides an input to NAND gate 623, the other input to which is connected to the output of NOR gate 629. The two inputs to NOR gate 629 are provided from signal connection points *u* and *t* providing randomizing bits from randomizing for pin fall logic circuit 164. The output from NAND gate 623 provides one input to NAND gate 622, the other input to which receives the PIN FALL ENABLE signal from signal connection point F. The output from NAND gate 622 determines whether Pin 7 will fall.

A NOR gate 630 has inputs connected to signal connection point *d* and to signal connection point *j* and provides an output to one input terminal of NOR gate 633. The other input terminal to NOR gate 633 is connected to signal connection point *z* from which it receives a randomizing bit provided by randomizing for pin fall logic circuit 164. The output from NOR gate 633 provides one input to NAND gate 635, the other input to which is connected to an output from NAND gate 631. One input to NAND gate 631 is conneced to signal connection point AA from which it receives the $\overline{\text{COLUMN 6}}$ signal. A second input to NAND gate 631 is connected to signal connection point h providing a random number bit. A third input to NAND gate 631 is connected to signal connection point *n*, providing the BALL 1 signal. The output from NAND gate 635 provides one input to NAND gate 636, the other input to which receives the PIN FALL ENABLE signal from signal connection point F. The output from NAND gate 536 determines whether Pin 8 will fall.

A NAND gate 632 has three inputs connected, respectively, to signal connection point *y*, receiving the $\overline{\text{COLUMN 2}}$ signal, signal connection point *h*, receiving a random number bit, and signal connection point *n*, receiving the BALL 1 signal. The output from NAND gate 632 provides one input to a NAND gate 637. The other input to NAND gate 637 is received from NOR gate 634. One input to NOR gate 634 is received from signal connection point *z*, providing a randomizing bit. The other input to NOR gate 634 is received from NOR gate 644, the inputs to which are connected to signal connection point Z (COLUMN 6) and signal connection point *j*, providing a random number bit. The output from NAND gate 637 provides one input to NAND gate 638, the other input to which receives the PIN FALL ENABLE signal from signal connection point F. The output from NAND gate 638 determines whether Pin 9 will fall.

A NAND gate 639 has three input terminals connected in common to signal connection point Y, providing the COLUMN 7 signal. The output from NAND gate 639 provides one input to NOR gate 640, the other input to which is connected to signal connection point *w*. The output from NOR gate 640 provides an input to NOR gate 641, the other input to which is connected to signal connection point *k*, providing a random number bit. The output from NOR gate 741 provides an input to NOR gate 642, the other input to which is connected to signal connection point AA, providing the $\overline{\text{COLUMN 6}}$ signal. The output from NOR gate 642 provides one input to NAND gate 645, the other input to which is received from NOR gate 643. NOR gate 643 has inputs connects to signal connection point *s* and signal connection point *v*, from which it receives randomizing bits. The output from NAND gate 645 provides one input to NAND gate 646, the other input to which receives the PIN FALL ENABLE signal from signal connection point F. The output from NAND gate 646 will determine whether Pin 10 will fall.

The PIN FALL signals from pin fall logic circuit 160 are received by bowling pin status registers 650, which comprise ten dual D-type edge-triggered flip-flops 651, 652, 653, 654, 655, 656, 657, 658, 659, and 660, receiving, respectively, PIN FALL signals for Pins 1, 2, 3, 4, 5, 6, 7, 8, 9, and 10 as shown in FIGS. 4E and 4M. It will be understood that each of these flip-flops contain both halves of the dual flip-flops, forming two sets of flip-flips. The first set corresponds to pin status register 170 and will provide fixed data as to fallen pins throughout a frame. The second set of flip-flops corresponds to pin status register 171 and will provide information after each ball roll as to which pins have fallen on that ball roll. There are, therefore, two sets of outputs from flip-flops 651, 652, 653, 654, 655, 656, 657, 658, 659, and 660, corresponding to pin status registers 170 and 171. It will be noted that an inverter 647 receives a signal from signal connection point BB from which it receives a RESET PINS signal. The output from inverter 647 is connected to one input of each of the dual flip-flops constituting pin status register 171. An inverter 648 is connected to signal connection point CC, receiving a RESET PINS signal therefrom for resetting the other flop-flop of each of the dual flip-flops constituting pin status register 170. As will be evident from detailed consideration of pin reset logic circuit 266 hereinafter, these two PIN RESET signals are provided when different logic conditions are present.

Before proceeding with the manner in which pin fall status data from register 650 is used in the scoring of the game, consideration will be given to pin program step generator 185 which provides signals which are used in the scoring routine. As will be seen from FIG. 4M, pin program step generator 185 includes a flip-flop 661 which receives on its S terminal a signal from signal connection point DD, providing the roll program STEP 9 signal. Thus, when the roll program reaches step 9, the pin program step generator is enabled. The C input to flip-flop 661 is connected to the output of an OR gate 668 in execution counter 190, as will be presently described. The $\overline{Q}$ output from flip-flop 661 serves as an input to enable a 4-bit binary counter 662. This counter receives clock pulses from signal connection point EE, which are provided by scoring clock 440. The four output lines from binary counter 662 are connected as inputs to decoder-demultiplexer 663 which converts the 4-line binary input to a 16-line decimal output. The $\overline{\text{SCORING CLOCK}}$ signal is provided from signal connection point D to pins 18 and 19 of decoder-demultiplexer 663. An output from pin 15 of decoder-demultiplexer 663 is connected through inverter 664 to input terminals of a master-slave flip-flop 665 of execution counter 190. The output from pins 3, 7 and 12 of master-slave flip-flop 665 is applied as an input to a NAND gate 666. Pin 9 provides an input to a NAND gate 667, while a second input is provided from pins 13 and 14 to NAND gate 667. An OR gate 668 has one input connected to pin 13 of decoder-demultiplexer 663, while its second input is connected to the output fron NAND gate 667. The output fron NAND gate 666 provides an input to the R input terminal of flip-flop 669. The output from the Q output terminal of flip-flop 669 provides a signal to be used in scoring pulse train generator 220, as will be presently described. The output from NAND gate 667 provides an input to the R terminal of a flip-flop 670, and the output from the Q terminal of flip-flop 670 is used in the scoring pulse train generator 220 as will be described. The output from OR circuit 668 is connected to the C input terminal of flip-flip 661, as has already been described. It also provides an input to the R input terminal of flip-flip 671. The output from the Q output terminal of flip-flop 661 is used to enable updating step generator 240, as will be presently described. The S inputs to filp-flip 669 and 670 are connected to signal connection point GG, which provide the $\overline{\text{RESET PINS}}$ signal from pin reset circuit 266. The execution count by execution counter 190 is terminated by a signal to the S terminal of flip-flop 671. This signal is provided from updating step generator 240, as will be described.

Returning to the outputs from pin status register 650, the output from the flip-flops forming pin status register 170 are provided as inputs to inverter buffers 672-1, 672-2, 672-3, 672-4, 672-5, 672-6, 672-7, 672-8, 672-9, and 672-10, which are connected, respectively, to the lines for Pin 1, Pin 2, Pin 3, Pin 4, Pin 5, Pin 6, Pin 7, Pin 8, Pin 9, and Pin 10 of the bowling pin display 370 of FIG. 5. This connection is effected through board terminal J3-14, J3-11, J3-12, J3-9, J3-10, J3-7, J3-8, J3-5, J3-6, and J3-3 which connect, respectively, to pin display lines 381 through 390 of display 370 of FIG. 5.

Returning to the bowling pin status register 650, it is to be noted that each of the dual flip-flops is provided with the same pin connections as are shown for dual flip-flop 651 in FIG. 4E. Thus, the outputs to the bowling pin drivers are all taken from pin 5 of the respective dual flip-flops. Outputs to scoring pulse train generator 220 are taken from pin 9 of the respective dual flip-flop, this pin consituting an output terminal of the flip-flop of each dual set constituting pin status register 171. These outputs from pin 9 of dual flip-flop 651 through 660 are connected, respectively, to an input terminals of OR gates 673-1, 673-2, 673-3, 673-4, 673-5, 673-6, 673-7, 673-8, 673-9, and 673-10. The other input terminals of these OR gates are connected to pins 2, 3, 4, 5, 6, 7, 8, 9, 10, and 11 of decoder-demultiplexer 663 of pin program step generator 185, these pins providing the first ten successive steps of the pin program. The first eitht of the aforementioned OR gates have their outputs connected as inputs to a NAND gate 674, the output from which is connected as an input to OR gate 676. OR gate 673-9 and OR gate 673-10 provide the two inputs to NAND gate 675, the output from which provides the other input to OR gate 676. The output from OR gate 676 on line 679-1 provides a single scoring pulse train. The output from OR gate 676 also serves as inputs to AND gates 677 and 678, the other inputs to which are received from the Q output terminals of flip-flops 669 and 670. The outputs of AND gates 677 and 678 provide the double scoring pulse train on line 679-2 and the triple scoring pulse train on line 679-3, respectively. As will be explained hereinafter, the scoring pulse trains on lines 679-1, 679-2, and 679-3 will be employed for computing the score of the corresponding player.

Pin status store 197 retains data as to what happened on the first roll which will affect the pin fall on the second roll. Pin status data is received on a first input to NAND gate 680 from pins 6 and 11 of dual flip-flop 654, on a second input from pins 6 and 11 of dual flip-flop 657, and on a third input from signal connection point n, which provides the BALL 1 signal. NAND gate 681 has one input connected to signal connection point n, a second input connected to pins 6 and 11 of dual flip-flop 656, and a third input terminal connected to pins 6 and 11 of dual flip-flop 660. An inverter 682 has an input connected to signal connection point CC, providing a RESET PINS signal from pin reset circuit 266, and the output from inverter 682 is connected to the R inputs to a pair of flip-flops 683 and 684. The output from NAND gate 680 is connected to the S input of flip-flop 683, while the output from NAND gate 681 is connected to the S input to flip-flop 684. The Q output from flip-flop 683 is connected to signal connection point *q*, and the Q output from flip-flop 684 is connected to signal connection point *p*.

Pins 6 and 11 of each of the dual flip-flops constituting bowling pin status register 650 serve as inputs to strike or spare test logic circuit 200. A NAND gate 685 has eight input leads connected, respectively, to pins 6 and 11 dual flip-flops 651, 652, 653, 654, 655, 656, 657, and 658. The output from NAND gate 685 provides one input to NOR gate 687. The other input to NOR gate 687 receives an output from NAND gate 686, the inputs to which are the outputs from pins 6 and 11 of dual flip-flops 659 and 660. The output from NOR gate 687 provides one input to NAND gate 689, the other input of which is connected to the output from an inverter 688. The input to inverter 688 is connected from signal connection point FF, providing a step signal from udating step generator 240 as will be presently explained. The output from NAND gate 689 provides inputs to NOR gates 690 and 691. The other input to NOR gate 690 is connected to signal connection point *x* which provides the BALL 2 signal. The other input to NOR gate 691 is connected to signal connection point n which provides the BALL 1 signal. When the signal is provided from NOR gate 687, it signifies that all pins are down, and the purpose of NOR gates 690 and 691 is to distinguish between a strike and a spare. The output from NOR gate 690 is connected as inputs to NAND gates 692 and 693. It is also connected to signal connection point LL, providing a STRIKE signal. The output from NOR gate 691 is the SPARE signal and is applied as an input to NAND gates 694 and 695. A PLAYER 1 signal is applied from signal connection point JJ to inputs to NAND gates 692 and 694, while a PLAYER 2 signal is applied from signal connection point KK to inputs to NAND gates 694 and 695. In this way, strikes and spares for each player are distinguished.

Strike and spare memory 210 receives the outputs from NAND gtes 692, 693, 694, and 695. The output from NAND gate 692 is applied as inputs to OR gates 696 and 697. The output from NAND gate 693 is applied as inputs to OR gates 698 and 699. The output from NAND gate 694 is applied as an input to the S terminal of a flip-flop 707. The output from NAND gate 695 is applied as an input to the S terminal of flip-flop 713. The second input to OR gate 696 is connected to signal connection point MM, which signal connection point is also connected to the other input terminal to OR gate 698. The second input terminals or OR gate 697 and OR gate 699 are connected to signal connection point NN. It will be noted that the signal provided from signal connection point MM is the FRAME 11 OR 12 signal, while the signal applied to signal connection point NN is the FRAME 11 signal, both signals being derived from frame number logic 270. A signal from cash credit logic 410 is applied from signal connection point HH through inverter 700 to the R inputs of flip-flops 705, 707, 708, 709 and 710 and to the S input to flip-flop 706 and through inverter 701 to the R inputs of flip-flops 711, 713, 714, 715 and 716 and to the S input to flip-flop 712. The output from OR gate 696 is applied to the S input of flip-flop 705. The output from OR gate 697 is connected to the R input to flip-flop 706. The output from OR gate 698 is connected to the S input to flip-flop 711. The output from OR gate 699 is connected to the R input to flip-flop 712. A STRIKE/SPARE SHIFT ENABLE signal is provided from signal connection point PP to both inputs of a NOR gate 702, the output from which is applied to a pair of inverters 703 and 704. The output from inverter 703 is connected to the C inputs of flip-flops 705 and 707 and the C inputs of flip-flops 708, 709, and 710. The output from inverter 704 is connected to the c inputs to flip-flops 711 and 713 and to the C inputs to flip-flops 714, 715, and 716. The Q output from flip-flop 705 is connected to the D input to flip-flop 708; and Q output from flip-flop 707 is connected to the D input to flip-flop 710; the Q output from flip-flop 711 is connected to the D input to flip-flop 714; and the Q output from flip-flop 713 is connected to the D input to flip-flop 716. It is to be noted also that the Q output of flip-flop 708 is connected to the D input to flip-flop 709 and that the Q output from flip-flop 714 is connected to the D input to flip-flop 715. Flip-flops 705 through 710 serve as the strike and spare memory for PLAYER 1. Flip-flops 711 through 716 constitute the strike and spare memory for PLAYER 2.

As will be seen in FIG. 4I, strike and spare memory 210 includes a strike/spare memory multiplexing section. The output from flip-flop 708 is applied as one input to OR gate 717 and as an input to pin 10 of data selector/multiplexer 719. The other input to OR gate 717 is taken from the $\overline{Q}$ output from flip-flop 706. The output from OR gate 717 is connected to board terminal J7-J which is connected to the Strike 1 - Player 1 lamp on the scoring display panel. The output from the Q terminal of flip-flop 705 is connected to pin 13 of data selector/multiplexer 719 and to board terminal J7-H which connects to the lamp driver for the Strike 2 - Player 1 display. OR gate 718 receives an input from the Q output of flip-flop 714; its other input is connected to the $\overline{Q}$ output from flip-flop 712. The output from OR gate 718 is connected to board terminal J7-K which connects to the Strike 1 -Player 2 lamp driver. Data selector/multiplexer 719 has its terminals connected as follows: pin 1 is connected to signal connection point JJ which provides the PLAYER 1 signal; pin 2 is connected to receive the output from the Q terminal of flip-flop 713; pin 11 is connected to receive the output from the Q terminal of flip-flop 714; pin 5 is connected to receive the output from the Q terminal of flip-flop 715; pin 14 is connected to receive the output from the Q terminal of flip-flop 711, which is also applied to board terminal J7-N which connects to the lamp driver for the Strike 2- Player 2 display; pin 3 is connected to receive the output from the Q terminal of flip-flop 707, which is also connected to board terminal J7-L, which is connected to the lamp driver for the Spare - Player 1 display; pin 6 is connected to the Q output from flip-flop 709; pin 10 is connected to the Q output from flip-flop 708; pin 13 is connected to the Q output from flip-flop 705, which is also connected to board terminal J7-H which connects to the lamp driver for the Strike 2 - Player 1 display. The outputs from data selector/multiplexer 719 are as follows: from pin 4 to an input terminal of NOR gate 788 of the extra ball and end of game circuit 294; pin 12 to the other input terminal of NOR gate 788; pin 7 to an input terminal of NAND gate 726 of the scoring pulse processing circuit 220; pin 9 to a second input of NAND gate 726, to an input to NOR gate 724, and to an input to NAND gate 730. Data selector/multiplexer 720 has inputs connected to its pins as follows: the PLAYER 1 signal from signal connection point JJ to pin 1; to pin 3 from Q output of flip-flop 710; to pin 6 from $\overline{Q}$ output of flip-flop 706; to pin 5 from $\overline{Q}$ output of flip-flop 712; and to pin 2 from Q output of flip-flop 716. The outputs from data selector/multiplexer 720 are a connection from pin 7 to NAND gate 794 of the extra ball and end of game circuit 294 and a connection from pin 4 to the input of inverter 721 of scoring pulse processing circuit 220.

Scoring pulse processing circuit 220 will select one of the scoring pulse lines 679-1, 679-2, or 679-3 for application to the scoreboard for a particular player. The output from inverter 721 provides one input to NOR gate 722, the other input to which is connected to signal connection point *x*, which provides the BALL 2 signal. Signal connection point *x* is also connected to the input of inverter 723, the output of which is connected to signal connection point YY and to an input to NAND gate 730. The output from NOR gate 722 provides an input to NOR gate 724, the other input to which receives an output from pin 9 of data selector/multiplexer 719. The output from NOR gate 724 is connected to an input to NOR gate 725, the other input to which is connected to signal connection point MM which provides the FRAME 11 OR 12 signal. NAND gate 726 has a third input connected to signal connection point *n*, which provides the BALL 1 signal. The output from NAND gate 726 provides an input to NOR gate 727 and to NAND gate 728. The other input to NOR gate 727 is connected to signal connection point MM, and its output is connected as an input to AND gate 732. The other input to NAND gate 728 is taken from the output of NOR gate 725 and provides an input to NAND gate 729. The other input to NAND gate 729 is taken from NAND gate 730. The inputs to NAND gate 730 are taken from pin 9 of data selector/multiplexer 719, inverter 723, pin 12 of selector/multiplexer 719, and from signal connection point WW which provide a FRAME 11 signal from frame number section 270. The output from NAND gate 729 provides inputs to AND gate 731 and NOR gate 734. The other input to AND gate 731 is the triple pulse line 679-3. The inputs to AND gate 732 are from NOR gate 727 and the single pulse line 679-1. The inputs to NOR gate 734 are from NOR gate 727 and NAND gate 729. The output from NOR gate 734 provides one input to NAND gate 735, the other input to which is provided by the double pulse line 679-2. The outputs from AND gates 731 and 732 provide inputs to NOR gate 733 which, in turn, provides one input to AND gate 736. The other input to AND gate 736 is taken from NAND gate 735. The output from AND gate 736 provides inputs to NOR gates 737 and 738. The other input to NOR gate 737 is from signal connection point KK, providing the PLAYER 2 signal. The other input to NOR gate 738 is from signal connection point JJ, providing the PLAYER 1 signal. The output from NOR gate 737 provides scoring pulses for Player 1 to board terminal J7-R, while the output from NOR gate 738 provides scoring pulses for Player 2 to board terminal J7-S.

Figure 40:
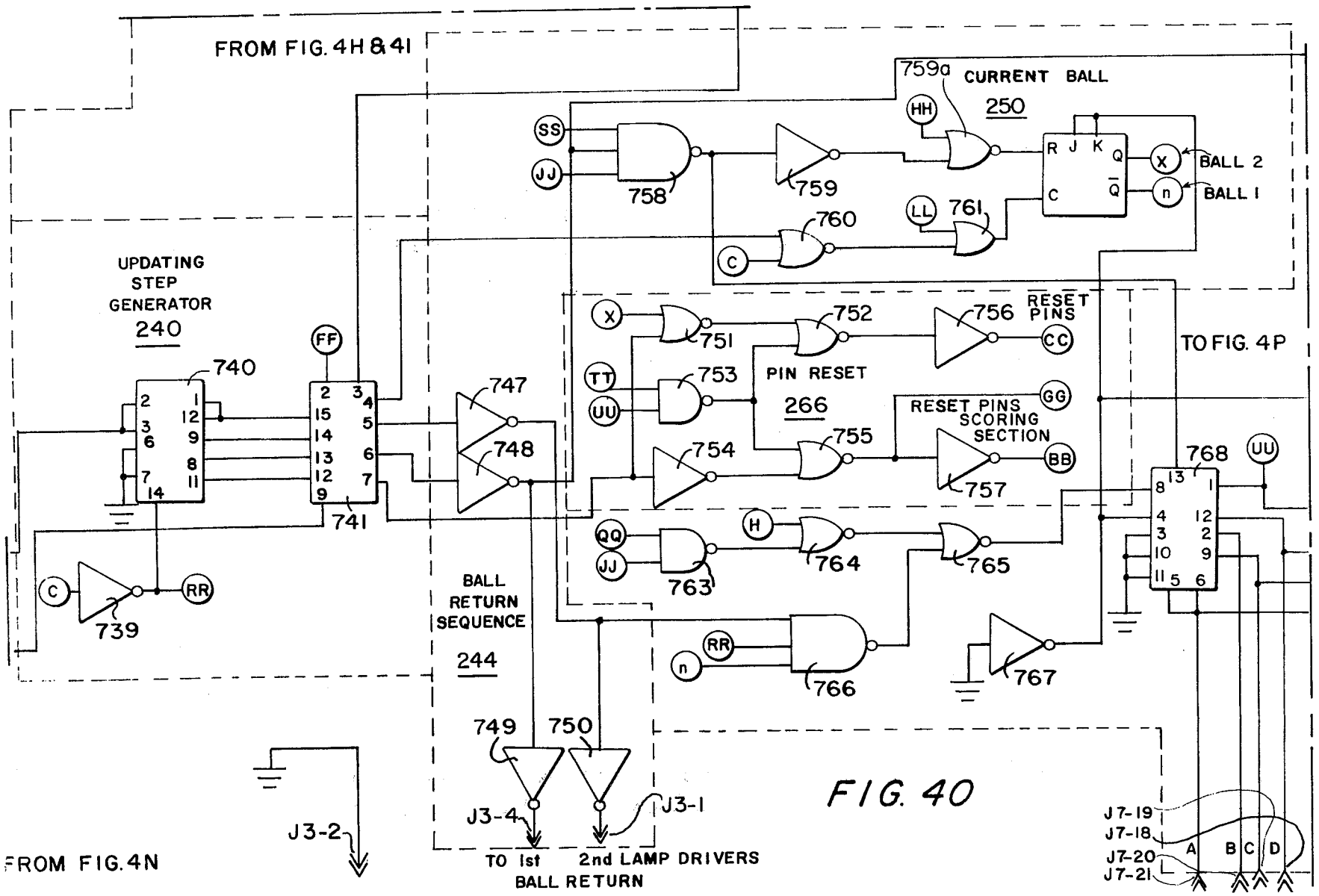
Figure 4P:
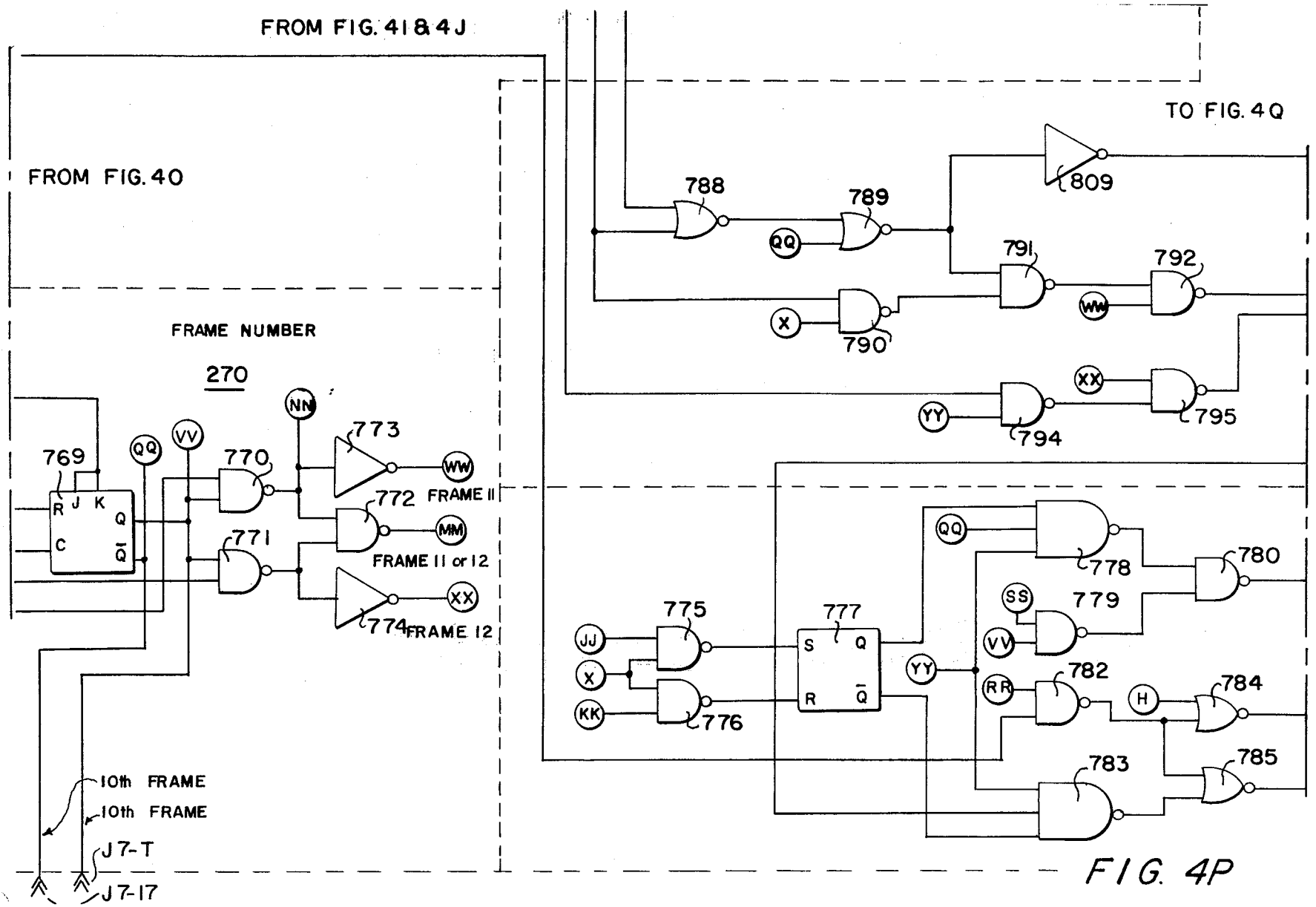
Figure 4Q:
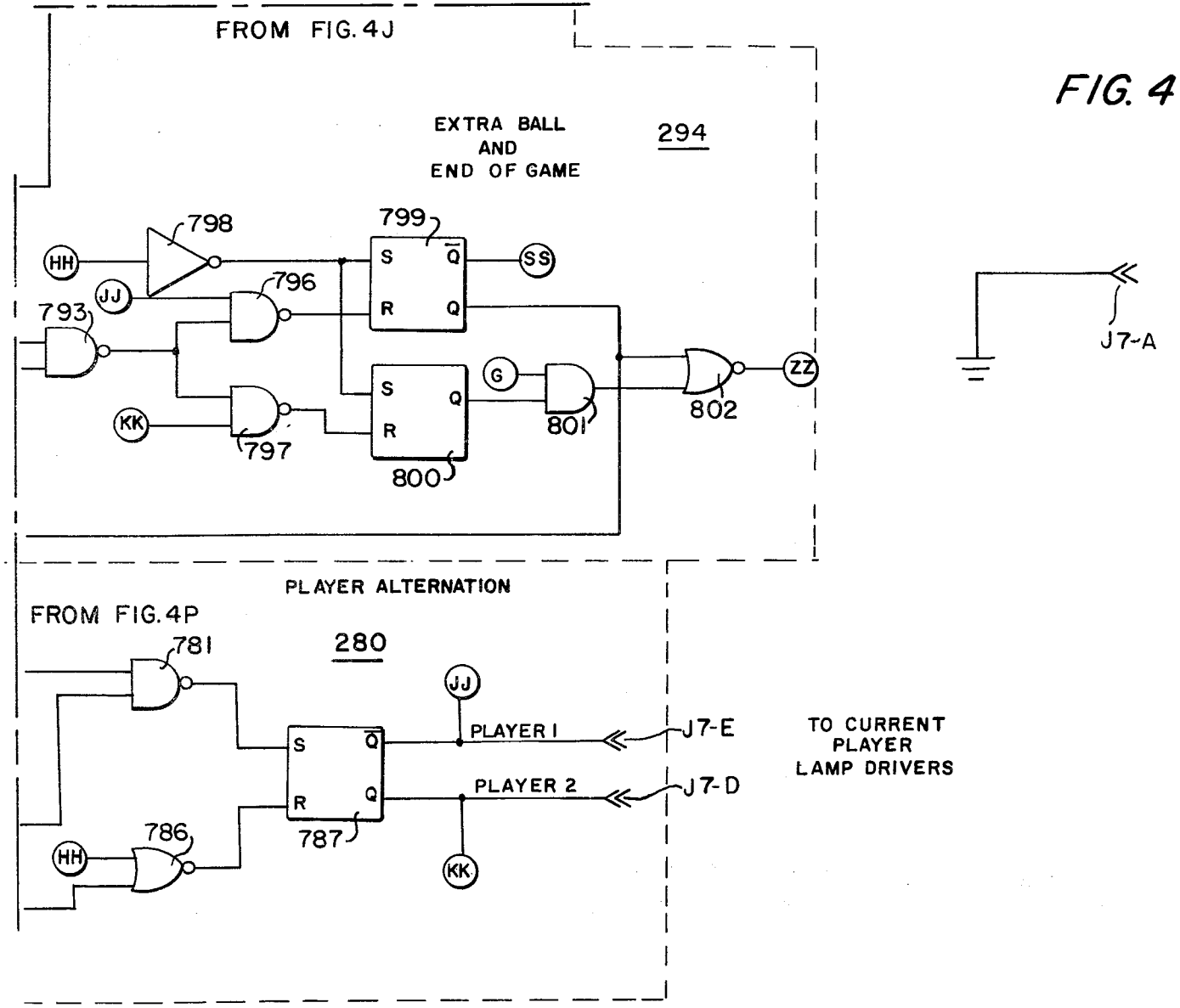

Updating step generator 240 (FIG. 40) includes an inverter 739 which is connected to signal connection point C, providing DISPLAY CLOCK signals. The output from inverter 739 is connected to signal connection point RR providing $\overline{\text{DISPLAY CLOCK}}$ signals thereto. A type 7490 decade counter 740 receives $\overline{\text{DISPLAY CLOCK}}$ signals from inverter 739 on pin 14. As previously explained, an ENABLE signal is received on pins 2 and 3 from flip-flop 671 of execution counter 190. The four parallel output leads from decade counter 740 provide a binary input signal to a BCD-to-decimal decoder 741 (Type 7442) which provides decimal output signals representing the steps of the updating step program. Pin 2 provides a signal to signal connection point FF representing the first step of the updating step program. Pin 3 is connected to an inverter 745 in the strike/spare shift enable circuit 260. Pin 4 is connected to an input of NOR gate 760 in the current ball logic circuit 250. Pin 5 is connected to an inverter 747 and pin 6 is connected to an inverter 748 in the ball return sequence circuit 244. Pin 7 is connected to an inverter 754 and to a NOR gate 751 in the pin reset logic circuit 266.

Strike/spare shift enable circuit 260 includes a NOR gate 742. One input is connected to the signal connection point H, providing a 1 PLAYER signal, and the other input is connected to signal connection point KK, providing a PLAYER 2 signal. The output from NOR gate 742 is connected as an input to NOR gate 743, the other input to which is received from NAND gate 744. The three inputs to NAND gate 744 are provided from signal connection point QQ providing the $\overline{\text{TENTH FRAME}}$ signal, to signal connection point *x* providing the BALL 2 signal, and to signal connection point JJ providing the PLAYER 1 signal. The output from NOR gate 743 is connected to NAND gate 746, the other input to which is connected to the output from inverter 745. The output from NAND gate 746 is connected to signal connection point PP providing the STRIKE/SPARE SHIFT ENABLE signal.

Ball return sequence 244 includes a pair of inverters 747 and 748 connected to pin 5 and pin 6 of BCD-to-decimal decoder 741 of updating step generator 240. The output from inverter 748 provides an input to inverter 745 of strike/spare shift enable circuit 260 and to inverter buffer 749, the output from which is connected through board terminal J3-4 through line 365 to drive ball return indicator lamp 362, the other end of which is connected to +12 volt terminal 367 of the ball return display 360 as shown in FIG. 5. Inverter 747 is connected through inverter buffer 750 to board terminal J3-1 and thus to line 364 and lamp 361 of the ball return sequence, the other end of which is also connected to terminal 367, as shown in FIG. 5. As previously explained, lamp 363 is energized in response to a signal from signal connection point *f* applied through board terminal J2-8. This completes a circuit through line 366 to the +12 volt terminal 367. By these means, lamps 361, 362 and 363 are energized in sequence.

Pin reset logic circuit 266 includes a NOR gate 751 connected to one input of NOR gate 752. The inputs to NOR gate 751 are from signal connection point *x*, providing the BALL 2 signal, and from pin 7 of decoder 741 of updating step generator 240. A NAND gate 753 has inputs connected to signal connection points TT and UU which provide a POWER ON signal and a frame number bit signal from frame number logic 270. The output from NAND gate 753 provides the other input to NOR gate 752. Inverter 754 is also connected to pin 7 of decoder 741 and provides one input to NOR gate 755, the other input to which is taken from NAND gate 753. The output from NOR gate 755 provides the $\overline{\text{RESET PINS}}$ signal to signal connection point GG and through inverter 757 the RESET PINS signal to signal connection point BB for use in the scoring section. The output from NOR gate 752 is connected through inverter 756 to signal connection point CC providing the RESET PINS signal for the flip-flops of pin status register 170.

Current ball logic circuit 250 includes NAND gate 758, one input to which is taken from inverter 748. A second input is connected to signal connection point SS providing an EXTRA BALL signal from extra ball and end of game logic circuit 294. The third input to NAND gate 758 is taken from signal connection point JJ, providing the PLAYER 1 signal. The output from NAND gate 758 is connected through inverter 759 to an input to NOR gate **759*a*, the other input to which is taken from signal connection point HH providing a CASH CREDIT signal. The output from NOR gate 759a is connected to the R input to master-slave flip-flop 762. A NOR gate 760 receives the signal from pin 4 of decoder 741 of update step generator 240. The other input to NOR gate 760 is taken from signal connection point C, providing the DISPLAY CLOCK signal. The output from NOR gate 760 provides one input to OR gate 761, the other input to which is taken from signal connection point LL, providing the STRIKE signal. The output from OR gate 761 is connected to the C input of master-slave flip-flop 762. The Q output from master-slave flip-flop 762** is connected to signal connection point *x*, providing the BALL 2 signa, while the $\overline{Q}$ output terminal is connected to signal connection point *n*, providing the BALL 1 signal. The J and K terminals of master-slave flip-flop 762 are connected together and to the output terminal of an inverter 767, the input of which is grounded. It will be noted, also, that the output from NAND gate 758 is connected as and enabling signal to pin 13 of presetable decade counter 768 (Type 74176) of frame number logic circuit 270.

Turning now to frame number logic circuit 270, it will be seen that a NAND gate 763 receives inputs from signal connection point QQ and signal connection point JJ, providing, respectively, a $\overline{\text{TENTH FRAME}}$ signal and a PLAYER 1 signal. The output from NAND gate 763 provides one input to NOR gate 764, the other input to which is taken from signal connection point H, providing the 1 PLAYER signal. The output from NOR gate 764 provides one input to NOR gate 765, the other input to which is taken from the output of NAND gate 766. The inputs to NAND gate 766 are taken from inverter 748, from signal connection point RR, providing the $\overline{\text{DISPLAY CLOCK}}$ signal, and from signal connection point *n*, providing the BALL 1 signal. The output from NOR gate 765 is connected to pin 8 of decade counter 768, initiating the count. It will be observed that pin 13 receives the output from NAND gate 758 and that pin 4 is connected to the output side of inverter 767, the input of which is grounded. The binary output from decade counter 768 is provided from pins 1, 12, 2, 9, and 6. Pin 1 is connected to signal connection point UU, providing a frame number bit. Pin 1 is also connected to the R input to master-slave flip-flop 769. Pin 12 of decade counter 768 is connected to the C input to master-slave flip-flop 769 and to board terminal J7-18. Pin 2 is connected to board terminal J7-20. Pin 9 is connected to board terminal J7-19. Pins 5 and 6 are connected to board terminal J7-21. The J and K terminals of master-slave flip-flop 769 are connected to the output of inverter 767 and to the J and K terminals of master-slave flip-flop 762. The Q output from master-slave flip-flop 769 is connected to signal connection point VV providing a TENTH FRAME signal. As previously explained, the $\overline{Q}$ output from master-slave flip-flop 769 is connected to signal connection point QQ, providing a $\overline{\text{TENTH FRAME}}$ signal. These signals are also respectively connected to the J7-T and J7-17 board terminals. NAND gate 770 receives one input from pins 5 and 6 of decade counter 768 and a second input from the Q output from flip-flop 769. The inputs to NAND gate 771 are taken from the same Q output terminal from flip-flop 769 and from pin 9 of decade counter 768. NAND gate 772 receives the outputs from NAND gates 770 and 771 and has its output connected to signal connection point MM providing the FRAME 11 OR 12 signal. The output from NAND gate 770 is connected to signal connection point NN providing a $\overline{\text{FRAME 11}}$ signal and through inverter 773 to signal connection point WW, providing a FRAME 11 signal. The output from NAND gate 771 is connected through inverter 774 to provide a FRAME 12 signal to signal connection point XX.

Player alternation logic 280 includes a pair of NAND gates 775 and 776, one input of each being connected to signal connection point *x* providing the BALL 2 signal. The other input terminal to NAND gate 775 is connected to signal connection point JJ, and the other input to NAND gate 776 is connected to signal connection point KK. NAND gate 775 is connected to the S input to flip-flop 777, and the output from NAND gate 776 is connected to the R input thereof. The Q output from flip-flop 777 is connected as an input to NAND gate 778, and the $\overline{Q}$ output is connected as an input to NAND gate 783. The other inputs to NAND gate 778 are taken from signal connection points QQ and YY. Inputs to NAND gate 779 are from signal connection points SS and VV. A NAND gate 780 receives inputs from NAND gates 778 and 779 and provides an output to NAND gate 781. The other inputs to NAND gate 783 are taken from signal connection point YY and from extra ball and end of game logic circuit 294. A NAND gate 782 receives one input from inverter 748 in ball return sequence logic 244 and a second input from signal connection point RR. The output from NAND gate 782 provides an input to NOR gate 784, the other input to which is taken from signal connection point H. The output from NOR gate 784 provides the other input to NAND gate 781. A NOR gate 785 receives an input from NAND gate 782 and from NAND gate 783, providing an input to NOR gate 786, the other input to which is taken from signal connection point HH. The output from NAND gate 781 is connected to the S input of flip-flop 787, while the output from NOR gate 786 is connected to the R input thereof. The $\overline{Q}$ output from flip-flop 787 is connected to signal connection point JJ, providing the PLAYER 1 signal and to board terminal J7-E. The Q output from flip-flop 787 is connected to signal connection point KK providing the PLAYER 2 signal thereto and also to board terminal J7-D. These board terminals connect to the current player lamp drivers on the scoring display panel.

Extra ball and end of game logic 294 includes a NOR gate 788, having a pair of inputs connected to pins 9 and 7 of multiplexer 719. A NOR gate 789 receives the output from NOR gate 788 and, on its other input, is connected to signal connection point QQ. NAND gate 790 has inputs connected to signal connection point *x* and to pin 4 of multiplexer 719. A NAND gate 791 receives inputs from NOR gate 789 and NAND gate 790 and provides an input to NAND gate 792, the other input to which is taken from signal connection point WW. The output from NAND gate 792 provides an input to NAND gate 793, the other input to which is taken from NAND gate 795. NAND gate 795 receives an input from signal connection point XX and from NAND gate 794. NAND gate 794 receives an input from signal connection point YY and from pin 7 of multiplexer 720. The output from NAND gate 793 provides inputs to NAND gates 796 and 797. The other input to NAND gate 796 is from signal connection point JJ, and the output is connected to the R input of flip-flop 799. The other input to NAND gate 797 is taken from signal connection point KK, and its output is connected to input terminal R of flip-flop 800. An inverter 798 is connected to signal connection point HH and to the S inputs to flip-flops 799 and 800. The $\overline{Q}$ output from flip-flop 799 is connected to signal connection point SS providing the EXTRA BALL signal. The Q output from flip-flop 799 is connected to an input of NOR gate 802. The Q output from flip-flop 800 is provided as an input to AND gate 801, the other input to which is taken from signal connection point G. The output from NOR gate 802 is connected signal connection point ZZ providing the END OF GAME signal. Inverter 803 receives the output from NOR gate 789 and through inverter 804 connects to signal junction 807. A +5 volt bias terminal 805 is connected through a 330 ohm resistor 806 to junction point 807, and a 0.01 microfarad capacitor 808 is connected between junction point 807 and ground. A 330 ohm resistor 809 connects the junction point to the base electrode of transistor 810 (Type 2N5128), the emitter of which is grounded and the collector of which is connected to board terminal J7-P to activate the "Extra Ball" display lamp. Inverter 811 is connected to signal connection point B which provides an END OF GAME signal from end of game logic 433. The output from inverter 811 is connected to junction point 814 which is connected through a 330 ohm resistor 813 to +5 volt bias terminal 812 and to ground through a 0.01 microfarad capacitor 815. The junction point is coupled through a 330 ohm resistor 816 to the base electrode of transistor 817 (Type 2N5128), the emitter of which is grounded and the collector of which is connected through board terminal J7-23 to the "Game Over" display.

In Table II, which follows immediately hereinafter, the aforementioned signal connection points are identified with respect to the signals and the source of the signals found thereon.

TABLE II

SIGNAL CONNECTION POINT CHART

| Symbol | Signal and/or | Source |
|---|---|---|
| A | BALL RELEASE | Ball Release Logic 104 |
| B | END OF GAME | End of Game 433 |
| C | DISPLAY CLOCK | Clock 112 |
| D | SCORING CLOCK | Clock 112 |
| E | DISPLAY CLOCK | Clock 112 |
| F | PIN FALL ENABLE | Pin Fall Enable 444 |
| G | TWO PLAYERS | Cash Credit 410 |
| H | ONE PLAYER | Cash Credit 410 |
| J | ROLL PROGRAM STEP 8 | Roll Program Generator 110 |
| K | ROLL PROGRAM STEPS 6, 7 and 8 | Roll Program Generator 110 |
| L | ROLL PROGRAM STEPS 7 and 8 | Roll Program Generator 110 |
| M | ROLL PROGRAM STEP 6 | Roll Program Generator 110 |
| N | Ball Direction Bit | Ball Direction Register 124 |
| P | Ball Direction Bit | Ball Direction Register 124 |
| Q | ROLL PROGRAM STEP 6 | Roll Program Generator 110 |
| R | SPIN FACTOR | Spin Factor Register 136 |
| S | SPIN FACTOR | Spin Factor Register 136 |
| T | CLEAR | Ball Release Logic 104 |
| U | Initial Ball Position Bit | Ball Position Register 116 |
| V | Initial Ball Position Bit | Ball Position Register 116 |
| W | Initial Ball Position Bit | Ball Position Register 116 |
| X | Initial Ball Position Bit | Ball Position Register 116 |
| Y | COLUMN 7 | Horizontal Decoder 146 |
| Z | COLUMN 6 | Horizontal Decoder 146 |
| a | COLUMN 5 | Horizontal Decoder 146 |
| b | COLUMN 4 | Horizontal Decoder 146 |
| c | COLUMN 3 | Horizontal Decoder 146 |
| d | COLUMN 2 | Horizontal Decoder 146 |
| e | COLUMN 1 | Horizontal Decoder 146 |
| f | BALL RELEASE | Ball Release Logic 104 |
| g | Random Number Bit | Random Number Generator 130 |
| h | Random Number Bit | Random Number Generator 130 |
| j | Random Number Bit | Random Number Generator 130 |
| k | Random Number Bit | Random Number Generator 130 |
| l | Random Number Bit | Random Number Generator 130 |
| m | Random Number Bit | Random Number Generator 130 |
| n | BALL 1 | Current Ball Logic 250 |
| p | Pin Status Bit | Pin Status Store 197 |
| q | Pin Status Bit | Pin Status Store 197 |
| r | COLUMN 3 | Pin Fall Logic 160 |
| s | Randomizing Bit | Randomizing for Pin Fall 164 |
| t | Randomizing Bit | Randomizing for Pin Fall 164 |
| u | Randomizing Bit | Randomizing for Pin Fall 164 |
| v | Randomizing Bit | Randomizing for Pin Fall 164 |
| w | related to COLUMN 4 | Pin Fall Logic 160 |
| x | BALL 2 | Current Ball Logic 250 |
| y | COLUMN 2 | Pin Fall Logic 160 |
| z | Randomizing Bit | Randomizing for Pin Fall 164 |
| AA | COLUMN 6 | Pin Fall Logic 160 |
| BB | RESET PINS | Pin Reset 266 |
| CC | RESET PINS | Pin Reset 266 |
| DD | ROLL PROGRAM STEP 9 | Roll Program Generator 110 |
| EE | SCORING CLOCK | Clock 112 |
| FF | UPDATE STEP | Updating Step Generator 240 |
| GG | RESET PINS | Pin Reset 266 |
| HH | CASH CREDIT | Cash Credit 410 |
| JJ | PLAYER 1 | Player Alternation 280 |
| KK | PLAYER 2 | Player Alternation 280 |
| LL | STRIKE | Strike or Spare Test 200 |
| MM | FRAME 11 OR 12 | Frame Number Logic 270 |
| NN | FRAME 11 | Frame Number Logic 270 |
| PP | STRIKE/SPARE SHIFT ENABLE | Strike/Spare Shift Enable 260 |
| QQ | TENTH FRAME | Frame Number Logic 270 |

TABLE II-continued

| Symbol | Signal | SIGNAL CONNECTION POINT CHART and/or Source |
|---|---|---|
| RR | DISPLAY CLOCK | Updating Step Generator 240 |
| SS | EXTRA BALL | Extra Ball and End of Game 294 |
| TT | POWER ON | Power Section 400 |
| UU | Frame Number Bit | Frame Number Logic 270 |
| VV | TENTH FRAME | Frame Number Logic 270 |
| WW | FRAME 11 | Frame Number Logic 270 |
| XX | FRAME 12 | Frame Number Logic 270 |
| YY | BALL 2 | Scoring Pulse Processing 220 |
| ZZ | END OF GAME | Extra Ball and End of Game 294 |

Before leaving consideration of the main circuit board, it would be well to note a number of additional board terminal connections to peripheral boards. Board terminal J7-C connects signal connection point HH to the scoring panel. Board terminal J7-F connects signal connection point RR to the animation section of the scoring panel. Board terminal J7-Q provides a ground signal to the animation section of the scoring panel. Board terminal J3-2 provides reference potential to the alley display board of FIG. 5.

Figure 6A:
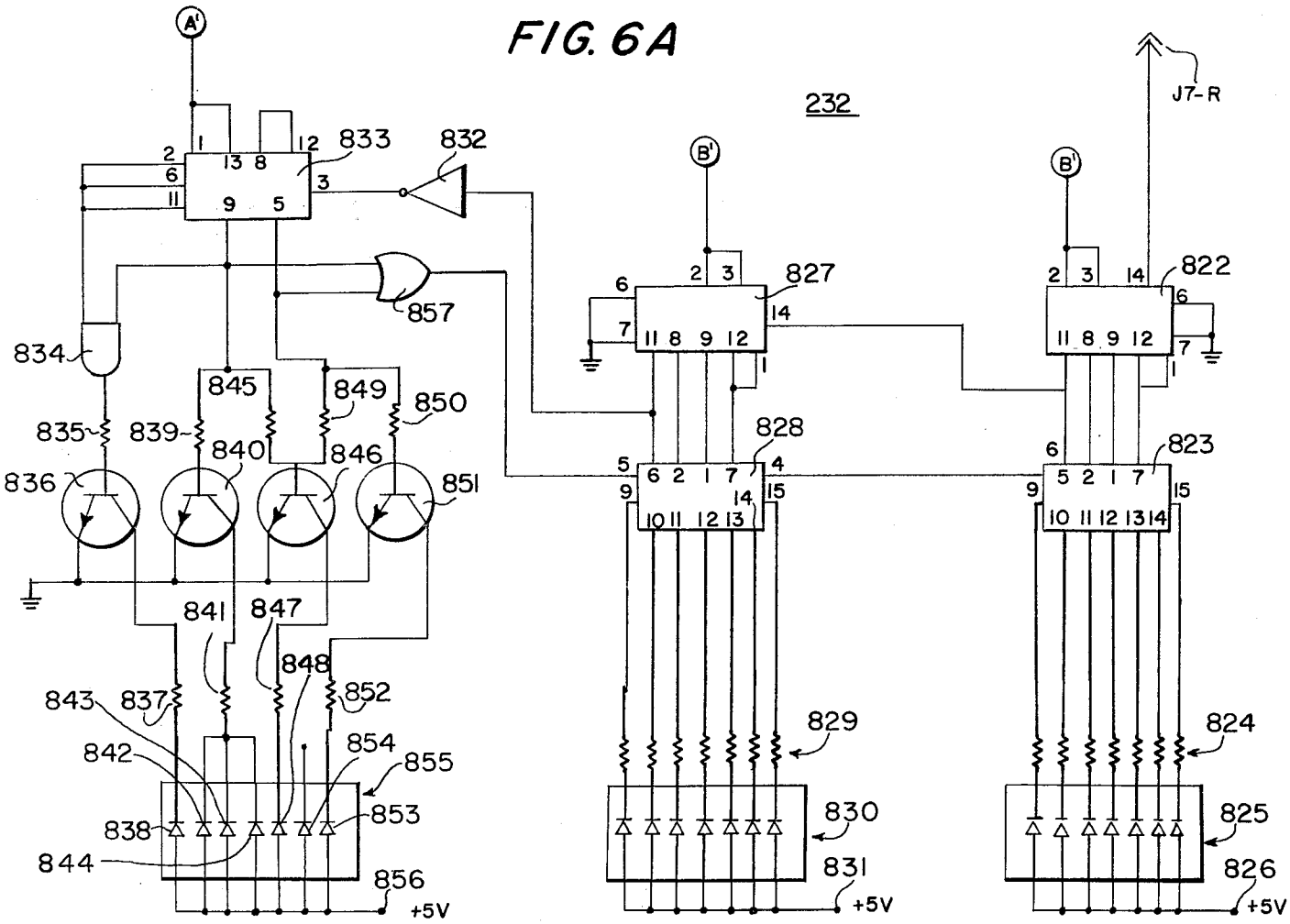
FIG. 6A is a schematic circuit diagram of part of the scoring logic panel of the game of FIG. 1.

The scoring display panel is shown in FIGS. 6A, 6B, 6C and 6D. Referring first to FIG. 6C, it will be noted that board terminal J7-C, which connects to the corresponding terminal on the main circuit board, provides an input to an inverter 820, the output from which is connected to signal connection point A′ and to an inverter 821, the output from which is connected to signal connection point B′. It is to be understood that the signal connection points mentioned in connection with the scoring display board refer to connections points on the scoring display board itself and have no relation to the connection points on the main logic board.

Referring to FIG. 6A, one portion of the scoring display is shown. The signal from board terminal J7-R receives the scoring pulses for Player 1 from the main circuit board and applies them to a Type 7490 decade counter 822. A reset input is provided from signal connection point B′. The four output leads from decade counter 822 are applied in parallel to decoder/driver 823 (Type 7447) which converts the binary coded decimal input from decade counter 822 to a seven-segment output for driving the seven light emitting diodes forming the units portion of the scoring display. Thus, the seven output leads from decoder/driver 823 are connected through 150 ohm resistors 824 to seven light emitting diodes 825 forming a numeric display. The opposite end of the light emitting diodes are connected to a +5 volt bias terminal 826. It is to be understood that the decoder/driver provides 15-volt outputs to the resistors 824 establishing conditions for light emission by a selected light emitting diode 825. A carry is taken from pin 11 of decade counter 822 to pin 14 of a tens decade counter 827. Decade counter 827 also receives a RESET signal from signal connection point B′ on pins 2 and 3. The four output lines from decade counter 827 provide a binary coded decimal input to a decoder/driver 828. Pin 4 of decoder/driver 828 is connected to pin 5 of decoder/driver 823. Decoder/driver 828 converts the binary decimal coded input to seven output signals which are applied through 150 ohm resistors 829 to seven light emitting diodes 830, the other ends of which are connected to a +5 volt bias terminal 831. Decoder/driver 828 provides +15 volts to a selected resistor for driving a selected light emitting diode. The signal on pin 11 of decade counter 827 is applied through inverter 832 to the pin 3 input to dual flip-flop 833. Flip-flip 833 receives a RESET signal from signal connection point A′ on pins 1 and 13 and provides one input to AND gate 834 from pins 2, 6 and 11. Pin 9 provides the other input of AND gate 834, the output from which is applied through a 1,000 ohm resistor 835 to the base electrode of a grounded emitter transistor 836. The collector electrode is connected through a 150 ohm resistor 837 to a light emitting diode 838. The output from pin 9 is applied through a 1,000 ohm resistor 839 to the base electrode of a grounded emitter transistor 840, the collector of which is connected through a 50 ohm resistor 841 to three light emitting diodes 842, 843 and 844 in parallel. Pin 9 of flip-flop 833 is also connected through a 1,000ohm resistor 845 to the base electrode of a grounded emitter transistor 846, the collector of which is connected through a 150 ohm resistor 847 to a light emitting diode 848. Pin 5 of flip-flop 833 is also connected to the base electrode of transistor 846 through a 150 ohm resistor 849. Pin 5 of flip-flop 833 is also connected through a 150 ohm resistor 850 to the base input terminal of grounded emitter transistor 851, the collector of which is connected through a 150 ohm resistor 852 to a light emitting diode 853. It is to be noted that one of the light emitting diodes 854 of the hundreds set of seven light emitting diodes 855 is not used and remains with one terminal unconnected. The opposite terminal of all of the light emitting diodes of set 855 is connected to a +5 volt bias terminal 856. It is to be understood that transistors 836, 840 846 and 851 are all Type 2N5128 transistors. OR gate 857 receives inputs from pins 5 and 9 of flip-flop 833 and has its output connected to pin 5 of decoder/driver 828. This completes the description of the scoring counters and display for Player 1.

Figure 6B:
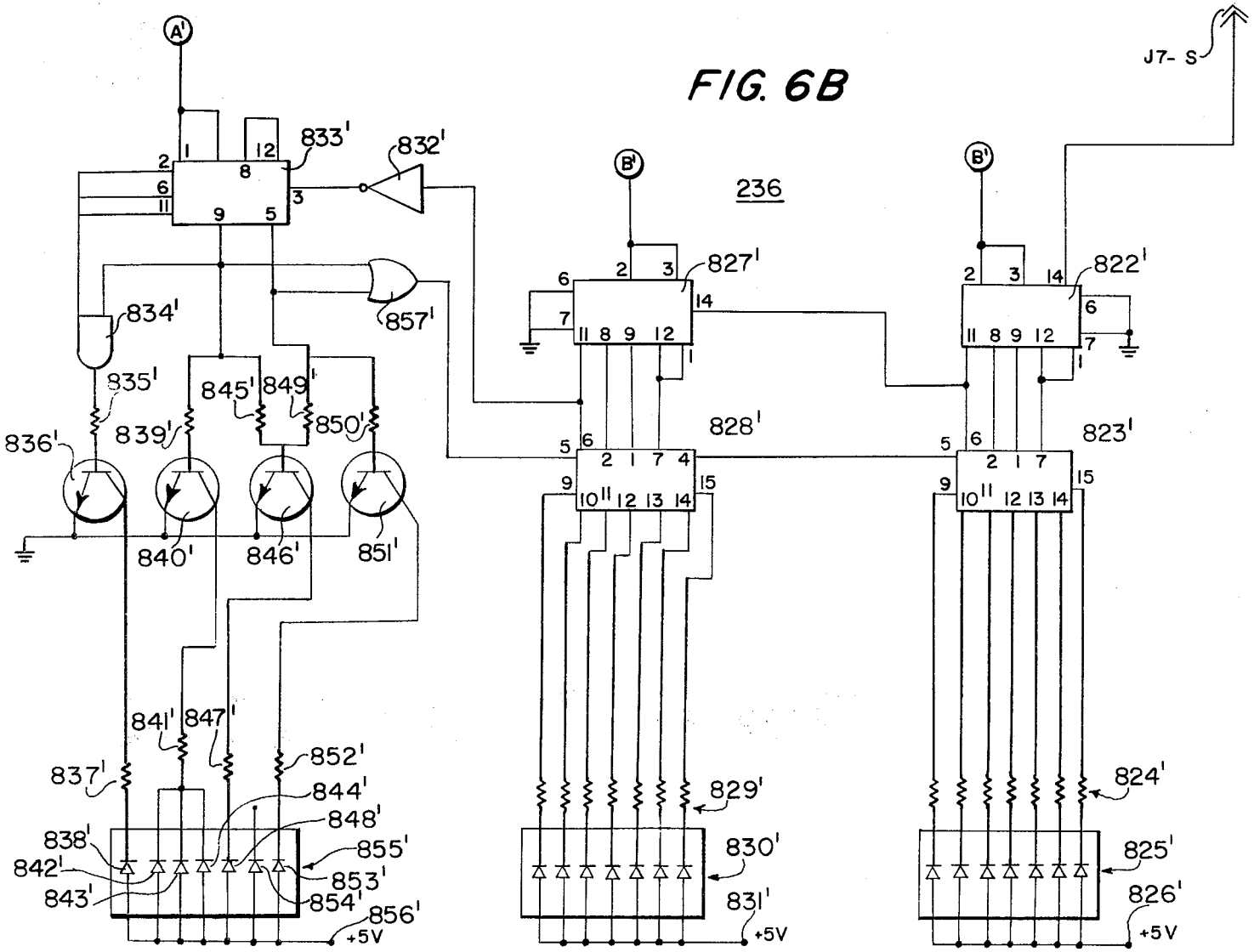
FIG. 6B is a schematic circuit diagram of part of the scoring logic panel of the game of FIG. 1.

The scoring display for Player 2 is shown in FIG. 6B. Board terminal J7-S receives scoring pulses for Player 2 from the main circuit board. Since the circuit shown in FIG. 6B is otherwise identical to the circuit shown in FIG. 6A, it will not be further described except to note that the reference numerals used in FIG. 6B follow the same reference numbering system employed in FIG. 6A, except that all of the reference numerals in FIG. 6B are primed.

Turning to FIG. 6C, the strike and spare display 860 includes six inverter buffers 861, 862, 863, 864, 865 and 866 connected, respectively, to board terminals J7-L, J7-J, J7-H, J7-M, J7-K and J7-N. These inverter buffers respectively drive display lamps 867, 868, 869, 870, 871 and 872, the other ends of which are connected to a +12 volt bias terminal 873. These lamps, when energized, illuminate squares **47, 47*a* and 47*b*, for Player 1, and squares 48, 48*a* and 48*b*, for Player 2, on panel 40 of FIG. 1. These squares, when illuminated, signify for Player 1, a spare, the first strike ball, and the second strike ball, and for Player 2, a spare, a first strike ball, and a second strike ball. It is to be understood that the board connection terminal to strike and spare display section 860** are connected to corresponding terminals on the main circuit board.

Animation display 159 on the scoring display panel includes a decade counter 880 (Type 7490) which receives inputs from board terminals J7-F and J7-Z. Referring to the main circuit board, it will be noted that J7-Z is connected to a point of reference potential on the main circuit board, while J7-F is connected to signal connection point RR, which provides a $\overline{\text{DISPLAY CLOCK}}$ signal. The four output leads from decade counter 880 provide an input to a binary coded decimal-to-decimal decoder/driver (Type 7445) 881. Decoder 881 provides six output leads to 1,000 ohm resistors 882, 883, 884, 885, 886 and 887 which provide inputs, respectively, to transistors 888, 889, 890, 891, 892 and 893. All of these transistors are Type 2N5139 transistors. The emitters of the transistors are connected to a +12 volt bias terminal 894. Base to emitter resistors 895, 896, 897, 898, 899 and 900 have a 10,000 ohm value. Collector resistors 901, 902, 903, 904, 905 and 906 are 220 ohm resistors. Lamp sets 907, 908, 909, 910, 911 and 912 each contain three 12-volt, 40 ma. lamps in parallel, and are connected, respectively, from the collectors of the transistors to ground. The lamp sets are actuated in sequence in synchronism with display clock pulses provided from board terminal J7-F. Each set of lamps is associated with one of the six figures of animation display 42 (see FIG. 1).

Figure 6D:
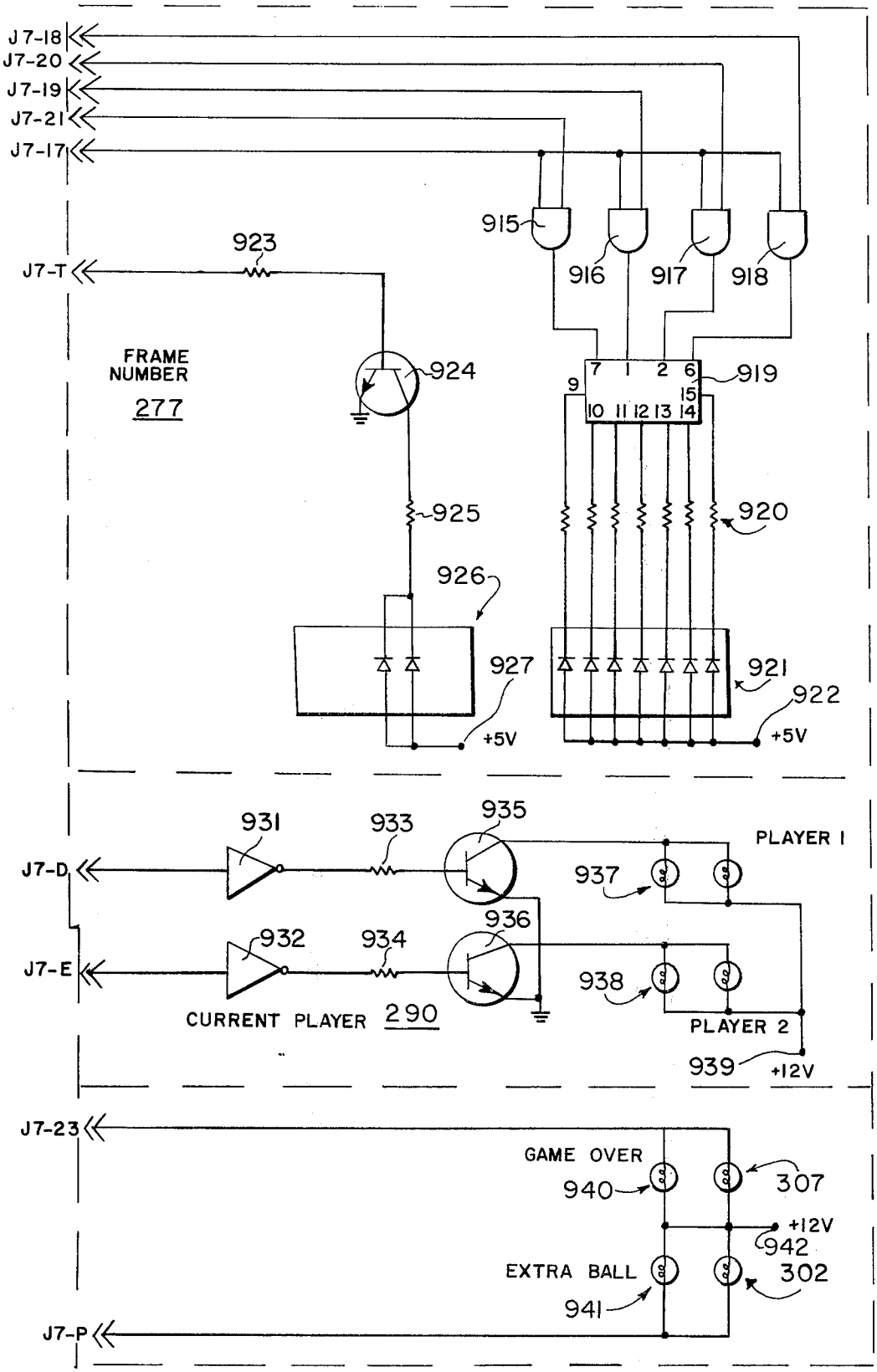
FIG. 6D is a schematic circuit diagram of part of the scoring logic panel of the game of FIG. 1.

Referring to FIG. 6D, it will be noted that frame number display 277 receives signals from board terminals J7-18, J7-20, J7-19, J7-21, J7-17 and J7-T. AND gates 915, 916, 917 and 918 each have one input connected to board terminal J7-17 and another input connected, respectively, to board terminals J7-21, J7-19, J7-20 and J7-18. The outputs from AND gates 915, 916, 917 and 918 provide four inputs to binary coded decimal-to-seven segment decoder/driver (Type 7447) 919. The seven outputs from decoder 919 are applied through a set of 150 ohm resistors 920 to a set of seven light emitting diodes 921, the opposite ends of which are connected to a +5volt bias terminal 922. This display provides the units digit of the frame number as it appears in area 44 of the game as shown in FIG. 1. The display for the tens digit receives a signal from board terminal J7-T through a 1,000 ohm resistor 923 to the base electrode of transistor 924 (Type 2N5128), the emitter of which is grounded. The collector electrode is connected through a 68 ohm resistor 925 to a set 926 of two light emitting diodes in parallel. The other ends of the light emitting diodes are connected to a +5 volt bias terminal 927. The set of light emitting diodes 926 form the tens portion of the display in area 44 of the game as shown in FIG. 1.

The current player display 290 receives signals from board terminals J7-D and J7-E to inverters 931 and 932. The outputs from these inverters are applied through 1,000 ohm resistors 933 and 934 to the base electrodes of transistors 935 and 936 (Type 2N5128), which are in the grounded emitter configuration. The collector electrodes of transistors 935 and 936 are connected, respectively, to a set of lamps 937 for the Player 1 display and 938 for the Player 2 display. The other ends of these lamp sets, which include two lamps connected in parallel of 12 volt, 40 ma. rating, are connected to a +12 volt bias terminal 939. The lamp sets 937 and 938 may be provided in the areas of the scoring display board 40 directly above squares 45 and 46.

The "Game Over" display 307 receives an input from board terminal J7-23 through a set of lamps 940 to a +12 volt bias terminal 942. Lamp set 940 consists of two lamps in parallel.

"Extra Ball" display 302 receives a signal from board terminal J7-P through a set of lamps 941 to bias terminal 942. Lamp set 941 consists of two lamps connected in parallel. The game over and extra ball lamps may be positioned in areas 37 and 38 of the alley display board or on back panel 40.

Figure 7:
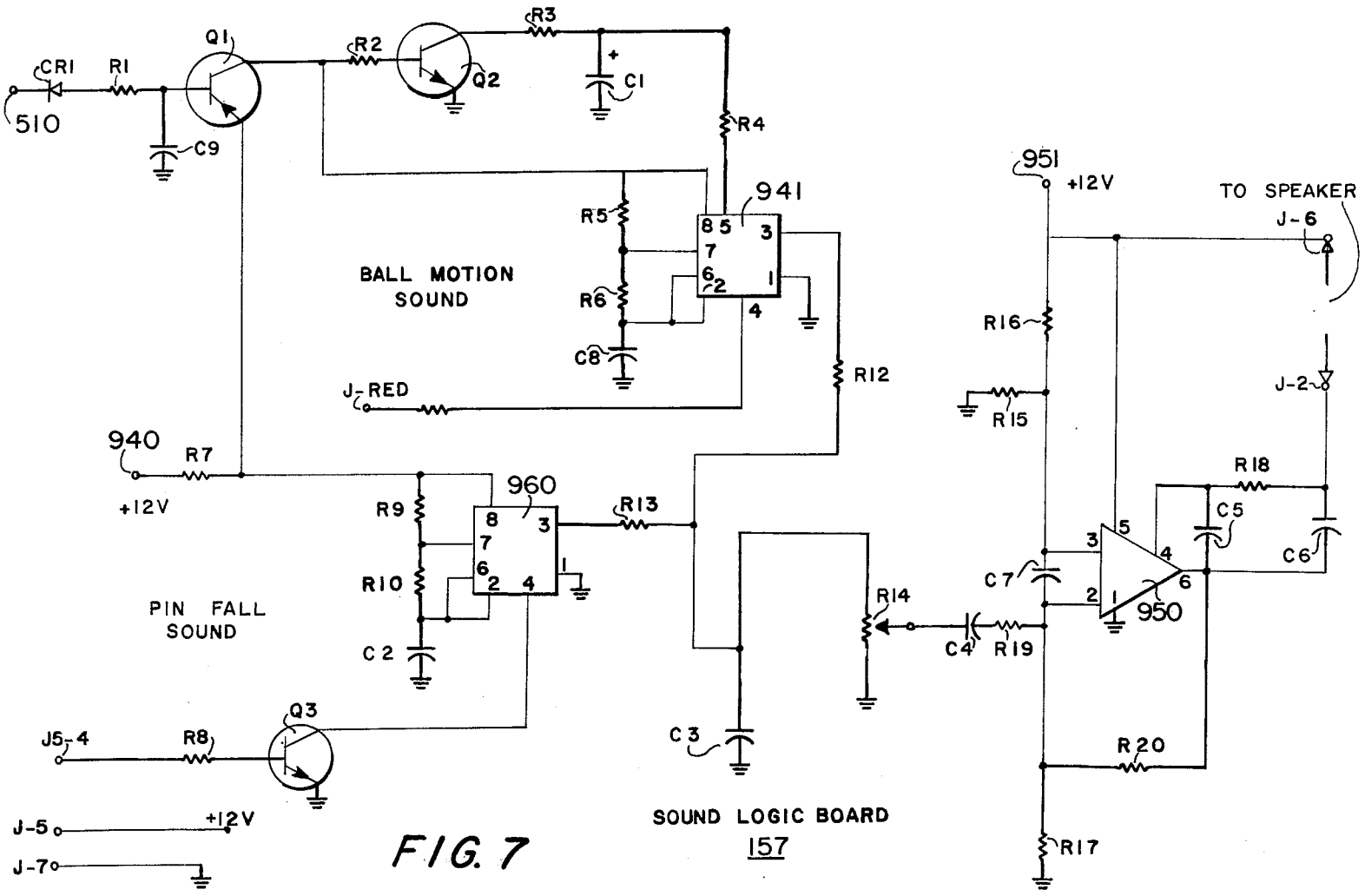
FIG. 7 is a schematic circuit diagram of the sound circuit board of the game of FIG. 1.

Turning to FIG. 7, it will be seen that the sound logic board, which is mounted in cabinet 12, receives a ball sound trigger signal on board terminal 510 through a semiconductor rectifier CR1 (Type 1N914 or 1N4148) and resistor R1, having a value of 3,300 ohms, to the base electrode of transistor Q1 (Type 2N5139). A 0.01 microfarad capacitor C9 is connected between the base electrode of transistor Q1 and ground. The emitter electrode is connected through a 1,000 ohm resistor R7 to 12 volt bias terminal 940. The collector from transistor Q1 is connected through a 1,000 ohm resistor R2 to the base electrode of a transistor Q2 (Type 2N5128), the emitter of which is grounded. A 3,300 ohm resistor R3 connects the collector electrode of transistor Q2 to a 100 ohm resistor R4. The junction between these resistors is connected by a 100 microfarad capacitor C1 (25 volt rating) to ground. The other end of resistor R4 is connected to a clock circuit 941 (Type NE555). The input is to pin 5 of the clock. The collector of transistor Q1 is directly connected to pin 8 of clock circuit 941 and to a 470,000 ohm resistor R5 which is connected to a 100,000 ohm resistor R6. The junction between these resistors is connected to pin 7 of clock circuit 941. A 0.01 microfarad capacitor C8 is connected between the other end of resistor R6 and ground. The junction between capacitor C8 and resistor R6 is connected to pins 2 and 6 of the clock. Board terminal J-RED provides DISPLAY CLOCK signals to pin 4 of clock 941. An output is taken from pin 3 through a 100,000 ohm resistor R12 and applied across a 5 megohm potentiometer R14 which serves as a volume control. In shunt with potentiometer R14 is a 0.001 microfarad capacitor C3. The output from potentiometer R14 is applied through a 0.01 microfarad capacitor C4 and a 180,000 ohm resistor R19 to an input terminal of an amplifier stage 950. The amplifier stage may be a Type MFC6070 amplifier. A +12 volt bias terminal 951 provides bias to input pin 3 of amplifier 950, there being a 47 picofarad capacitor C7 connected between input pin 2 and pin 3 of amplifier 950. A 680,000 ohm resistor R16 is connected between bias terminal 951 and pin 3 of amplifier 950, and a 100,000 ohm resistor R15 is connected between pin 3 and ground. An additional bias from bias terminal 951 is applied directly to pin 5 or amplifier 950 and to speaker output terminal J-6. The output from pin 4 is applied through a 10,000 ohm resistor R18 to output terminal J-2 for the speaker. A pair of capacitors C5 (470 picofarads) and C6 (250 microfarads) are connected between opposite ends of resistor R18 and pin 6 of amplifier 950. A 1.5 megohm resistor R20 is connected between pin 6 and input pin 2. There is also a 560,000 ohm resistor R17 connected between input pin 2 and ground. When clock 941 is triggered by the receipt of an enabling signal from board terminal 510, a signal will be applied through amplifier 950 to the speaker connected to the output terminals to provide a sound at a time corresponding with the ball roll.

A "pin fall" sound is provided in conjunction with the pin fall upon the receipt of a signal on board terminal J5-4. This is applied through 1,000 ohm resistor R8 to the base electrode of transistor Q3 (Type 2N5128). The emitter of the transistor is grounded, and the collector is connected to pin 4 of a clock circuit 960. This clock is also a Type NE555 clock. Pin 8 is connected to bias resistor R7, and bias resistors R9 (47,000 ohms) and R10 (39,000 ohms) are connected in series with a 0.01 capacitor C2, one end of which is connected to ground. The junction betwen resistors R9 and R10 is connected to pin 7 of clock 960, and the junction between resistor R10 and capacitor C2 is connected to pins 6 and 2 of clock 960. An output is taken from pin 3 through a 47,000 ohm resistor R13 and applied across potentiometer R14. The remainder of the circuit is as was previously described. Thus, upon receipt of a triggering signal on board terminal J5-4, clock 960 will be triggered to generate a "pin fall" sound in the speaker connected across terminals J-6 and J-2. Sound logic board 157 also includes board terminals J-5 and J-7, which are respectively connected to a +12 volt bias terminal and ground.

Cabinet 12 may be approximately 21 inches wide by 24 inches deep and 62 inches high. Display panels 30 and 40 are preferably plastic panels. These plastic panels may be generally opaque, but are translucent of transparent in the position of the display lamps, such as the ball and pin display lamps and the figures of the animation display.

While a preferred embodiment of the invention has been shown and described, it will be readily apparent to those skilled in the art that changes and modifications can be made without departing from the principles and spirit of the invention, the scope of which is defined in the appended claims.

The invention claimed is:

1. A simulated bowling game, comprising:

means to provide a simulated ball and a simulated bowling alley having a starting line and a set of simulated bowling pins;

random signal means for generating random binary bits;

ball path selection means which comprises an initial ball position selector, ball position encoder means responsive to said initial ball position selector for providing an initial ball position signal, a ball direction selector, and ball direction encoder means responsive to said ball direction selector providing a ball direction signal; wherein said ball position encoder means includes means for generating a horizontal ball displacement signal in response to said ball direction signal and said random signal means; and adder means for adding said initial ball position signal and said horizontal ball displacement signal to provide a succession of horizontal ball position signals;

ball position means for simulating movement of said simulated ball down said simulated bowling alley from said starting line to said set of simulated bowling pins, wherein said ball position means includes horizontal ball position means and vertical ball position means, said horizontal ball position means computing a horizontal position for said ball in response to said ball path selection means and said random signal means for each of a plurality of positions along said bowling alley, and wherein said vertical ball position means providing successive vertical ball position signals, said ball position means being responsive to said ball path selection means and said random signal means for determining the path of the ball;

display means for displaying the position of said simulated ball as it moves down said simulated bowling alley, said display means including a plurality of lamps arranged in a plurality of rows, representing vertical ball position, and a plurality of columns, representing horizontal ball position, simulating said bowling alley, and circuit means responsive to said horizontal ball position signals and said vertical ball position signals for successively energizing a lamp in a column selected by one of said horizontal ball position signals and a row selected by one of said vertical ball position signals in sequence to display the simulated movement of said simulated ball down said simulated bowling alley from said starting line to said set of simulated pins;

step generator means for synchronizing said horizontal ball position means and said vertical ball position means, said step generator means providing step signals defining successive step intervals and vertical ball position means providing successive vertical ball position signals in successive step intervals, said step signals synchronizing said horizontal ball displacement generator means with said vertical ball position means whereby each successive horizontal ball position signal will coincide with a vertical ball position to signify horizontal and vertical positions of a simulated ball in said simulated alley;

pin disposition means enabled by a said step signal corresponding with the time of arrival of said ball with said set of bowling pins for determining which of said set of bowling pins will fall; and random number generator means providing a random number signal at said time of arrival, and wherein said pin disposition means is responsive to said horizontal ball position signal and said random number signal provided upon the enablement of said pin disposition means.

2. A simulated bowling game as recited in claim 1, wherein said pin disposition means is further responsive to said ball direction signal.

3. A simulated bowling game as recited in claim 2, further comprising pin status register means for storing data as to whether a pin is standing or fallen, said pin disposition generator means being further responsive to said pin status register means.

4. A simulated bowling game as recited in claim 1, further comprising pin status register means for storing data as to whether a pin is standing or fallen, and pin display means responsive to said pin status register means for displaying which of said pins remain standing.

5. A simulated bowling game as recited in claim 1, further comprising pin status register means for storing data as to whether a pin is standing or fallen and scoring means responsive to said pin in status register means for computing the score of a player of the game.

6. A simulated bowling game as recited in claim 5, wherein said scoring means comprises a scoring pulse train generator means for generating a train of pulses in response to said pin status register means with the number of pulses indicative of the number of fallen pins, scoring register means responsive to the pulses of said pulse train for computing the cumulative score of a player, and scoring display means responsive to said scoring register means for displaying the cumulative score of a player.

7. A simulated bowling game as recited in claim 6, wherein said scoring pulse train generator means provides a single pulse train, a double pulse train, and a triple pulse train, wherein one, two or three pulses signify a fallen pin, respectively, and pulse train selector means for selecting one of said pulse trains as an input to said scoring register means.

8. A simulated bowling game as recited in claim 7, further comprising strike-spare test means responsive to said pin status register means for providing a strike or a spare signal when the pin status register means indicates that all of said pins have fallen, said pulse train selector means being responsive to said strike and spare signals.

9. A simulated bowling game as recited in claim 8, further comprising strike and spare indicator lights and means responsive to said strike and spare signals for energizing said strike and spare indicator lights, respectively.

10. A simulated bowling game as recited in claim 7, wherein said scoring pulse generator means comprises means for scanning said pin status register means three times, for generating one pulse for each fallen pin on three output lines after the first scan, for generating one additional pulse for each fallen pin on the second and third output lines after the second scan, and for generating one additional pulse for each fallen pin on the third output line after the third scan.

11. A simulated bowling game as recited in claim 1, further comprising simulated sound means for generating a signal simulating the sound of a ball going down said alley and loudspeaker means for transducing said signal to a sound simulating a ball rolling down said alley, said sound generating means being enabled by a signal representing the initiation of movement of said ball down said alley.

12. A simulated bowling game as recited in claim 1, further comprising sound generating means for generating a sound simulating the sound of pins falling upon impact by said ball, said sound generating means being responsive to a signal indicating the arrival of said ball within the field of said pins.

13. A simulated bowling game as recited in claim 12, wherein said sound generating means further generates the sound of a ball rolling down said alley in response to a signal indicating the initiation of a ball rolled down said alley.

14. A simulated bowling game as recited in claim 1 further comprising display means including a plurality of lamps arranged in rows and columns to define said bowling alley, and lamp driver means responsive to said ball position means to energize a selected lamp of each row in sequence to display the simulated movement of said ball down said bowling alley, and means responsive to the arrival of a ball at said pins for displaying the return of said ball to the starting line of said alley.

15. A simulated bowling game as recited in claim 1, further comprising pin disposition means for determining which of said bowling pins will fall.

16. A simulated bowling game as recited in claim 15, further comprising random number generator means providing a random number signal at the time of arrival of a ball at said pins, and wherein said pin disposition means includes means for generating a horizontal ball position signal at the time of arrival of said ball at said pins, said pin disposition means being responsive to said horizontal ball position signal and said random number signal.

17. A simulated bowling game as recited in claim 16, wherein said ball path selection means includes means for selecting a ball direction, and wherein said pin disposition means is further responsive to said ball direction selection means.

18. A simulated bowling game as recited in claim 17, further comprising pin status register means for storing data as to whether a pin is standing or fallen, said pin disposition generator means being further responsive to said pin status register means.

19. A simulated bowling game as recited in claim 15, further comprising pin status register means for storing data as to whether a pin is standing or fallen and pin display means responsive to said pin status register means for displaying which of the pins remain standing.

20. A simulated bowling game as recited in claim 15, further comprising pin status register means for storing data as to whether a pin is standing or fallen and scoring means responsive to said pin status register means for computing the score of a player after each simulated roll of said ball.

21. A simulated bowling game as recited in claim 20, wherein said scoring means comprises a scoring pulse train generator responsive to said pin status register means for generating a train of pulses having a number of pulses related to the number of fallen pins, register means for computing the score after each roll of said ball in response to said pulses, and display means for displaying said score in response to said scoring register means.

22. A simulated bowling game as recited in claim 21, wherein said scoring pulse train generator means provides a single pulse train, a double pulse train, and a triple pulse train, wherein one, two or three pulses signify a fallen pin, respectively, and pulse train selector means selects one of said pulse trains as an input to said scoring register means.

23. A simulated bowling game as recited in claim 22, further comprising strike-spare test means responsive to said pin status register means for providing a strike or a spare signal when the pin status register means indicates that all of said pins have fallen, said pulse train selector means being responsive to said strike and spare signals.

24. A simulated bowling game as recited in claim 22, wherein said scoring pulse train generator means comprises means for scanning said pin status register means three times, for generating one pulse for each fallen pin on three output lines after the first scan, for generating one additional pulse for each fallen pin on the second and third output lines after the second scan, and for generating one additional pulse for each fallen pin on the third output line after the third scan.

* * * * *